US006918969B2

(12) United States Patent
Zeze et al.

(10) Patent No.: US 6,918,969 B2
(45) Date of Patent: Jul. 19, 2005

(54) CAST STEEL AND STEEL MATERIAL WITH EXCELLENT WORKABILITY, METHOD FOR PROCESSING MOLTEN STEEL THEREFOR AND METHOD FOR MANUFACTURING THE CAST STEEL AND STEEL MATERIAL

(75) Inventors: Masafumi Zeze, Kitakyushu (JP); Takashi Morohoshi, Kitakyushu (JP); Ryusuke Miura, Kitakyushu (JP); Shintaro Kusunoki, Kitakyushu (JP); Yasuhiro Kinari, Kitakyushu (JP); Masayuki Abe, Kitakyushu (JP); Hiroshi Sugano, Kitakyushu (JP); Kenichiro Miyamoto, Kitakyushu (JP); Masaharu Oka, Kitakyushu (JP); Yuji Koyama, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 92 days.

(21) Appl. No.: 10/222,362

(22) Filed: Aug. 16, 2002

(65) Prior Publication Data

US 2003/0015260 A1 Jan. 23, 2003

Related U.S. Application Data

(62) Division of application No. 09/719,206, filed as application No. PCT/JP00/02296 on Apr. 7, 2000, now Pat. No. 6,585,799.

(30) Foreign Application Priority Data

| | | |
|---|---|---|
| Apr. 8, 1999 | (JP) | 11-101163 |
| Apr. 9, 1999 | (JP) | 11-102184 |
| Apr. 9, 1999 | (JP) | 11-102379 |
| Apr. 21, 1999 | (JP) | 11-113673 |
| May 13, 1999 | (JP) | 11-133223 |
| May 26, 1999 | (JP) | 11-146443 |
| May 26, 1999 | (JP) | 11-146850 |
| Jun. 25, 1999 | (JP) | 11-180112 |
| Aug. 24, 1999 | (JP) | 11-237031 |
| Sep. 21, 1999 | (JP) | 11-267277 |
| Jan. 31, 2000 | (JP) | 2000-022056 |
| Mar. 10, 2000 | (JP) | 2000-66137 |
| Mar. 27, 2000 | (JP) | 2000-86215 |

(51) Int. Cl.[7] ..... C22C 38/10; C22C 38/00
(52) U.S. Cl. ..... 148/404; 148/320
(58) Field of Search ..... 148/404, 320, 148/325, 327

(56) References Cited

U.S. PATENT DOCUMENTS

| | | | |
|---|---|---|---|
| 3,754,893 A | 8/1973 | Frawley et al. | 75/568 |
| 5,690,753 A | 11/1997 | Kawauchi et al. | 148/320 |

FOREIGN PATENT DOCUMENTS

| | | |
|---|---|---|
| JP | 49-52725 | 5/1974 |

(Continued)

OTHER PUBLICATIONS

International Search Report PCT/JP00/02296.

*Primary Examiner*—Deborah Lee
(74) *Attorney, Agent, or Firm*—Kenyon & Kenyon

(57) ABSTRACT

A cast steel with excellent workability, characterized in that not less than 60% of the total cross section thereof is occupied by equiaxed crystals, the diameters (mm) of which satisfy the following formula:

$$D<1.2X^{1/3}+0.75,$$

wherein D designates each diameter (mm) of equiaxed crystals in terms of internal structure in which the crystal orientations are identical, and X the distance (mm) from the surface of the cast steel.

The cast steel and the steel material obtained by processing the cast steel have very few surface flaws and internal defects.

6 Claims, 11 Drawing Sheets

FOREIGN PATENT DOCUMENTS

| | | |
|---|---|---|
| JP | 50-16616 | 2/1975 |
| JP | 52-47522 | 4/1977 |
| JP | 52-60231 | 5/1977 |
| JP | 53-90129 | 8/1978 |
| JP | 57-62804 | 4/1982 |
| JP | 63-140061 | 6/1988 |
| JP | 2-151354 | 6/1990 |
| JP | 2-250925 | 10/1990 |
| JP | 7-48616 | 2/1995 |
| JP | 8-104950 | 4/1996 |
| JP | 8-155613 | 6/1996 |
| JP | 9-287015 | 11/1997 |
| JP | 10-102131 | 4/1998 |
| JP | 10-296409 | 11/1998 |
| JP | 10-324956 | 12/1998 |
| JP | 11-254107 | 9/1999 |
| JP | 11-286712 | 10/1999 |
| JP | 11-320033 | 11/1999 |
| JP | 11-320050 | 11/1999 |
| JP | 2000-61598 | 2/2000 |

CAST STEEL AND STEEL MATERIAL WITH EXCELLENT WORKABILITY, METHOD FOR PROCESSING MOLTEN STEEL THEREFOR AND METHOD FOR MANUFACTURING THE CAST STEEL AND STEEL MATERIAL

This application is a divisional application under 35 U.S.C. §120 and §121 of prior Application No. 09/719,206 filed Dec. 7, 2000, now U.S. Pat. No. 6,585,799 which is a 35 U.S.C. §371 National Stage of International Application No. PCT/JP00/02296 filed Apr. 7, 2000, wherein International Application No. PCT/JP00/02296 was filed and published in the Japanese language.

TECHNICAL FIELD

The present invention relates to a cast steel excellent in workability and quality with few surface flaws and internal defects, having a solidification structure of a uniform grain size, and to a steel material obtained by processing the cast steel.

Further, the present invention relates to a method for processing molten steel capable of improving quality and workability by enhancing the growth of solidification nuclei and fining a solidification structure when producing an ingot or a cast steel from the molten steel after it is subjected to decarbonization refining using a ingot casting method or a continuous casting method.

Yet further, the present invention relates to a method for casting a chromium-containing steel with few surface flaws and internal defects having a fine solidification structure, and to a seamless steel pipe produced using the steel.

BACKGROUND ART

Until now, cast steels have been produced by casting molten steel into slabs, blooms, billets and cast strips, etc. through ingot casting methods using fixed molds and through continuous casting methods using oscillation molds, belt casters and strip casters, etc. and by cutting them into prescribed sizes.

Said cast steels are heated in reheating furnaces, etc., and then processed to produce steel sheets and sections, etc. through rough rolling and finish rolling, etc.

Likewise, cast steels for seamless steel pipes are produced by casting molten steel into blooms and billets using ingot casting methods and continuous casting methods. Said cast steels are heated in reheating furnaces, etc., are then subjected to rough rolling, and are sent to pipe manufacturing processes as steel materials for pipe manufacturing. Further, the steel materials are formed into rectangular or round shapes after being heated again, and then are pierced with plugs to produce seamless pipes.

Solidification structures of cast steels before processing, as well as the conditions of processing such as rolling, etc., have a great influence on the properties and quality of the steel materials.

In general, the structure of a cast steel is, as shown in FIG. 7, composed of relatively fine chilled crystals in the surface layer cooled and solidified rapidly by a mold, large columnar crystals formed at the inside of the surface layer, and equiaxed crystals formed at the center portion. In some cases, the columnar crystals may reach the center portion.

When coarse columnar crystals exist in the surface layer of a cast steel as mentioned above, tramp elements of Cu, etc. and their chemical compounds segregate at the grain boundaries of the large columnar crystals, resulting in the brittleness of the segregated portions and the generation of surface flaws in the surface layer of the cast steel, such as cracks and dents caused by uneven cooling, etc. As a result, the yield deteriorates due to the increase of reconditioning work such as grinding and scrapping of the cast steel.

When processing the above-mentioned cast steel by rolling etc., since anisotropy of deformation caused by uneven crystal grain size becomes large, deformation behavior in the transverse direction becomes different from that in the longitudinal direction and the defects such as scabs and cracks, etc., are apt to arise. Further, forming properties such as the r-value (drawing index) deteriorate, and/or surface flaws such as wrinkles (in particular, ridging and roping in stainless steel sheets) appear.

In particular, in a stainless steel material in which the appearance is important, surface flaws such as edge seam defects and roping arise, leading to poor appearance and an increase in the edge trimming amount.

Further, when a seamless steel pipe is produced from the above-mentioned cast steel, surface flaws such as scabs and cracks or internal defects such as internal cracks, voids and center segregation caused by the cast steel remain in the steel pipe. Moreover, during pipe manufacturing, the above-mentioned defects are promoted by forming and piercing and defects such as cracks and scabs are generated on the inner surface of the steel pipe. This leads to the lowering of the yield due to the increase of reconditioning such as grinding or the frequent occurrence of scrapping.

This tendency appears markedly in ferritic stainless seamless pipes containing chromium.

When coarse columnar crystals and large equiaxed crystals exist at the interior of a cast steel, internal defects, such as internal cracks resulted from strain imposed by bulging and straightening, etc., center porosity resulted from the solidification contraction of molten steel and center segregation caused by the flow of unsolidified molten steel at the last stage of solidification, are generated in the cast steel.

Thus the surface flaws generated on a cast steel cause the deterioration of yield caused by an increase in reconditioning work such as grinding and the frequent occurrence of scrapping. If this cast steel is used as it is for processing such as rough rolling and finish rolling, etc., in addition to the surface flaws generated on the cast steel, internal defects such as internal cracks, center porosity and center segregation, etc., remain in the steel material, resulting in the rejection by UST (Ultrasonic Test), the degradation of strength or the deterioration of appearance, and consequent increase of reconditioning work and frequent occurrence of scrapping of the steel material.

Surface flaws and internal defects in a cast steel can be suppressed by improving the solidification structure of the cast steel.

Further, the generation of surface flaws such as surface cracks and dents caused by uneven cooling and uneven solidification contraction arising in a cast steel can be suppressed by making the solidification structure of the cast steel uniform and fine.

Moreover, the generation of internal defects such as internal cracks, center porosity and center segregation, etc., caused by the solidification contraction and the flow of unsolidified molten steel, etc. at the interior of the cast steel can be suppressed by raising the equiaxed crystal ratio at the interior of the cast steel.

Therefore, to suppress the occurrence of surface flaws and internal defects of a cast steel and a steel material produced therefrom and improve the workability and quality such as toughness, etc., of the cast steel, it is important to suppress the coarsening of columnar crystals at the surface layer of the cast steel, to raise the equiaxed crystal ratio at the interior of the cast steel, and to make a uniform and fine solidification structure as a whole.

To cope with these problems, various measures for preventing the occurrence of surface flaws and internal defects in a cast steel and a steel material produced therefrom, such as to devise the form of inclusions in molten steel and to make a solidification structure into fine equiaxed crystal structure by controlling solidification process, have been attempted.

By the way, as measures to raise an equiaxed crystal ratio in the solidification structure of a cast steel, known are (1) a method for casting at a low temperature by lowering the temperature of molten steel, (2) a method for electromagnetically stirring molten steel in solidification process, and (3) a method for generating oxides and inclusions in molten steel by adding themselves or other components in molten steel to act as solidification nuclei at the time of the solidification of molten steel, or a method combining the above methods (1) to (3).

As an embodiment related to low temperature casting by the above method (1), for example, disclosed is a method in Japanese Examined Patent Publication No. 7-84617 for preventing ridging from occurring on a ferritic stainless steel sheet by extracting a cast steel while cooling it in a mold and maintaining the superheat temperature (a temperature obtained by subtracting liquidus temperature of molten steel from actual temperature of molten steel) at not more than 40° C. while continuously casting molten steel, and by maintaining the equiaxed crystal ratio of the cast steel to not less than 70%.

However, according to the method disclosed in Japanese Examined Patent Publication No. 7-84617, since the superheat temperature is lowered, there occur the problems of generating nozzle clogging caused by the solidification of molten steel during casting, making casting difficult due to the adhesion of skull, preventing the floating of inclusions caused by the increase of viscosity, and generating defects caused by inclusions remaining in molten steel. Therefore, by this method, it is difficult to lower the superheat temperature to the extent that a cast steel with sufficient equiaxed crystal ratio can be obtained.

Thus, it has not so far been clarified as to how large grain size of equiaxed crystals from the surface layer to the interior of a cast steel is desirable and how uniform the solidification structure should be.

In Japanese Unexamined Patent Publication No. 57-62804, a method is disclosed for reducing a cast steel and bonding the central area with pressure under the condition that unsolidified portions remain in the interior, in order to eliminate internal defects such as center porosity, etc. in the cast steel.

However, according to the method disclosed in Japanese Unexamined Patent Publication No. 57-62804, since the center area of a cast steel is bonded with pressure by reduction, when the unsolidified portion is large, the brittle solidified layer is subjected to a large reduction force, and this causes internal cracks and center segregation, etc. On the other hand, when the reduction is insufficient, there are problems that internal defects such as center porosity, etc. remain, and this causes the generation of defects on inner surface, such as cracks and scabs, when the cast steel is pierced in the pipe manufacturing process, which causes the deterioration of quality of the steel pipe.

As mentioned above, by those conventional methods, it is difficult to produce a chromium-containing cast steel having a fine solidification structure and controlled surface flaws and internal defects and further to produce a pipe without breaking down (applying large reduction to) the continuously cast steel. Moreover, it has not so far been clarified as to what kind of casting and treatment of a cast steel should be carried out for producing stably and industrially a pipe of chromium-containing steel (ferritic stainless steel) without defects.

Further, as a method for applying electromagnetic stirring to molten steel according to the above method (2), for example, as disclosed in Japanese Unexamined Patent Publication Nos. 49-52725 and 2-151354, there is a method for improving the solidification structure of a cast steel by applying electromagnetic stirring to molten steel in a mold or downstream of the mold during a solidification process, promoting the floating of inclusions and controlling the growth of columnar crystals.

However, according to the method disclosed in Japanese Unexamined Patent Publication Nos. 49-52725 and 2-151354, when a stirring flow is imposed on molten steel at the vicinity of a mold by electromagnetic stirring, though the solidification structure of the surface layer portion of a cast steel can become fine, that of the interior of the cast steel cannot become sufficiently fine. On the other hand, when a stirring flow is imposed on molten steel downstream of a mold, though the solidification structure of the interior of a cast steel can become fine, large columnar crystals are formed at the surface layer portion of the cast steel, and thus it is impossible to make the solidification structures of the interior and surface layer portions of the cast steel fine at the same time.

Moreover, by only imposing a stirring flow on molten steel during solidification process with electromagnetic stirring, it is difficult to obtain a cast steel having a fine solidification structure with a prescribed grain size, and thus the effect of electromagnetic stirring on the fining of a solidification structure is limited.

Further, as a method for applying electromagnetic stirring to molten steel, as disclosed in Japanese Unexamined Patent Publication No. 50-16616, there is a method for preventing ridging by applying electromagnetic stirring to molten steel during a solidification process, cutting the tips of growing columnar crystals, making use of the cut tips of the columnar crystals as solidification nuclei, and controlling equiaxed crystal ratio in the solidification structure of the cast steel to not less than 60%.

However, according to the method disclosed in Japanese Unexamined Patent Publication No. 50-16616, since electromagnetic stirring is applied to a cast steel leaving a mold, columnar crystals exist in the surface layer of the cast steel. Thus, on the cast steel, surface flaws such as cracks and dents caused by the columnar crystals occur, and on the steel material processed by rolling, etc., in addition to scabs and cracks, surface flaws such as ridging occur.

Yet further, there are methods, as disclosed in Japanese Unexamined Patent Publication No. 52-47522, for producing a cast steel with a fine solidification structure by installing an electromagnetic stirrer at a point 1.5 to 3.0 m distant from the meniscus in a continuous casting mold and stirring molten steel at a thrust of 60 mmHg, and, as disclosed in Japanese Unexamined Patent Publication No. 52-60231, for producing a steel material not having internal defects such as center segregation and center porosity, etc. by casting molten steel at the superheat temperature of 10 to 50° C., also applying electromagnetic stirring to unsolidified layer of a cast steel under casting, and making the solidification structure into fine structure composed of equiaxed crystals.

However, according to the method disclosed in Japanese Unexamined Patent Publication No. 52-47522, since growing columnar crystals (a dendrite structure) are suppressed by applying electromagnetic stirring to molten steel during solidifying in a mold, though the solidification structure near the portion where electromagnetic stirring is imposed can become fine to some extent, to make the whole solidification structure of the cast steel fine, there is still a problem that a multistage electromagnetic stirrer is necessary and thus the equipment cost increases. Moreover, the installation of a multistage electromagnetic stirrer is extremely difficult from the viewpoint of space for installation, and thus the method disclosed in Japanese Unexamined Patent Publication No. 52-47522 has a limitation in producing a cast steel a whole solidification structure of which is fine.

Further, according to the method disclosed in Japanese Unexamined Patent Publication No. 52-60231, since low temperature casting is applied, there are problems that nozzles clog due to the deposition of inclusions on the inner surface of an immersion nozzle, a skin is formed on the surface of molten steel due to the temperature drop of molten steel in a mold, and thus, in some cases, the operation becomes unstable and the casting operation is interrupted.

As mentioned above, in case of low temperature casting, because the temperature for casting molten steel is lowered, problems occur such as the interruption of casting caused by the clogging of an immersion nozzle used for pouring molten steel in a mold and the decline of casting speed caused by the decrease of the feed amount of molten steel, and thus it is difficult to lower the casting temperature to the extent capable of stably making the solidification structure of a cast steel fine.

Further, in case of using an electromagnetic stirrer, even though electromagnetic stirring is applied locally during the solidification of molten steel, there are drawbacks in that columnar crystals and coarse equiaxed crystals are generated and this causes surface flaws and internal defects, and thus yield deteriorates due to the increase of reconditioning and the frequent occurrence of scrapping and the quality of the steel material also deteriorates due to internal defects such as internal cracks and center porosity, etc.

On the other hand, it may be considered to make a solidification structure fine over the whole cross section of a cast steel by installing a plurality of electromagnetic stirrers at the downstream side of a mold including a meniscus. However, since the degree of fining varies depending on the portion where stirring is applied, it is impossible to stably obtain a fine solidification structure over the whole cast steel. If it is required to obtain a stable and fine solidification structure, the number of electromagnetic stirrers to be installed increases. Since the number of electromagnetic stirrers to be installed is restricted by equipment cost and the configuration of a continuous caster, the installation itself of the required number of stirrers is difficult. In any event, even though a plurality of electromagnetic stirrers are installed, sufficient fining of a solidification structure cannot be obtained.

Moreover, as an embodiment of a method for generating oxides and inclusions in molten steel, which act as solidification nuclei, by adding the oxides or inclusions themselves or other components into molten steel according to the above method (3), for example, disclosed is a method, in Japanese Unexamined Patent Publication No. 53-90129, for making whole solidification structure of a cast steel into equiaxed crystals by adding into molten steel a wire wherein iron powder and oxides of Co, B, W and Mo, etc., are wrapped and applying a stirring flow to the place where the wire melts. However, by this method, the dissolution of the additives in the wire is unstable and sometimes undissolved remainders appear. When undissolved remainders appear, they cause product defects. Even if all the additives in the wire are dissolved, it is extremely difficult to uniformly disperse the additives throughout the entire cast steel from the surface layer to the interior. As a result, the size of the solidification structure becomes uneven which is not desirable. Besides, since the effect of equiaxed crystallization is influenced by the position of an electromagnetic stirrer and the stirring thrust, this method has a drawback of undergoing constraint by conditions related to equipment. A method for adding fine particles of TiN, etc. during casting is disclosed in Japanese Unexamined Patent Publication No. 63-140061. However, this method has the same drawbacks as that of Japanese Unexamined Patent Publication No. 53-90129.

With regard to the effect of generating inclusions which act as solidification nuclei by adding required components in molten steel, for example, a method is generally known to form TiN in molten steel of ferritic stainless steel and to produce equiaxed crystals in the solidification structure (Tetsu to Hagane Vol.4-S79, 1974, for example). However, to obtain a sufficient effect of equiaxed crystallization by the formation of TiN as mentioned above, as described in above "Tetsu to Hagane," it is necessary to increase Ti concentration in molten steel up to not less than 0.15 mass %.

Therefore, to obtain sufficient equiaxed crystallization by the formation of TiN as mentioned above, an increased addition amount of expensive Ti alloy is required, which leads to a higher manufacturing cost. Furthermore, there arise the problems of nozzle throttling caused by coarse TiN during casting and formation of scabs on the product sheet. Besides, since the chemical composition of the steel is restricted in relation to the addition amount of TiN, applicable steel grades are limited.

A means is desired for effectively obtaining a cast steel with a fine equiaxed crystal structure by adding some components in as small amounts as possible, and for that reason, a method to add Mg to molten steel is proposed.

However, since the boiling point of Mg is about 1,107° C., lower than the temperature of molten steel and the solubility of Mg in molten steel is almost zero, even if metallic Mg is added to molten steel, most of it is vaporized and escapes away. Therefore, if Mg is added by a usual method, the Mg yield generally becomes very low, and thus it is necessary to devise a means for Mg addition.

The present inventors, during the course of research on Mg addition, have found that the composition of oxides formed after Mg addition is affected by not only the composition of molten steel but also the composition of slag. That is, it has been found that, by only adding Mg to molten steel, it is difficult to form inclusions which have composition acting effectively as solidification nuclei in molten steel.

For example, in Japanese Unexamined Patent Publication No. 7-48616, disclosed is a method for improving Mg yield in molten steel by providing the slag covering the molten steel surface in a container such as a ladle with $CaO—SiO_2—Al_2O_3$ slag containing MgO adjusted to 3 to 15 wt % and FeO, $Fe_2O_3$ and MnO adjusted to not more than 5 wt %, and adding Mg alloy passing through the slag, and also, for improving the quality of a steel material by forming fine oxides of MgO and $MgO—Al_2O_3$.

According to the method disclosed in Japanese Unexamined Patent Publication No. 7-48616, since the slag of $CaO—SiO_2—Al_2O_3$ covers the surface of the molten steel, there is an advantage that the improvement of yield can be expected by suppressing the evaporation of Mg. However, by the method disclosed in Japanese Unexamined Patent Publication No. 7-48616, only the total amount of FeO, $Fe_2O_3$ and MnO in slag covering molten metal is specified to be not more than 5 wt % and the amount of $SiO_2$ is not specified. Then, if $SiO_2$ is abundantly contained in slag, when metallic Mg or Mg alloy is added, Mg reacts with $SiO_2$ contained in slag and the Mg yield in molten steel drops. When the Mg yield is low, $Al_2O_3$, etc., in molten steel can not be reformed into oxides containing MgO, coarse oxides of $Al_2O_3$ remain in molten steel and this causes the generation of defects in a cast steel and a steel material after all.

Since the function of $Al_2O_3$ system oxides as solidification nuclei is limited, the solidification structure of a cast steel coarsens and defects, such as cracks, center segregation and center porosity, etc., arise on the surface or in the interior of the cast steel, and thus the yield of the cast steel deteriorates.

Further, there are problems that, in the steel material produced from the above cast steel too, surface flaws and internal defects caused by a coarse solidification structure arise, and thus yield and quality deteriorate.

Moreover, since no restrictions are specified for CaO concentration in slag or Ca concentration in molten steel, in some cases, instead of the generation of high-melting-point MgO, etc., low-melting-point complex compounds ($CaO—Al_2O_3—MgO$ oxides) which do not act as solidification nuclei are generated.

In Japanese Unexamined Patent Publication Nos. 10-102131 and 10-296409, proposed are methods for improving the solidification structure of a cast steel by controlling the amount of Mg contained in molten steel at 0.001 to 0.015 wt %, forming fine oxides with good dispersibility, and distributing the oxides over the entire cast steel.

However, by the methods disclosed in Japanese Unexamined Patent Publication Nos. 10-102131 and 10-296409, since oxides are uniformly distributed from the surface layer portion to the interior of a cast steel at a high density of not less than $50/mm^2$, in some cases, defects such as cracks and scabs caused by oxides arise on the cast steel, the cast steel being processed or the steel material processed from the cast steel. In this case, reconditioning such as surface grinding, etc. is required or the steel material is scrapped, and thus the yield of products drops.

Further, when oxides are exposed on the surface of a steel material or exist in the vicinity of a surface layer, there are problems that, when the oxides touch acid or salt water, etc., oxides (oxides containing MgO) dissolve out and the corrosion resistance of the steel material deteriorates.

Then, as a result of carrying out various experiments to clarify the optimum conditions for equiaxed crystallization obtained by adding Mg to molten steel, the present inventors have newly found that, even though a molten steel component and/or a slag composition are not changed, the order of the addition of Mg and deoxidation elements such as Al has a great influence on the effect on equiaxed crystallization.

That is, it was found that, when Al is added after Mg is added to molten steel, since $Al_2O_3$ covers the surface of MgO generated after Mg addition, the generated MgO does not act effectively as a solidification nucleus.

As a result, the effect of MgO on making a solidification structure fine cannot be obtained, the solidification structure coarsens, and surface flaws such as cracks, etc. and internal defects such as center segregation and center porosity, etc. arise. As a result, reconditioning work of a cast steel and a steel material increases, a cast steel and a steel material are scrapped, and the yield and quality of products deteriorate.

As mentioned above, by conventional methods of adding oxides and inclusions themselves to molten steel as solidification nuclei, and generating solidification nuclei in molten steel by adding a required component, it is difficult to obtain a cast steel of a uniform solidification structure without defects. Therefore, there is a problem that it is impossible to obtain a cast steel with excellent workability during rolling, etc., and further a steel material with good quality and few defects.

It has so far not been clarified as to what kind of solidification structure should be obtained for stably and industrially producing a cast steel with good workability but without defects.

As explained above, the reality is that, with the conventional methods for obtaining equiaxed crystallization of a cast steel by casting at a low temperature, adopting electromagnetic stirring or adding oxides which form solidification nuclei, it is impossible to stably and industrially produce a steel material with excellent quality and few defects by suppressing the generation of surface flaws and internal defects such as cracks, dents, center segregation and center porosity, etc. which arise in a cast steel, and further obtaining a defect-less cast steel having a solidification structure with a uniform grain diameter, and thus improving the workability of the cast steel.

SUMMARY OF THE INVENTION

The present invention has been made in consideration of above circumstances and an object of the invention is to provide a cast steel with excellent workability and/or quality by making a solidification structure fine and uniform and suppressing the generation of surface flaws and internal defects such as cracks, center porosity and center segregation.

Another object of the present invention is to provide a steel material, obtained by processing said cast steel, excellent in workability and/or quality without surface flaws and internal defects.

A further object of the present invention is to provide a method for processing molten steel capable of making a solidification structure of a cast steel fine by promoting the generation of MgO-containing oxides with high melting points and making them act as solidification nuclei.

An even further object of the present invention is to provide a continuous casting method capable of casting a cast steel excellent in quality such as corrosion resistance, etc., with few defects which arise in a steel material during processing the cast steel into the steel material by making the solidification structure of the cast steel fine and suppressing the generation of surface flaws and internal defects such as cracks and segregation, etc.

An additional object of the present invention is to provide a method for casting a cast steel of chromium-containing steel capable of improving product yield, etc., with few defects arising in the steel pipe when a seamless steel pipe is produced from the cast steel by making the solidification structure of the cast steel fine and suppressing the generation of surface flaws and internal defects such as cracks and segregation, etc., and the steel pipe produced from said cast steel.

A cast steel of the present invention complying with aforementioned objects (hereunder referred to as "Cast Steel A") is characterized in that not less than 60% of the total cross section of the cast steel is occupied by equiaxed crystals, the diameters (mm) of which satisfy the following formula:

$$D<1.2X^{1/3}+0.75,$$

wherein D designates each diameter (mm) of equiaxed crystals in terms of internal structure in which the crystal orientations are identical, and X the distance (mm) from the surface of the cast steel.

In a cast steel, by obtaining a solidification structure satisfying the above formula, it becomes possible to make the width of columnar crystals remaining in the surface layer of the cast steel narrow, to enhance resistance to cracking by suppressing micro-segregation caused by the allocation of solid and liquid of molten steel component during solidification, to suppress the generation of crack defects resulted from stress imposed by strain during solidification, bulging and straightening, etc., of the cast steel, and further to prevent the generation of internal defects such as center porosity and center segregation, etc., caused by the solidification contraction and flowing of molten steel in the center portion of the thickness.

Moreover, since Cast Steel A with a solidification structure satisfying the above formula has a uniform deformation property and an excellent workability when processed by rolling, etc., the generation of surface flaws and internal defects are suppressed in the processed steel material.

Further, in Cast Steel A, said equiaxed crystals can occupy the total cross section of the cast steel.

By occupying the total cross section of a cast steel with a uniform and fine solidification structure without columnar crystals and making micro-segregation in the surface layer and interior of the cast steel smaller, the resistance to cracks caused by strain and stress during solidification can be enhanced. As a result, the generation of surface flaws and internal defects of a cast steel can be prevented and workability is improved by the improvement of uniformity of deformation, during forming, over the surface layer to the interior of the cast steel.

Another cast steel with excellent workability of the present invention complying with the aforementioned objects (hereunder referred to as "Cast Steel B") is characterized in that the maximum crystal grain diameter at a depth from the surface of the cast steel is not more than three times of the average crystal grain diameter at the same depth.

By obtaining a solidification structure satisfying above condition regarding crystal grain diameter, the grain diameter of crystals present at a prescribed depth from the surface layer of a cast steel can be uniform. As a result, the local segregation of tramp elements of Cu, etc. at grain boundaries is suppressed and thus grain boundary cracks at the surface layer is also suppressed. Further, when subjected to forming, since uniform deformation of crystal grains can be obtained and the concentration of deformation to specific crystal grains can be suppressed, an r-value, which is a drawing index, can be improved and surface flaws such as wrinkles, ridging and roping, etc., can be prevented.

Further, in Cast Steel B, not less than 60% of the cross section in the direction of the thickness of the cast steel can be occupied by equiaxed crystals.

By occupying not less than 60% of the cross section in the direction of the thickness of a cast steel with equiaxed crystals, it is possible to make the solidification structure of the cast steel into the structure where the growth of columnar crystals is suppressed. As a result, grain boundary segregation in the surface layer and the interior of the cast steel is further suppressed, resistance to cracks caused by strain and stress during solidification is enhanced, the generation of surface flaws and internal defects in the cast steel is suppressed, the isotropy of deformation behavior during forming (stretch to transverse and longitudinal directions by reduction) improves, and thus workability improves. That is, in a steel material, surface flaws such as cracks, scabs and wrinkles caused by the unevenness of deformation by forming, etc., can be prevented from occurring.

Further, in Cast Steel B, the whole cross section in the direction of the thickness of the cast steel can be occupied by equiaxed crystals.

In such a solidification structure, since micro-segregation is further suppressed and a more uniform solidification structure is obtained, for a cast steel, resistance to cracks, etc. is enhanced, the generation of surface flaws and internal defects is more securely prevented, uniformity of deformation from the surface layer to the interior of the cast steel during forming improves, and thus workability, r-value and toughness improve.

A cast steel with excellent quality and workability of the present invention complying with the aforementioned objects (hereunder referred to as "Cast Steel C") is characterized by containing not less than 100/cm$^2$ of inclusions whose lattice incoherence with δ-ferrite formed during the solidification of molten steel is not more than 6%.

Inclusions whose lattice incoherence with δ-ferrite is small act as inoculation nuclei efficiently generating many solidification nuclei. If many solidification nuclei are formed, a solidification structure becomes fine and, as a result, micro-segregation in the surface layer and the interior of a cast steel is suppressed and crack resistance against uneven cooling and contraction stress, etc. improves. Further, solidification nuclei provide pinning action (suppressing crystal grain growth immediately after solidification) after solidification, the coarsening of a solidification structure is suppressed, and a more stable and fine solidification structure can be obtained.

Thus, a cast steel with such solidification structure transforms easily in the direction of reduction when subjected to forming such as rolling, etc. That is, this cast steel has extremely high workability.

When the number of inclusions contained in a cast steel becomes less than 100/cm$^2$, the number of generated solidification nuclei falls and, at the same time, a pinning action after solidification becomes insufficient, and thus the solidification structure of the cast steel becomes coarse, and, as a result, surface flaws and internal defects arise in the cast steel.

Further, in Cast Steel C, not less than 100/cm$^2$ of inclusions, the sizes of which are not more than 10 μm, can be contained.

If inclusions are fine, since solidification nuclei can be generated efficiently and abundantly and a pinning action can be promoted, a finer and more uniform solidification structure can be obtained. In a cast steel with such a solidification structure, workability is good when subjected to processing such as rolling, etc., and surface flaws and internal defects such as scabs, surface cracks and wrinkles, etc., are not generated in the steel material.

If the size of inclusions exceeds 10 μm, though they act as solidification nuclei when molten steel solidifies, there is a problem that scabs and slivers are apt to arise.

Cast Steel C may be of a steel grade whose solidified primary crystals are composed of δ-ferrite.

Even though Cast Steel C is of a steel grade wherein phase transformation occurs during the cooling of the cast steel and structure other than ferrite is formed after solidification or during cooling, inclusions in the Cast Steel C act as inoculation nuclei and promote the generation of solidification nuclei of δ-ferrite, and therefore fine and uniform solidification structure can be obtained. As a result, the crystal structure of the cast steel after cooling can be fine.

A cast steel, with the excellent quality of the present invention complying with the aforementioned objects (hereunder referred to as "Cast Steel D") is characterized in that, in said cast steel cast by adding metal or metallic compound to molten steel for forming solidification nuclei during the solidification of the molten steel, the number of the metallic compounds the sizes of which are not more than 10 μm contained further inside than the surface layer portion of said cast steel is not less than 1.3 times the number of the metallic compounds the sizes of which are not more than 10 μm contained in said surface layer portion.

As mentioned above, in Cast Steel D, among the metallic compounds produced by adding metal to molten steel or metallic compounds added directly to molten steel, the metallic compounds the sizes of which are not more than 10 μm are included more abundantly in the interior than in the surface layer portion of the cast steel. These metallic compounds act as solidification nuclei when molten steel solidifies, and reduce the diameter of equiaxed crystals, and, as a result, suppress grain boundary segregation. Further, these metallic compounds provide a pinning action and suppress the coarsening of equiaxed crystals after solidification.

After all, in Cast Steel D, cracks by strain and stress during solidification and surface flaws caused by dents and inclusions are prevented from occurring, resistance to internal cracks caused by strain imposed by bulging and straightening of the cast steel is intensified, and the generation of internal defects such as center porosity and center segregation, etc., caused by solidification shrinkage and flowing of molten steel at the last stage of solidification, is also suppressed.

Besides, in Cast Steel D, since the number of metallic compounds in the surface layer portion is controlled to be less than the number of metallic compounds in the interior portion, when the cast steel is subjected to processing such as rolling, etc., surface flaws produced caused by inclusions are reduced, and quality such as corrosion resistance, etc. and workability, etc. improve.

Here, the surface layer portion in Cast Steel D designates the portion in the range between than 10% and 25% away from the surface. If it deviates from this range, the surface layer portion becomes excessively thin and the interior portion having metallic compound abundantly becomes close to the surface layer portion, the number of metallic compounds in the interior portion increases, the solidification structure of the surface layer portion cannot become fine, and defects are apt to be generated by metallic compounds when the cast steel is processed.

Here, lattice incoherence of metallic compound contained in molten steel with δ-ferrite formed during the solidification of molten steel may be controlled at not more than 6%.

By doing so, the ability to form solidification nuclei during the solidification of molten steel improves, a much finer solidification structure can be obtained, and the size of micro-segregation in the surface layer portion and interior portion can be decreased to the utmost. Moreover, deformation in the direction of reduction becomes easy and a cast steel excellent in workability and quality can be stably produced.

Further, Cast Steel D can be a ferritic stainless steel.

In Cast Steel D of ferritic stainless steel, a solidification structure which tends to coarsen can easily be made into fine equiaxed crystals.

In the above cast steel of the present invention, "MgO-containing oxides" formed by adding Mg or Mg alloy in molten steel can be included.

By including "MgO-containing oxides", it is possible to suppress the aggregation of oxides in molten steel, to raise the dispersibility of the oxides, and to increase the number of the oxides which act as solidification nuclei. As a result, the solidification structure of a cast steel becomes fine more stably.

The aforementioned cast steel of the present invention is, after being heated, for example, after being heated to a temperature of 1,100 to 1,350° C., processed into a steel material through rolling, etc. Since the cast steel of the present invention has various characteristics as mentioned above, the cast steel provides the advantages that resistance to cracking during forming such as rolling, etc. is high, the concentration of deformation to specific crystal grains during forming is suppressed, and uniform deformation of crystal grains (isotropy of deformation behavior) can be obtained.

Therefore, since the aforementioned cast steel of the present invention uniformly deforms in the transverse and longitudinal directions by reduction, the steel material of the present invention obtained by processing said cast steel has the advantages that surface flaws such as scabs and cracks, etc. and internal defects such as center porosity and center segregation, etc. generated in the steel material are extremely rare. Moreover, the steel material of the present invention has other advantages in that surface flaws and internal defects caused by inclusions are also rare and qualities such as corrosion resistance, etc. are good.

Methods for processing molten steel required for producing the above-mentioned cast steel of the present invention (hereunder referred to as "Processing Method of the Present Invention") will be explained hereafter.

A Processing Method of the Present Invention (hereunder referred to as "Processing Method I") is characterized by controlling the total amount of Ca in molten steel refined in a refining furnace at not more than 0.0010 mass %, and then adding a prescribed amount of Mg therein.

By Processing Method I, the generation of calcium aluminate (low-melting-point inclusions such as $12CaO\text{-}7Al_2O_3$) can be suppressed. As a result, the generation of ternary system complex oxides of $CaO—Al_2O_3—MgO$ formed by adding Mg oxides (MgO) to calcium aluminate is prevented and high-melting-point oxides such as MgO and $MgO—Al_2O_3$, etc. which act as solidification nuclei can be formed.

Here, the total amount of Ca is the sum total quantity of Ca existing in molten steel and the Ca portion of "Ca-containing chemical compounds" such as CaO, etc. The content of Ca specified in Processing Method I means that Ca is not included in molten steel at all or that not more than 0.0010 mass % of Ca is included in molten steel.

Further, in Processing Method I of the present invention, complex oxides of calcium aluminate may not be contained in molten steel.

By doing so, when oxides (MgO) exist in molten steel, the generation of ternary system complex oxides of $CaO—Al_2O_3—MgO$ generally formed from calcium aluminate and oxides (MgO) is stably prevented, and, as a result, high-melting-point oxides (hereunder occasionally referred to as "MgO-containing oxides") such as MgO and $MgO—Al_2O_3$, etc., can be steadily generated in molten steel, the solidification structure of the cast steel becomes fine, and the generation of surface flaws and internal defects in the cast steel can be prevented.

It is desirable that the addition amount of Mg in molten steel be 0.0010 to 0.10 mass %.

If the addition amount of Mg is less than 0.0010 mass %, the number of solidification nuclei by MgO-containing oxides in molten steel falls and a solidification structure cannot be made fine. On the other hand, if the addition amount of Mg exceeds 0.10 mass %, the effect of making fine the solidification structure is saturated, the Mg and Mg alloy added are ineffective, and also defects caused by the increase of oxides including MgO and MgO-containing oxides may arise.

In a cast steel of the present invention produced by pouring and cooling molten steel processed by Processing Method I of the present invention in a mold, a solidification structure is fined by fine MgO and/or MgO-containing oxides and the generation of surface flaws, such as cracks and dents, etc., arising on the surface of the cast steel and internal defects such as internal cracks, center porosity and center segregation, etc., is suppressed. Then, when a steel material is produced by processing this cast steel through rolling, etc., the generation of surface flaws and internal defects in the steel material is prevented, reconditioning and scrapping can be prevented, and thus the product yield and the material properties improve.

Another Processing Method of the Present Invention (hereunder referred to as "Processing Method II") is characterized by carrying out a deoxidation treatment by adding a prescribed amount of an "Al-containing alloy" to molten steel before adding a prescribed amount of Mg therein.

Processing Method II is a method to add "Al-containing alloy" in advance, generate $Al_2O_3$ by reacting the "Al-containing alloy" with oxygen, MnO, $SiO_2$ and FeO, etc., in molten steel, and after that, form MgO or MgO—$Al_2O_3$ generated by the oxidation of Mg on the surface of $Al_2O_3$ by adding a prescribed amount of Mg. MgO or MgO—$Al_2O_3$ present on the surface of $Al_2O_3$ acts as solidification nuclei when molten steel solidifies, because its lattice incoherence with δ-ferrite which is solidified primary crystals is not more than 6%. As a result, a solidification structure becomes fine, the generation of surface flaws such as cracks, etc., and internal defects such as center segregation and center porosity, etc., is suppressed, and the deterioration of workability and corrosion resistance is also suppressed.

"Al-containing alloy" means a substance containing Al such as metallic Al and an Fe—Al alloy, etc., and "Mg added" means metallic Mg and a "Mg-containing alloy" such as Fe—Si—Mg alloy and Ni—Mg alloy, etc.

Further, in Processing Method II of the present invention, before adding Mg to molten steel, a deoxidation treatment by adding a prescribed amount of a "Ti-containing alloy", in addition to a prescribed amount of "Al-containing alloy", may be adopted.

By adding a "Ti-containing alloy" as described above, it is possible to dissolve Ti as a solid solution in molten steel, to precipitate a part of said Ti as TiN, to let them act as solidification nuclei, further to form MgO or MgO—$Al_2O_3$ on the surface of $Al_2O_3$ generated by deoxidation, and also to let them act as solidification nuclei. Here, a "Ti-containing alloy" means a substance containing Ti such as metallic Ti and an Fe—Ti alloy, etc.

In Processing Method II of the present invention, it is desirable that the addition amount of Mg be 0.0005 to 0.010 mass %.

By adding Mg within this range, MgO or MgO—$Al_2O_3$ can form sufficiently on the surface of $Al_2O_3$ generated by deoxidation. MgO or MgO—$Al_2O_3$ acts sufficiently as solidification nuclei and makes a solidification structure finer when molten steel solidifies.

If the addition amount of Mg is less than 0.0005 mass %, the number of oxides having surfaces whose lattice incoherence with δ-ferrite is not more than 6% is insufficient and it is impossible to make a solidification structure fine. On the other hand, if the addition amount of Mg exceeds 0.010 mass %, the effect of making fine a solidification structure is saturated and the cost required for adding Mg becomes high.

Further, in Processing Method II of the present invention, the molten steel can be a ferritic stainless steel.

According to Processing Method II of the present invention, it is possible to make fine a solidification structure of ferritic stainless steel which is apt to coarsen. As a result, cracks and dents generated on the surface of a cast steel, internal cracks, center porosity and center segregation, etc., are suppressed.

In Processing Methods I and II of the present invention, it is desirable to add Mg so that oxides such as slag and deoxidation products, etc. contained in molten steel and oxides produced during the addition of Mg to the molten steel satisfy the following formulae (1) and (2):

$$17.4(kAl_2O_3)+3.9(kMgO)+0.3(kMgAl_2O_4)+18.7(kCaO)\leqq 500 \quad (1)$$

$$(kAl_2O_3)+(kMgO)+(kMgAl_2O_4)+(kCaO)\geqq 95 \quad (2),$$

wherein k designates mole % of the oxides.

By Mg addition, complex oxides such as CaO—$Al_2O_3$—MgO, MgO—$Al_2O_3$ and MgO, etc. which are oxides whose lattice incoherence with δ-ferrite is not more than 6% and act effectively as solidification nuclei can be generated. When molten steel solidifies, these complex oxides act as solidification nuclei, generate equiaxed crystals, and make the solidification structure of a cast steel fine.

The Mg addition can apply to molten steel of ferritic stainless steel.

That is, by adding Mg as described above, it is possible to make fine a solidification structure of ferritic stainless steel which is apt to coarsen and to suppress internal cracks, center porosity and center segregation, etc. generated in a cast steel. Further, in a steel material processed from said cast steel, it is possible to prevent the generation of roping and edge seam defects caused by a coarse solidification structure.

A further Processing Method of the Present Invention (hereunder referred to as "Processing Method III") is characterized by adding a prescribed amount of Mg to the molten steel having the concentrations of Ti and N satisfying the solubility product constant where TiN crystallizes at a temperature not lower than the liqudus temperature of the molten steel.

According to Processing Method III, when a temperature is so high that TiN does not crystallize, "MgO-containing oxides" such as MgO and MgO—$Al_2O_3$ with good dispersibility are generated, and then, as the molten steel temperature drops, TiN crystallizes on the "MgO-containing oxides", disperses in the molten steel, acts as solidification nuclei, and makes fine a solidification structure of a cast steel. Here, the addition of Mg is carried out by adding metallic Mg and "Mg-containing alloy" such as Fe—Si—Mg alloy and Ni—Mg alloy, etc.

Here, it is desirable that Ti concentration [% Ti] and N concentration [% N] satisfy the following formula:

$$[\%\ Ti]\times[\%\ N]\geqq([\%\ Cr]^{2.5}+150)\times 10^{-6},$$

wherein [% Ti] designates the amount of Ti, [% N] the amount of N, and [% Cr] the amount of Cr, in molten steel in terms of mass %.

In Processing Method III of the present invention, since concentrations of Ti and N contained in molten steel are maintained within a prescribed range and a prescribed amount of Mg is added, it is possible to make generated TiN join with MgO-containing oxides having high dispersibility and to disperse TiN in molten steel stably. This TiN acts as solidification nuclei when molten steel solidifies and makes fine a solidification structure further.

Processing Method III of the present invention demonstrates the effect of making fine a solidification structure even on "Cr-containing ferritic stainless steel" which is apt to coarsen the solidification structure and can prevent the generation of surface flaws and internal defects in a cast steel and a steel material.

Processing Method III of the present invention is suitable, in particular, for casting ferritic stainless molten steel containing 10 to 23 mass % of Cr.

If Cr content is less than 10 mass %, the corrosion resistance of a steel material deteriorates and desired fining effect cannot be obtained. On the other hand, if Cr content exceeds 23 mass %, even though Cr ferroalloy is added, the corrosion resistance of a steel material does not improve, the addition amount of ferroalloy increases, and thus the production cost becomes high.

An even further Processing Method of the Present Invention (hereunder referred to as "Processing Method IV") is characterized by containing 1 to 30 mass % of oxides reduced by Mg in slag covering molten steel.

According to Processing Method IV, since total amount of oxides contained in slag is maintained at a prescribed value, it is possible that Mg added to molten steel increases the proportion (yield) of Mg which forms MgO and oxides containing MgO and, as a result, it is possible to make fine MgO or oxides containing MgO (hereunder referred to as "MgO-containing oxides") disperse in molten steel.

Then MgO or MgO-containing oxides act as solidification nuclei and make fine the solidification structure of a cast steel. As a result, it is possible to decrease cracks and dents generated on the surface and cracks, center segregation and center porosity, etc., generated in the interior of a cast steel, to eliminate the necessity of reconditioning a cast steel, to prevent scrapping down, thus to improve the yield of a cast steel, and further to improve the quality of a steel material produced from the cast steel through processing such as rolling, etc.

Here, the above mentioned oxides in slag mean one or more of FeO, $Fe_2O_3$, MnO and $SiO_2$.

By properly selecting oxides in slag, it is possible to suppress the consumption of Mg by the oxides in slag, thus to raise Mg yield, and to add Mg to molten steel efficiently.

Further, in Processing Method IV of the present invention, it is desirable that the amount of $Al_2O_3$ contained in molten steel be 0.005 to 0.10 mass %.

By doing so, it is possible to make $Al_2O_3$ of high melting point into complex oxides such as MgO—$Al_2O_3$, etc., to uniformly disperse the complex oxides in molten steel by making use of the dispersibility of MgO, and to raise the ratio of MgO-containing oxides which act as solidification nuclei.

A yet further Processing Method of the Present Invention (hereunder referred to as "Processing Method V") is characterized by controlling the activity of CaO in slag which covers molten steel at not more than 0.3 before adding a prescribed amount of Mg to the molten steel.

According to Processing Method V, by adding Mg to molten steel, it is possible to generate, while fining, MgO excellent in lattice coherence with δ-ferrite and MgO-containing oxides with high melting point and to disperse them in molten steel.

Then, when molten steel solidifies, since the MgO and MgO-containing oxides act as solidification nuclei, the solidification structure of a cast steel becomes fine.

If the activity of CaO in slag exceeds 0.3, low-melting-point oxides containing CaO which do not act as solidification nuclei or oxides whose lattice incoherence with δ-ferrite exceeds 6% increase.

In Processing Method V of the present invention, it is desirable that the basicity of slag be not more than 10.

If the basicity of slag is adjusted to not more than 10, it is possible to stably suppress the activity of CaO in the slag and to prevent MgO-containing oxides from converting to low-melting-point oxides or oxides whose lattice incoherence with δ-ferrite exceeds 6%.

Further, Processing Method V of the present invention can appropriately apply to molten steel of ferritic stainless steel.

If Processing Method V of the present invention is applied to processing molten steel of ferritic stainless steel, it is possible to make fine a solidification structure which is apt to coarsen when the molten steel solidifies and to prevent surface flaws and internal defects from arising in a cast steel and a steel material produced therefrom.

The above-mentioned cast steel of the present invention can be produced by a continuous casting method and the continuous casting method is characterized by pouring molten steel containing MgO or MgO-containing oxides in a mold and casting the molten steel while stirring it with an electromagnetic stirrer.

By the continuous casting method, it is possible to form MgO and/or MgO-containing oxides with high dispersibility in molten steel and to make fine the solidification structure of a cast steel by the action for promoting the generation of solidification nuclei and the pinning action (suppressing the growth of a structure immediately after solidification) of said oxides.

Moreover, it is possible to reduce oxides present in the surface layer portion of a cast steel by the agitation of an electromagnetic stirrer, and in a cast steel and a steel material, to prevent scabs and cracks, generated by oxides, from occurring, and also to improve corrosion resistance.

Here, in the continuous casting method of the present invention, it is desirable to install an electromagnetic stirrer at a position between the meniscus in a mold and a level 2.5 m away therefrom in the downstream direction.

If an electromagnetic stirrer is installed in said range, it is possible to make fine the solidification structure of the surface layer portion while flushing away oxides captured in the surface layer portion solidified at the initial stage, to contain MgO and/or MgO-containing oxides abundantly in the interior of the cast steel, and to make the solidification structure finer. As a result, in a cast steel and a steel material, it is possible to prevent scabs and cracks generated by oxides from occurring and also to improve corrosion resistance.

If the position of agitation by an electromagnetic stirrer is above the meniscus (surface of molten steel), the agitation stream cannot be imposed on molten steel efficiently. On the other hand, if the position is more than level 2.5 m away from the meniscus in the downstream direction, there arise the problems that the solidified shell is too thick, oxides in the solidified shell which becomes the surface layer portion increase, and thus corrosion resistance deteriorates.

Further, in the continuous casting method of the present invention, it is desirable that the flow velocity of agitation stream imposed on molten steel by an electromagnetic stirrer is not less than 10 cm/sec.

By doing so, oxides captured in the solidified shell of a cast steel can be removed and cleaned by the flow of molten steel.

If the flow velocity of the agitation stream is less than 10 cm/sec., it is impossible to remove oxides in the vicinity of the solidified shell while cleaning. If the flow velocity of agitation stream is too strong, powder covering the surface of molten steel is entangled and the meniscus in a mold is disturbed. Therefore, it is desirable to set the upper limit of the flow velocity of agitation stream to 50 cm/sec.

Further, it is desirable to install an electromagnetic stirrer so that an agitation stream whirling in the horizontal direction is imposed on the surface of the molten steel in a mold.

By the agitation stream whirling in the horizontal direction, it is possible to remove, while efficiently cleaning, oxides captured in the surface layer portion of a cast steel and to secure fine oxides abundantly in the interior of the cast steel.

The continuous casting method of the present invention can appropriately apply to casting a cast steel from molten steel of ferritic stainless steel.

In particular, the above-mentioned molten steel contains 10 to 23 mass % of chromium and 0.0005 to 0.010 mass % of Mg.

By this method, it is possible to form MgO and/or MgO-containing oxides with high dispersibility in molten steel and to make fine the solidification structure of the cast steel by the action for promoting the generation of solidification nuclei and the pinning action (suppressing the growth of a structure immediately after solidification).

Further, it is possible to decrease surface flaws generated in the surface layer portion of a cast steel and defects such as cracks and center porosity, etc., generated in the interior.

Moreover, when piercing the cast steel after processed, the generation of cracks and scabs on the inner surface of a steel pipe is suppressed and the quality of the steel pipe improves.

If Mg content is less than 0.0005 mass %, MgO in molten steel decreases, solidification nuclei do not grow sufficiently, pinning action weakens, and a solidification structure cannot become fine. On the other hand, if Mg content exceeds 0.010 mass %, the effect of making fine the solidification structure is saturated and a remarkable effect does not appear, and the consumption of Mg and "Mg-containing alloy", etc., increases and thus the manufacturing cost increases too. Further, if chromium content is less than 10 mass %, the corrosion resistance of a steel pipe deteriorates and the effect of making fine solidification structure decreases. If chromium content exceeds 23 mass %, the addition amount of chromium increases and thus manufacturing cost increases too.

Here, when applying the continuous casting method of the present invention to the continuous casting of molten steel of ferritic stainless steel, the molten steel may be cast while stirring by an electromagnetic stirrer.

By the stirring, it is possible to divide the tips of columnar crystals formed during solidification and to further make fine the solidification structure of a cast steel by the interaction of the suppression of columnar crystal growth and the solidification nuclei generated by the divided tips.

Further, in case of such application, it is preferable to commence the soft reduction of a cast steel from the time when solid phase rate of the cast steel is in the range of 0.2 to 0.7.

By this soft reduction, it is possible to bond with pressure the center porosity generated by the solidification and shrinkage of unsolidified portions remaining in the interior of a cast steel and to prevent the center segregation, etc. generated by the flowing of unsolidified molten steel.

If the reduction is applied from the time when solid phase fraction is less than 0.2, unsolidified areas are so frequent that bonding effect cannot be obtained even though reduction is applied and cracks may arise in a brittle solidified shell. If the reduction is applied from the time when solid phase fraction is more than 0.7, center porosity does not bond with pressure sometimes. Therefore, a large reduction force is required for bonding center porosity with pressure and a large-sized reduction apparatus is required.

A seamless steel pipe of the present invention complying with the aforementioned objects is produced by pouring in a mold molten steel containing 10 to 23 mass % of chromium and 0.0005 to 0.010 mass % of Mg added therein, and by piercing in a pipe manufacturing process a cast steel continuously cast while being solidified with the cooling by a mold and the cooling by the water spray from cooling water nozzles installed in support segments.

In this steel pipe, since it is produced from a cast steel with a fine solidification structure, the generation of cracks and scabs on the surface and inner surface of the pipe is suppressed during piercing in a pipe manufacturing process, reconditioning such as grinding, etc. is not required, and the quality is good.

THE MOST PREFERRED EMBODIMENT

1) Embodiments of the present invention will be explained hereafter referring to the accompanying drawings for better understanding of the present invention.

Figure 1:
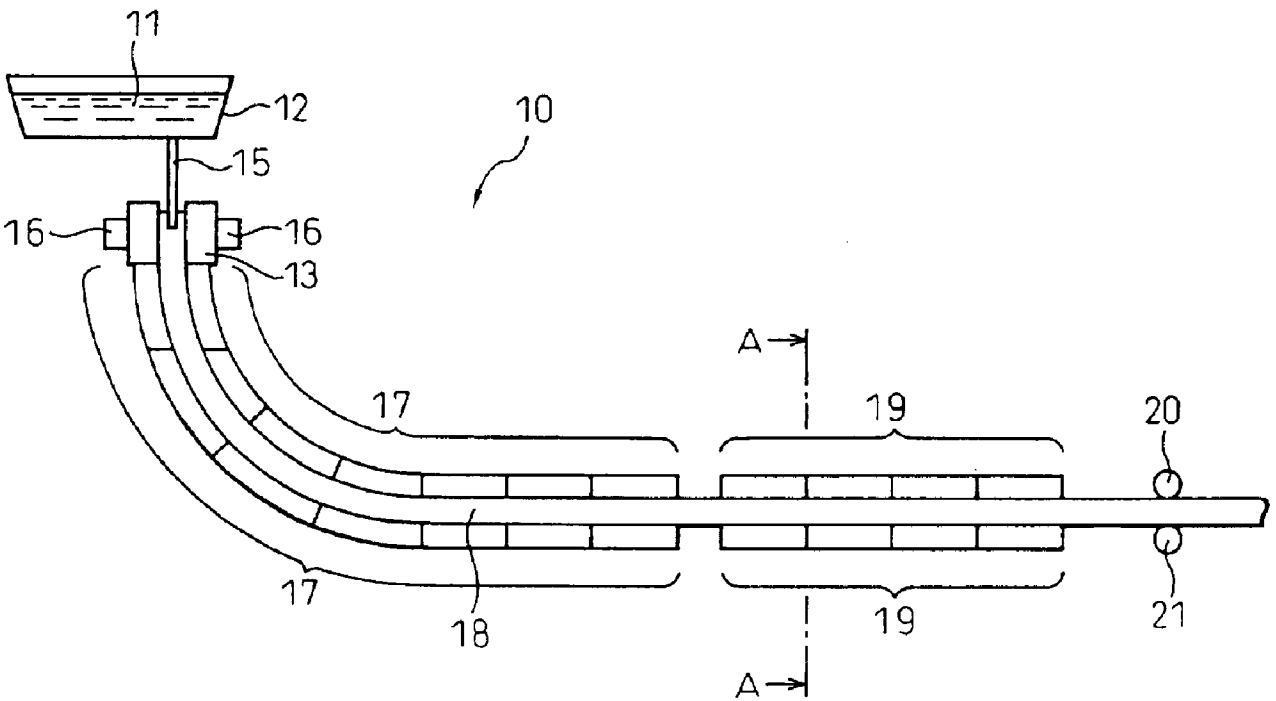
FIG. 1 is a sectional view of a continuous caster for casting a cast steel of the present invention.
Figure 2:
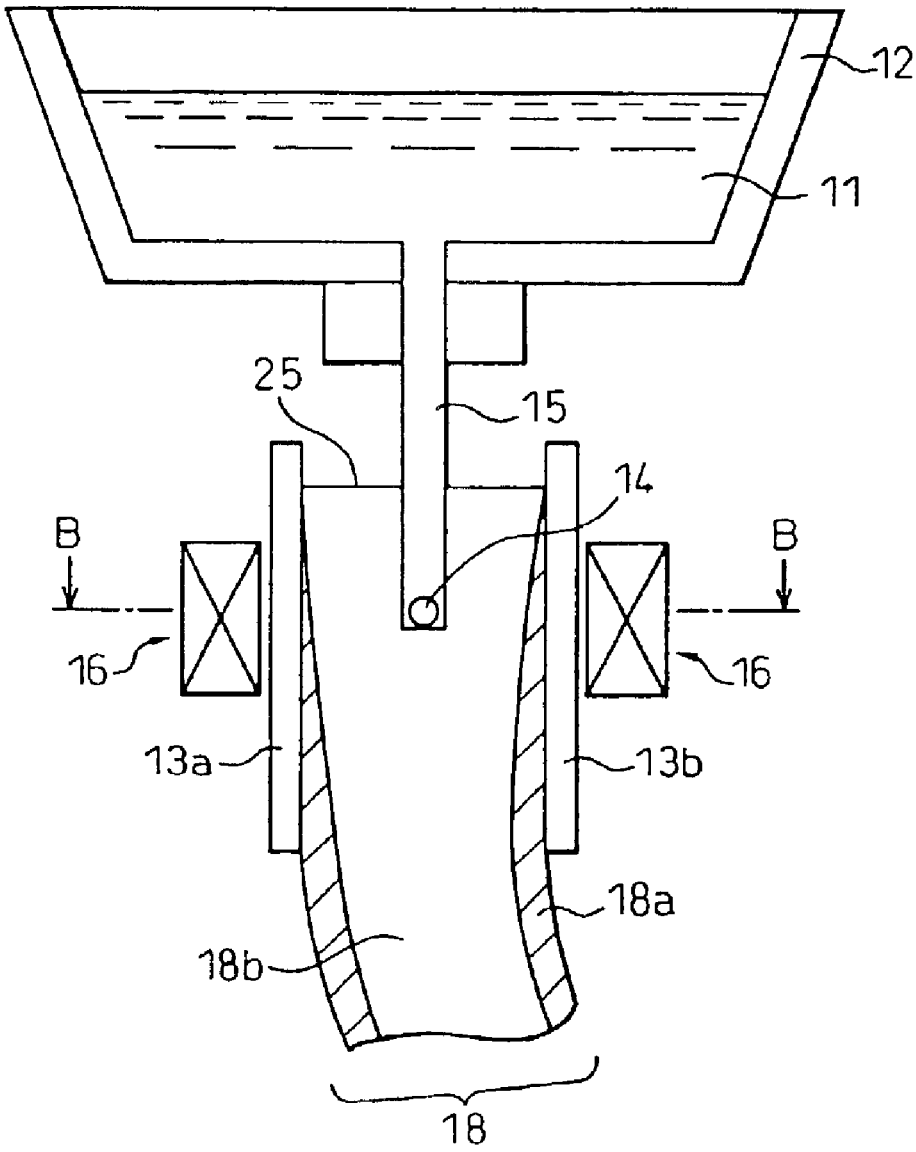
FIG. 2 is a sectional view of the vicinity of a mold of the continuous caster shown in FIG. 1.

As shown in FIGS. 1 and 2, the continuous caster 10 used for producing a cast steel of the present invention is equipped with a tundish 12 to hold molten steel 11, an immersion nozzle 15 provided with an outlet 14 to pour the molten steel 11 from the tundish 12 to a mold 13, an electromagnetic stirrer 16 to agitate the molten steel 11 in the mold 13, support segments 17 to solidify the molten steel 11 by water sprays from cooling water nozzles, not shown in the figures, reduction segments 19 to reduce the center portion of a cast steel 18, and pinch rolls 20 and 21 to extract the reduced cast steel 18.

Figure 3:
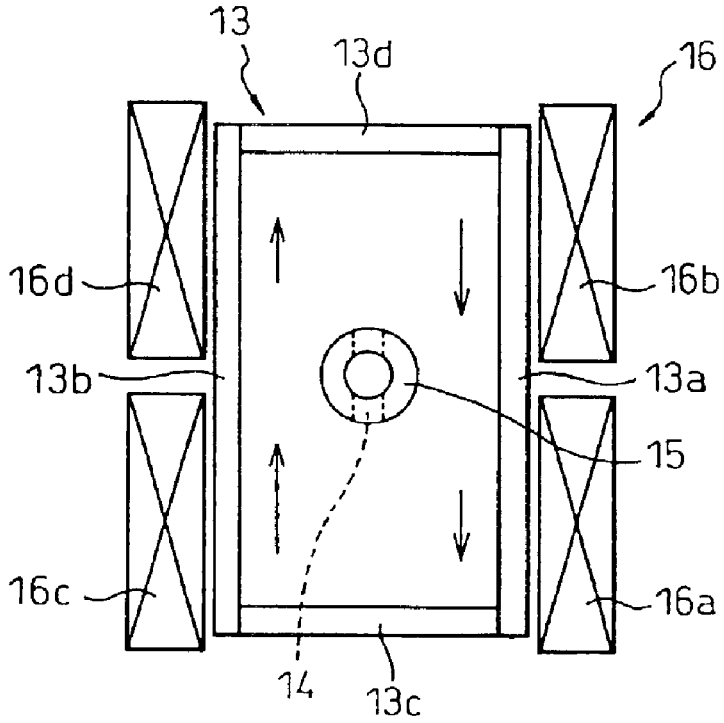
FIG. 3 is a sectional view of the mold taken on line B—B in FIG. 2.

The electromagnetic stirrer 16 is, as shown in FIG. 3, installed outside long pieces 13*a* and 13*b* of the mold 13, and electromagnetic coils 16*a* and 16*b* are disposed on the side of the long piece 13*a* and electromagnetic coils 16*c* and 16*d* on the side of the long piece 13*b*.

Further, this electromagnetic stirrer 16 is used as occasion demands.

Figure 4:
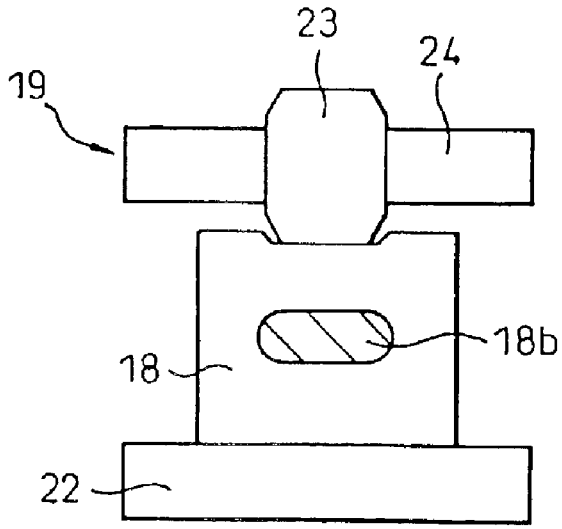
FIG. 4 is a sectional view of the continuous caster taken on line A—A in FIG. 1.

As shown in FIG. 4, the reduction segment 19 comprises a support roll 22 retaining the under surface of a cast steel 18 and a reduction roll 24 having a convex 23 contacting with the upper surface of the cast steel 18. The reduction roll 24 is pressed down by a hydraulic unit, not shown in the figure, the convex 23 is pushed to a position of a prescribed depth, and the unsolidified portion 18*b* of the cast steel 18 is reduced. Here, in FIG. 2, the reference numeral 18*a* denotes the solidified shell of the cast steel 18.

Then, the cast steel 18 is, after being cut into a prescribed size, sent to a next process and is processed into a steel material by rolling, etc. after being heated in a reheating furnace or a soaking pit, etc., not shown in the figures.

Figure 5:
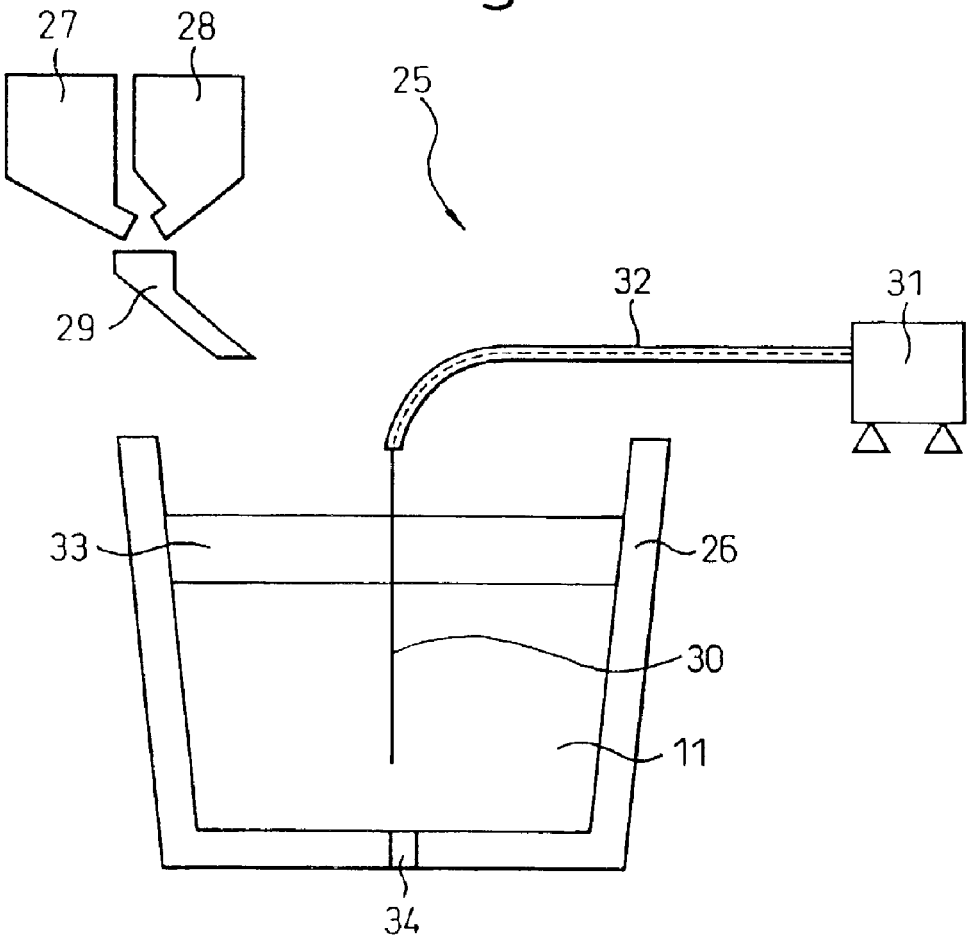
FIG. 5 is a sectional view of a processing apparatus used for a method of processing molten steel according to the present invention.
Figure 6:
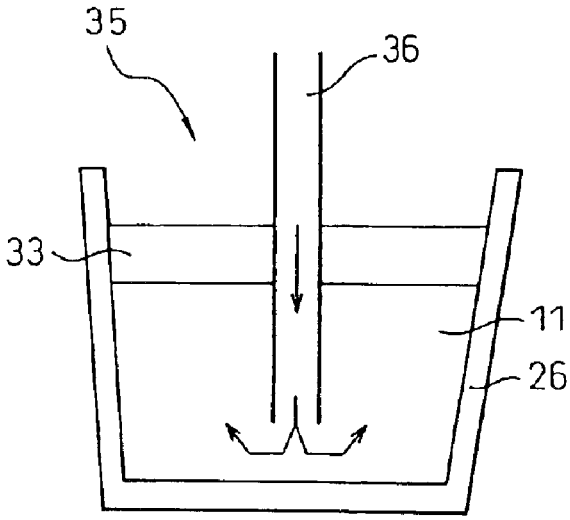
FIG. 6 is a sectional view of another processing apparatus used for a method of processing molten steel according to the present invention.

Processing units used in the processing method of the present invention are shown in FIGS. 5 and 6. The processing unit 25 shown in FIG. 5 is equipped with a ladle 26 accepting molten steel 11, a hopper 27 for storing "Al-containing alloy" provided above the ladle 26, a hopper 28 for storing Ti alloy such as sponge Ti, Fe—Ti alloy, etc. or N alloy such as Fe—N alloy, N—Mn alloy, N—Cr alloy, etc., and a chute 29 for adding said alloys from said storage hoppers 27 and 28 into the molten steel 11 in the ladle 26 as occasion demands.

Further, the processing unit 25 is equipped with a feeder 31 for feeding a wire 30 into the molten steel 11 passing through slag 33 by guiding said wire 30 formed into linear shape with a steel pipe covering metallic Mg through a guide pipe 32.

Here, in FIG. 5, reference numeral 34 denotes a porous plug for supplying inert gas into the molten steel 11 in the ladle 26. Further, a processing unit 35 shown in FIG. 6 is equipped with a ladle 26 and a lance 36 for injecting the powder of Mg or Mg alloy. The lance 36 is immersed into the molten steel 11 with slag 33 formed on its surface contained in the ladle 26, and, through this lance 36, the powder of Mg or Mg alloy is injected in the amount corresponding to 0.0005 to 0.010 mass % of Mg, for example, using an inert gas.

Figure 7:
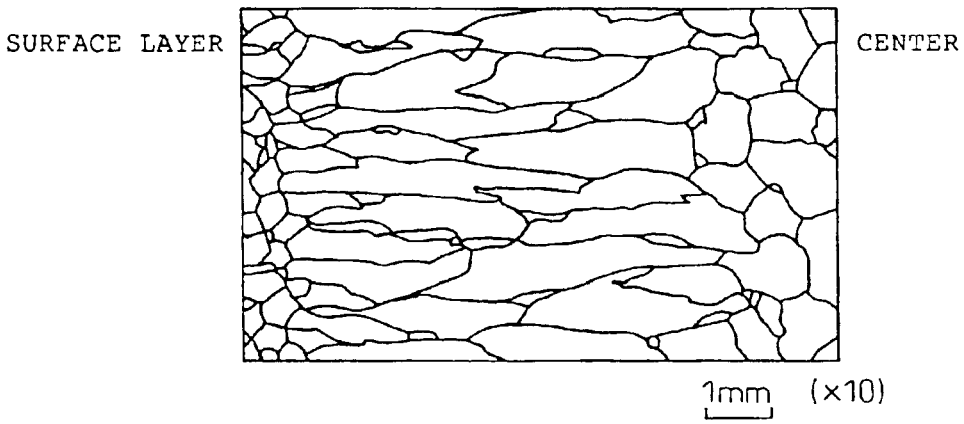
FIG. 7 is a schematic diagram of the solidification structure of a conventional cast steel in the direction of thickness.

In general, as shown in FIG. 7, a solidification structure of a cast steel comprises chilled crystals of fine crystal structure rapidly cooled by a mold and solidified at the surface layer (surface layer portion) and columnar crystals of large crystal structure formed inside said chilled crystals.

Further, in the interior of a cast steel, occasionally, equiaxed crystals are formed or columnar crystals reach the center portion.

The columnar crystals form a coarse solidification structure, have large anisotropy in deformation during processing such as rolling, etc. and thus show different deformation behavior in the transverse direction from that in the longitudinal direction.

Therefore, a steel material produced from a cast steel having a solidification structure occupied by columnar crystals in a large proportion is inferior in material properties to a steel material produced from a cast steel having fine equiaxed crystals, and is apt to generate surface flaws such as wrinkles, etc.

Further, when coarse columnar crystals are present in the surface layer of a cast steel, it means that brittle micro-segregation is present in the grain boundaries of the large columnar crystals and the portions where the micro-segregation exists become brittle and thus surface flaws such as cracks and dents, etc., arise.

Moreover, when columnar crystals are present or equiaxed crystals with large grain diameters are present in the interior of a cast steel, internal defects such as internal cracks (cracks) caused by micro-segregation and solidification contraction, etc. existing in a solidification structure, center porosity, and center segregation caused by the flowing of molten steel immediately before the completion of solidification, etc., arise and the quality of a cast steel and a steel material deteriorates.

2) (1) The generation of the above-mentioned surface flaws and internal defects can be prevented by obtaining a solidification structure wherein not less than 60% of the total cross section of a cast steel is occupied by equiaxed crystals, the diameters (mm) of which satisfy the following formula:

$$D<1.2X^{1/3}+0.75,$$

wherein D designates each diameter (mm) of equiaxed crystals in terms of internal structure in which the crystal orientations are identical, and X the distance (mm) from the surface of the cast steel.

That is, a cast steel comprising a solidification structure provided with equiaxed crystals satisfying the above formula is Cast Steel A of the present invention.

The diameter of the equiaxed crystal is the size of a solidification structure specified by etching the total cross section in the direction of the thickness of a cast steel solidified from molten steel and measuring the brightness of light reflected according to the crystal orientation of macro-structure when the surface of the cross section is illuminated.

The diameters of equiaxed crystals are determined by cutting a cast steel so that its cross section in the thickness direction appears, polishing the cross section, and then etching it by a reaction with hydrochloric acid or Nitral (liquid mixture of nitric acid and alcohol), etc., for example.

The average diameter of equiaxed crystals is determined by taking a photograph of macro-structure at a magnification of 1 to 100 times and measuring the diameters (mm) of equiaxed crystals obtained by the image processing of the extended photograph. Among the measured diameters of equiaxed crystals, the largest is the maximum diameter of equiaxed crystals.

Figure 8:
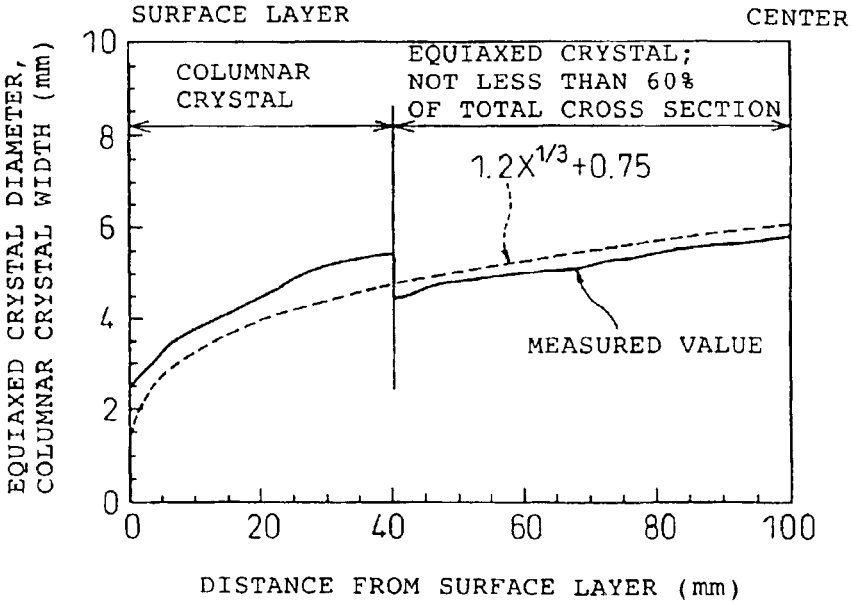
FIG. 8 is a graph showing a relationship of the distance from the surface layer with equiaxed crystal diameters and the width of columnar crystals in a cast steel of the present invention.

FIG. 8 shows a relationship between the distance from a surface layer and the diameters of equiaxed crystals in Cast Steel A of the present invention. In the Cast Steel A, by obtaining a solidification structure wherein not less than 60% of the total cross section of the cast steel is occupied by equiaxed crystals whose diameters satisfy the above formula, the generation of columnar crystals in the surface layer is suppressed and the diameters of equiaxed crystals in the interior decrease.

Figure 9:
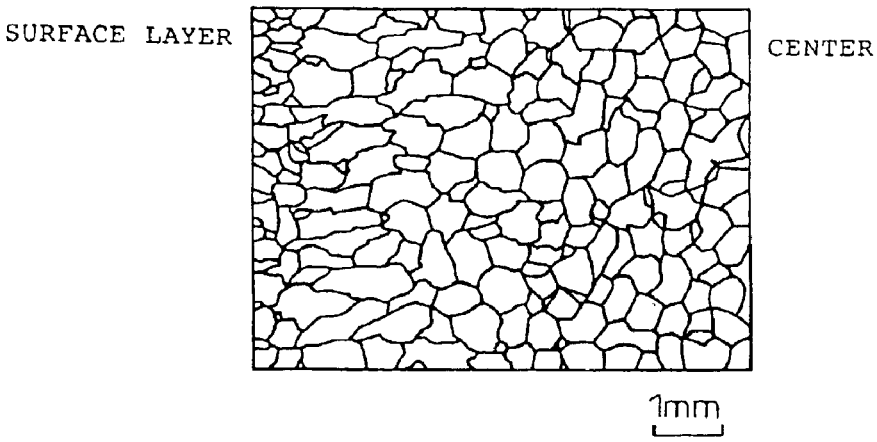
FIG. 9 is a schematic diagram of the solidification structure of a cast steel of the present invention in the direction of thickness.

In Cast Steel A, since the growth of columnar crystals in the surface layer portion is suppressed as shown in FIG. 9, the number of brittle micro-segregations present at grain boundaries is small and it is extremely small even if there are some. Therefore, in the Cast Steel A, even though uneven shrinkage and stress arise during cooling and solidification by a mold, the generation of surface flaws such as cracks and dents, etc., initiated from the portions of micro-segregation is suppressed.

Further, since the diameters of equiaxed crystals in the interior are also small as shown in FIG. 9, like the surface layer portion, the size of micro-segregation arising at grain boundaries decreases, resistance to cracks increases, and the generation of internal cracks, etc., caused by strain accompanied by the bulging and straightening of a cast steel is suppressed.

Since Cast Steel A has excellent workability and material properties as described above, if a steel material is produced using the Cast Steel A, a steel material without surface flaws such as wrinkles, etc., can be obtained.

When equiaxed crystals satisfying the aforementioned formula occupy less than 60% of the total cross section of a cast steel, the area of columnar crystals increases and the diameters of equiaxed crystals in the interior become large, and cracks and dents, etc., are generated in the cast steel. As a result, reconditioning of a cast steel is required and scrapping occurs, and further, when the cast steel is processed into a steel material, surface flaws and internal defects arise in the steel material and thus the quality of the steel material deteriorates.

Figure 10:
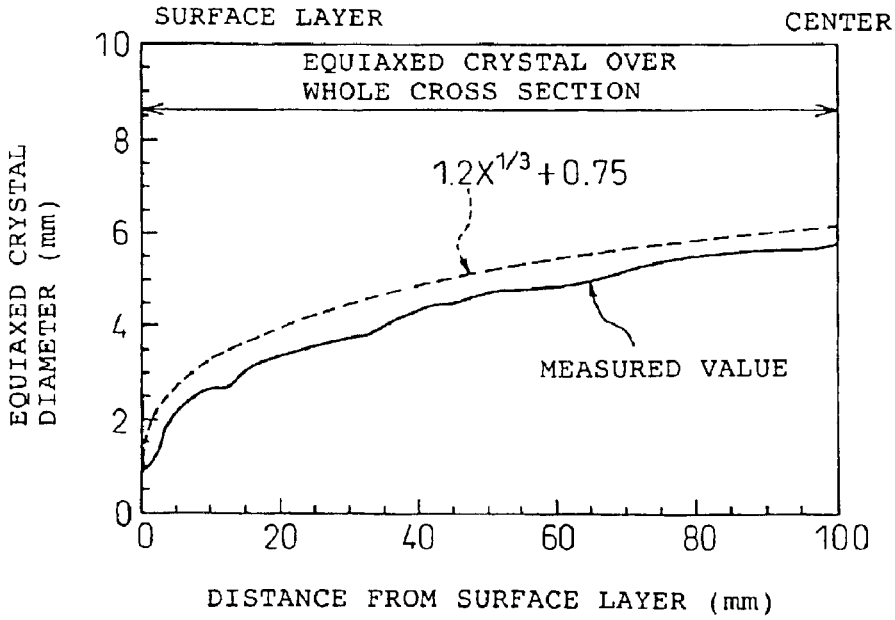
FIG. 10 is a graph showing another relationship between the distance from the surface layer and equiaxed crystal diameters in a cast steel of the present invention.

In the solidification structure of Cast Steel A of the present invention, by making equiaxed crystals satisfying the aforementioned formula occupy the total cross section of the cast steel as shown in FIG. 10, it is possible to make the whole solidification structure of the cast steel uniform and make the size of brittle micro-segregation present at grain boundaries small over the cast steel. As a result, in the cast steel, resistance to cracks is enhanced and, even though uneven shrinkage and stress arise during cooling and solidification by a mold, the generation of surface flaws such as cracks and dents, etc., initiated from the portions of micro-segregation and internal cracks, etc., caused by strain accompanied by the bulging and straightening of the cast steel, is steadily suppressed.

Moreover, when solidification is initiated from solidification nuclei, it is possible to decrease the diameters of equiaxed crystals and, as a result, to improve the flow of the molten steel immediately before the completion of solidification, to prevent defects such as center porosity caused by the contraction of molten steel and center segregation, etc., and to cast a cast steel without defects.

Further, in Cast Steel A of the present invention, by controlling the maximum diameter of equiaxed crystals to not more than three times the average diameter of equiaxed crystals, the solidification structure can become further fine and preferable results are obtained.

This is because a cast steel having a solidification structure with high uniformity is obtained by reducing the variation of the diameters of equiaxed crystals in the solidification structure, micro-segregation formed at the boundaries of equiaxed crystals is suppressed to be small, and the generation of surface flaws and internal defects is prevented.

Further, since the eqiaxed crystal diameters are small, the uniformity of deformation behavior during processing such as rolling, etc., improves further.

If the maximum diameter of equiaxed crystals exceeds three times the average diameter of equiaxed crystals, in some cases, the processing deformation of the local portions becomes uneven and wrinkles or striations, etc., occur in the steel material.

Figure 11:
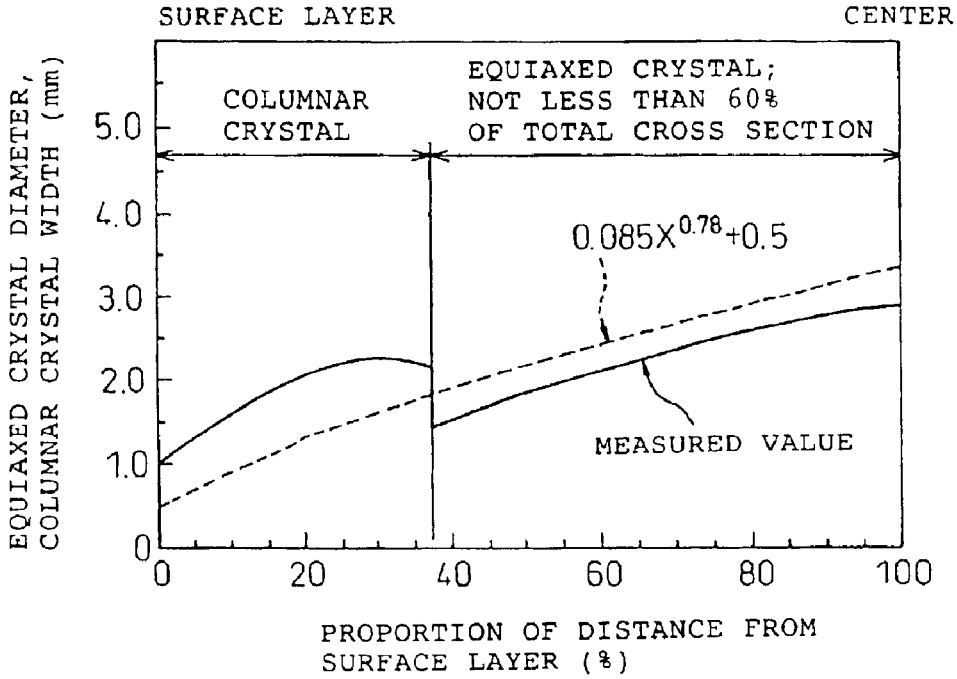
FIG. 11 is a graph showing another relationship of the distance from the surface layer with equiaxed crystal diameters and the width of columnar crystals in a cast steel of the present invention.

Further, in Cast Steel A of the present invention, paying attention to the diameters of equiaxed crystals obtained by image processing, it is possible to control the solidification structure, as shown in FIG. 11, so that not less than 60% of the total cross section of the cast steel is occupied by equiaxed crystals, the diameters of which satisfy the following formula and to obtain a preferable solidification structure:

$$D<0.08X^{0.78}+0.5,$$

wherein X designates the distance (mm) from the surface of the cast steel, and D the diameter (mm) of an equiaxed crystal located at the distance of X from the surface of the cast steel.

Figure 12:
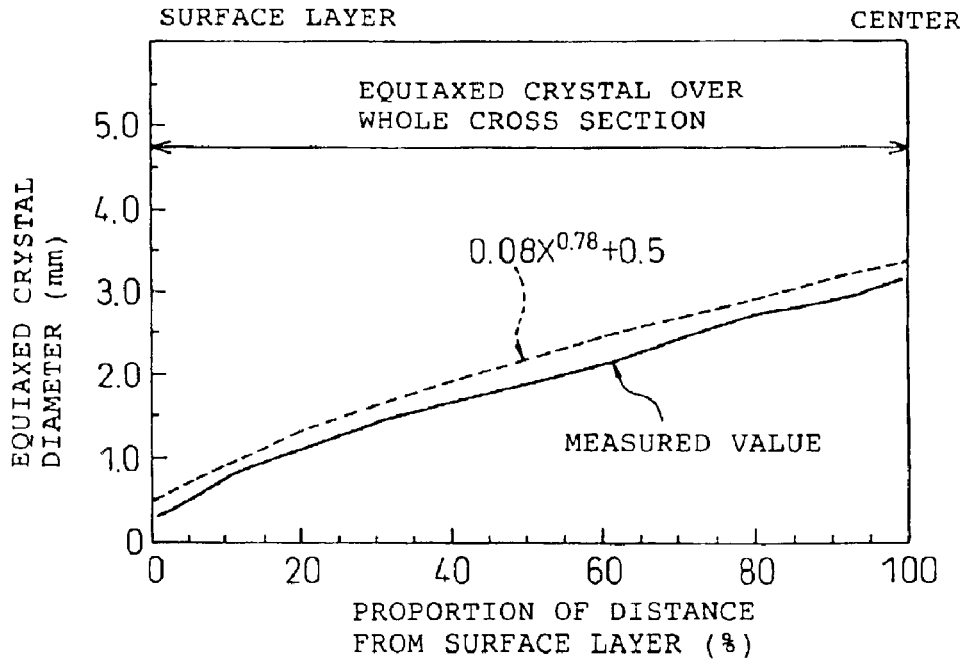
FIG. 12 is a graph showing another relationship between the distance from the surface layer and equiaxed crystal diameters in a cast steel of the present invention.

Moreover, in Cast Steel A of the present invention, as shown in FIG. 12, it is possible to control the solidification structure so that the total cross section of the cast steel is occupied by equiaxed crystals satisfying the above-mentioned formula and to obtain a more preferable solidification structure.

When continuously casting Cast Steel A of the present invention using a continuous caster shown in FIGS. 1 and 2, MgO itself or complex oxides containing MgO (hereunder referred to as "MgO-containing oxides") are formed in molten steel 11 by adding Mg or Mg alloy into molten steel 11 in a tundish 12.

MgO has a good dispersibility, disperses uniformly in molten steel 11 by forming fine particles and acts as solidification nuclei, and besides, the above-mentioned oxides themselves provide pinning action (suppressing the growth of a solidification structure immediately after solidification), suppress the coarsening of a solidification structure, form equiaxed crystals, fine equiaxed crystals themselves and make the cast steel homogeneous.

Mg or Mg alloy is added in molten steel in the amount corresponding to 0.0005 to 0.10 mass % of Mg, and the added Mg reacts with oxygen in molten steel and oxygen supplied from oxides such as FeO, $SiO_2$ and MnO, etc., and MgO or "MgO-containing oxides" are formed.

Further, Mg or Mg alloy is added by a method to add Mg or Mg alloy directly in molten steel or to continuously feed Mg or Mg alloy in the form of a wire formed into linear shape with thin steel covering Mg or Mg alloy.

When the Mg addition amount is less than 0.0005 mass %, since the number of solidification nuclei is insufficient and thus the number of generated nuclei is insufficient too, it is difficult to obtain a fine solidification structure.

On the other hand, when Mg addition amount exceeds 0.10 mass %, the effect of generating equiaxed crystals is saturated, the total amount of oxides in the interior of a cast steel increases, and corrosion resistance, etc. deteriorates. In addition, the cost of the alloy rises.

A cast steel cast as mentioned above has a uniform and fine solidification structure, but few surface flaws and internal cracks, and provides good workability.

Further, Cast Steel A of the present invention can be cast by, in addition to a continuous casting method, an ingot casting method, a belt casting method or a twin roll method, etc.

Now a steel material produced from Cast Steel A of the present invention will be explained hereafter.

A steel material of the present invention (for example, a steel sheet or a section) is produced by processing such as rolling, etc. the Cast Steel A, after being heated to a temperature of 1,150 to 1,250° C. in a reheating furnace or a soaking pit, etc., not shown in the figures, having a solidification structure wherein not less than 60% of the total cross section thereof is occupied by equiaxed crystals, the diameters of which satisfy the following formula:

$$D<1.2X^{1/3}+0.75,$$

wherein D designates each diameter (mm) of equiaxed crystals in terms of internal structure in which the crystal orientations are identical, and X the distance (mm) from the surface of the cast steel.

This steel material, since it is produced from Cast Steel A having said solidification structure, has features that brittle micro-segregation existing at grain boundaries is small, resistance to cracks of the micro-segregation portions is high and surface flaws such as cracks and scabs, etc., are few.

Further, since, in the interior of the cast steel, cracks, center porosity caused by the solidification contraction of unsolidified molten steel and center segregation caused by the flowing of molten steel 11, etc., are suppressed, in segregation the steel material, internal defects generated due to internal defects existing in the interior of the cast steel are extremely few.

Moreover, since Cast Steel A of the present invention has good uniformity of deformation during forming such as rolling, etc. and excellent workability, the steel material has excellent material properties such as toughness, etc., and few surface flaws such as wrinkles and cracks, etc.

In particular, a steel material produced by heating and then processing such as rolling, etc., a cast steel whose total cross section is occupied by equiaxed crystals satisfying the aforementioned formula, since it uses the cast steel with a uniform solidification structure, has extremely few surface flaws and internal defects as well as better uniformity of deformation during forming, and thus has excellent workability and material properties, etc.

Further yet, by controlling the maximum diameter of equiaxed crystals to not more than three times the average diameter of equiaxed crystals, it is possible to decrease the size of micro-segregation formed at the grain boundaries of the equiaxed crystals and to obtain a steel material having more uniform material properties.

(2) Cast Steel B of the present invention is characterized in that the maximum crystal grain diameter at a depth from the surface of the cast steel is not more than three times the average crystal grain diameter at the same depth.

Figure 13:
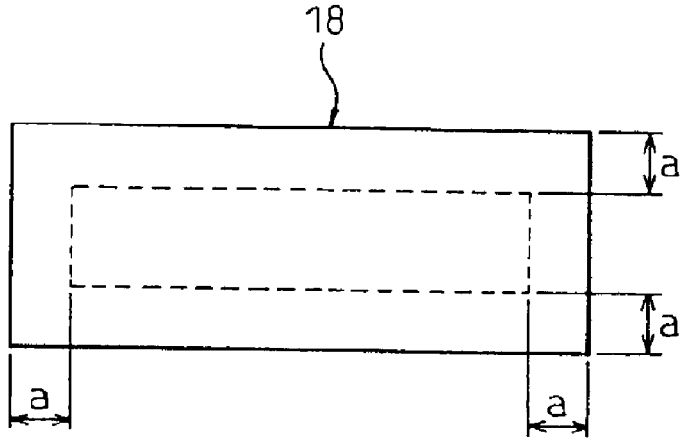
FIG. 13 is a sectional view of a cast steel of the present invention in the direction of thickness.

In said Cast Steel B, as shown in FIG. 13, by controlling the maximum value of crystal grain diameter at a certain depth of "a" mm, for example 2 to 10 mm, from the surface of the cast steel 18 to not more than three times the average value of crystal grain diameter at the same depth of "a" mm, the formation of coarse columnar crystals in the surface layer is suppressed and grain boundary segregation of tramp elements such as Cu, etc., decreases. As a result, the generation of dents and cracks, etc., caused by unevenness of cooling and solidification contraction, is prevented in the cast steel and the structure of the cast steel can have high resistance to cracks.

Furthermore, since cracks, etc. generated on the surface and in the interior of the cast steel decrease, reconditioning such as grinding, etc. and scrapping of the cast steel decrease, and thus the yield of the cast steel improves.

In addition, workability of the cast steel when subjected to processing such as rolling, etc., markedly improves.

As a value of crystal grain diameter at a certain depth of "a" mm from the surface of the cast steel, for example, the value obtained by grinding the cast steel up to the depth of 2 to 10 mm from the surface and measuring the crystal grain diameter of the exposed surface is used. Here, the grinding may be carried out up to the vicinity of the center portion of the cast steel.

When the maximum value of the crystal grain diameter at a certain depth from the surface of the cast steel exceeds three times the average crystal grain diameter at the same depth, the dispersion of the crystal grain diameters increases and, as a result, deformation strains concentrate on specific crystal grains resulting in uneven deformation during processing and thus surface flaws such as wrinkles, etc. arise, resulting in the deterioration of yield.

Further, portions with high grain boundary segregation are apt to appear and surface cracks and internal cracks may arise originated from those portions. As a result, surface flaws and internal defects arise, reconditioning and scrapping of the cast steel increase resulting in the deterioration of yield, and the material properties of the steel material deteriorate.

Figure 14:
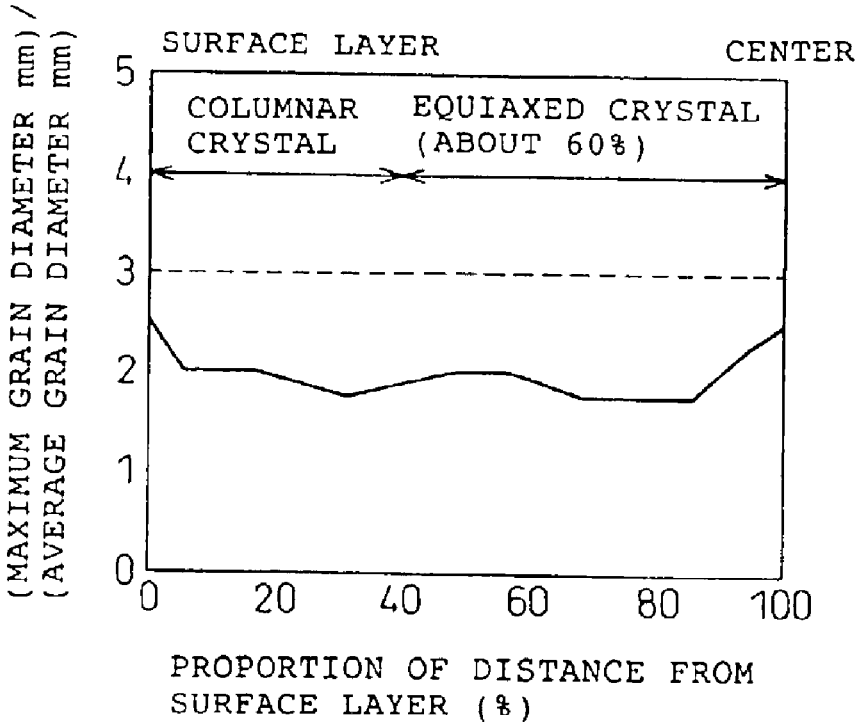
FIG. 14 is a graph showing a relationship between the distance from the surface layer and "maximum grain diameter/average grain diameter" in relation to crystal grain diameters in a cast steel of the present invention.

Further, in Cast Steel B of the present invention, as shown in FIG. 14, by controlling the maximum value of the crystal grain diameter to not more than three times the average crystal grain diameter at the same depth and further by controlling the cast steel so that at least 60% of its total cross section is occupied by equiaxed crystals, the formation of coarse columnar crystals in the surface layer as shown in FIG. 9 is suppressed and the whole structure of the cast steel can be made uniform.

Figure 15:
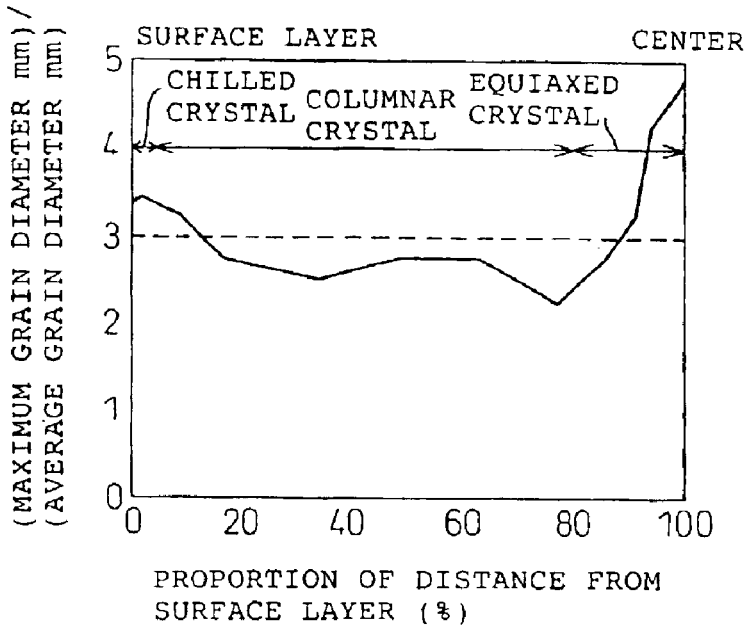
FIG. 15 is a graph showing a relationship between the distance from the surface layer and "maximum grain diameter/average grain diameter" related to crystal grain diameters in a conventional cast steel.

Here, FIG. 15 shows a relationship between the distance from the surface layer and "maximum grain diameter/average grain diameter" in a conventional cast steel.

When Cast Steel B of the present invention is processed, since the concentration of deformation strain on specific crystal grains is suppressed and the isotropy of deformation behavior (stretch to transverse and longitudinal directions by reduction) is secured, the Cast Steel B of the present invention shows better workability.

Therefore, when a steel material is produced by processing the cast steel, the generation of wrinkles (particularly, ridging and roping of stainless steel sheets) etc., in addition to cracks and scabs, etc., can be prevented.

Moreover, it is possible to decrease grain boundary segregation of tramp elements such as Cu, etc. formed at the grain boundaries, to enhance the resistance to cracks, etc. during processing by the reduction of rolling, etc., and to prevent the generation of defects such as cracks, etc. arising in the cast steel and steel material.

However, when less than 60% of the total cross section of a cast steel is occupied by equiaxed crystals, since the range of columnar crystals increases, in some cases, cracks and dents, etc. appear, the frequency of reconditioning and scrapping of the cast steel increases, surface flaws and internal cracks of the steel material processed from the cast steel arise, and thus yield and quality deteriorate.

For the same reason, by having equiaxed crystals occupy the total cross section of the cast steel, it is possible to reduce the size of grain boundary segregation by providing the whole structure with fine and uniform crystal grains, to enhance the resistance to cracks in surface layer portion and interior, to suppress dents and cracks, etc., to improve the isotropy of deformation by processing, and to improve quality and material properties such as r-value (drawing property) and toughness, etc. of the steel material.

It should be noted that the crystal grain diameter designates the grain diameter (mm) in terms of structure in which the crystal orientations are identical and is the size of a solidification structure specified by etching the surface of a cast steel and measuring the brightness of light reflected according to the crystal orientation of macro-structure.

The crystal grain diameter is determined by cutting a solidified cast steel in a predetermined length so that its cross section in the thickness direction appears, grinding it from circumference to a predetermined depth, polishing the exposed surface, and then etching it by the reaction with hydrochloric acid or Nitral (liquid mixture of nitric acid and alcohol), etc., for example.

Further, by taking a photograph of macro-structure at a magnification of 1 to 100 times and measuring the crystal grain diameter obtained by the image processing of the photograph, the maximum diameter and the average diameter are determined.

When continuously casting Cast Steel B of the present invention, Mg or Mg alloy is added into molten steel 11 in a tundish 12 (see FIGS. 1 and 2) and MgO itself or "MgO-containing oxides" are formed in molten steel 11.

The addition amount of Mg, the effect of action and the method of addition are the same as in the case of Cast Steel A of the present invention.

Further, like Cast Steel A, Cast Steel B of the present invention can be cast with, in addition to a continuous casting method, the methods of ingot casting, belt casting and twin roll casting, etc.

Cast Steel B of the present invention is subjected to processing such as rolling, etc. after being heated to a temperature of 1,150 to 1,250° C. in a reheating furnace or a soaking pit, etc., not shown in the figures, and is made into a steel material such as a steel sheet or a section, etc.

In this steel material, surface flaws such as cracks and scabs, etc., and internal defects such as internal cracks, etc., are few and the workability is excellent.

In particular, by using a cast steel having the feature that at least 60% of the cross section in the direction of thickness is occupied by equiaxed crystals or the total cross section is occupied by equiaxed crystals, defects decrease further and the steel material with excellent workability such as drawing can be obtained.

(3) Cast Steel C of the present invention is characterized by containing not less than 100/cm$^2$ of inclusions whose lattice incoherence with δ-ferrite formed during the solidification of molten steel is not more than 6%.

Molten steel 11 of a steel grade whose solidified primary crystals (a phase which crystallizes first when molten steel 11 solidifies) are composed of δ-ferrite (ferritic stainless molten steel containing 13 mass % of chromium) is poured in a mold 13 through an immersion nozzle 15 provided in a tundish 12 (see FIGS. 1 and 2), processed into the cast steel 18 while forming a solidified shell 18*a* by cooling, cooled by cooling water spray while proceeding downward along support segments 17, reduced by reduction segments 19 midway (see FIG. 4) while increasing the thickness of the solidified shell 18*a* gradually, and solidified completely.

In the solidification structure on a cross section in the thickness direction of a conventional cast steel, as shown in FIG. 7, chilled crystals of fine structure solidified by rapid cooling with a mold are formed in the surface layer (surface layer portion) of the cast steel and large columnar crystals are formed at the inside of the chilled crystals.

In the surface layer portion, micro-segregation appears at the boundary of the columnar crystals and, since this micro-segregation portion is brittle, this causes surface flaws such as cracks and dents, etc., in the surface layer of the cast steel due to the unevenness of cooling by a mold and solidification shrinkage.

Further, in the interior of the cast steel, since cooling is slower than in the surface layer portion, columnar crystals or large equiaxed crystals are generated and micro-segregation similar to that in the surface layer portion exists at the boundary of solidification structure.

This micro-segregation is, like in the surface layer portion, brittle and acts as an origin of internal cracks caused by thermal shrinkage during the solidification of the interior and mechanical stress such as bulging and straightening of the cast steel.

On the other hand, when the grain diameters of equiaxed crystals in the interior of the cast steel are large, with the progress of solidification, internal defects such as center porosity caused by the lack of molten steel supply and center segregation caused by the flowing of molten steel immediately before the completion of solidification are generated in the interior of the cast steel, and thus the quality of the cast steel deteriorates.

Therefore, to prevent the generation of the aforementioned surface flaws and internal defects, it is necessary for molten steel to contain not less than 100/cm$^2$ of inclusions whose lattice incoherence with δ-ferrite is not more than 6% when molten steel solidifies.

These inclusions are generated by adding metal which forms inclusions through reacting to O, C, N, S and oxides such as $SiO_2$, etc. contained in molten steel 11, or by adding the inclusions themselves to the molten steel.

Inclusions generated by the reaction of the aforementioned metal to O, C, N, S and $SiO_2$, etc., in molten steel or inclusions added in molten steel form inclusions whose size is 10 μm or smaller in molten steel. These inclusions act as solidification nuclei when molten steel solidifies and also as starters for the commencement of solidification Further, by the pinning action of the aforementioned inclusions, the growth of a solidification structure is suppressed and the cast steel with a fine solidification structure can be obtained.

Figure 16:
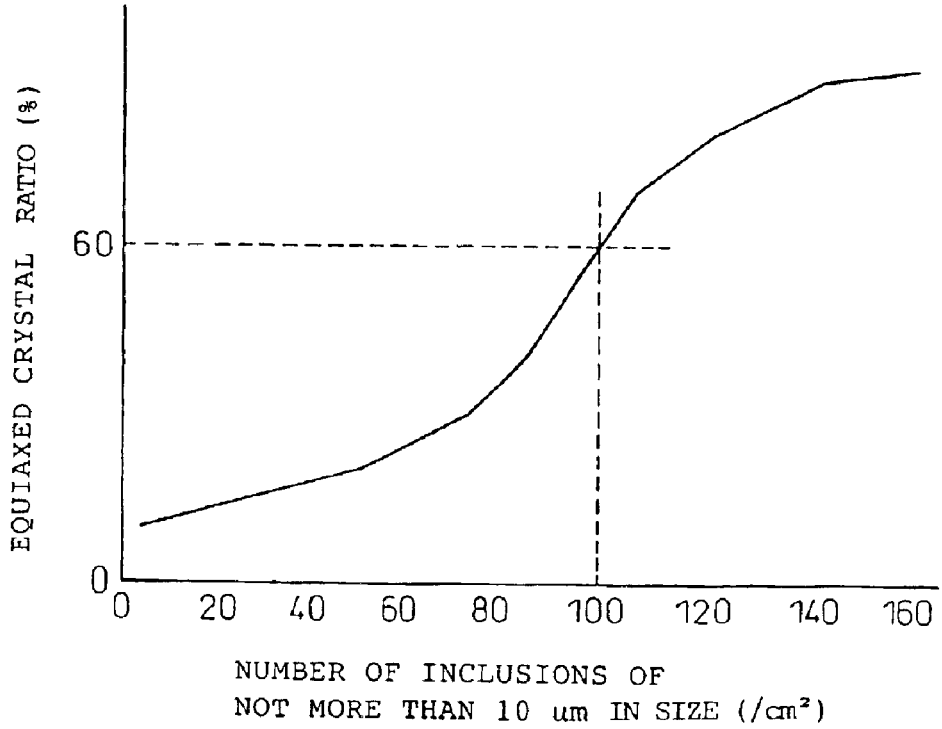
FIG. 16 is a graph showing a relationship between the number of inclusions (/cm$^2$) the sizes of which are not more than 10 $\mu$m and the equiaxed crystal ratio (%) of cast steels.

In particular, when generating inclusions with a size of 10 μm or smaller in an amount of not less than 100/cm$^2$ by the agitation with a discharged stream of molten steel in a mold 13 and stirring with an electromagnetic stirrer, the effects of the aforementioned solidification nuclei and pinning action are further activated and, as shown in FIG. 16, the cast steel having a solidification structure wherein equiaxed crystals occupy at least 60% can be obtained.

A solidification structure on the cross section in the thickness direction of the cast steel is shown in FIG. 9. A fine equiaxed crystal structure is formed in the interior of the cast steel and the growth of columnar crystals is suppressed in the surface layer portion.

Then, by increasing the number of inclusions whose sizes are 10 $\mu$m or less, it is possible to make the solidification structure of a cast steel into finer and more uniform equiaxed crystals over the whole cross section from the surface layer to the interior of the cast steel.

Cast Steel C with fine equiaxed crystals of the present invention is excellent in crack resistance and thus has a feature that the surface flaws such as cracks and dents, etc., generated on the surface of the cast steel are hard to appear.

Further, in the interior of Cast Steel C of the present invention, brittle micro-segregation portions are few, the generation of internal cracks, etc. is low even if thermal shrinkage or any sort of stress arises, and the generation of internal defects such as center porosity caused by the short supply of molten steel immediately before solidification, center segregation, etc., is also prevented.

Further, since the fine equiaxed crystals in Cast Steel C of the present invention can easily deform in the direction of reduction when the cast steel is subjected to processing such as rolling, etc., the Cast Steel C of the present invention has higher workability.

Moreover, since the workability is excellent, surface flaws such as wrinkles (roping, ridging, edge seam), etc., do not appear after being subjected to processing such as rolling, etc., and the generation of internal defects such as cracks, etc., caused by internal defects present in the interior of the cast steel is also prevented.

For forming inclusions used for ferritic steel grades (these inclusions are metallic compounds), metal and metal alloy such as Mg, Mg alloy, Ti, Ce, Ca and Zr, etc., are used and reacted with O, C, N, S and oxides such as $SiO_2$ etc., in molten steel.

As inclusions added in molten steel, substances whose lattice incoherence with δ-ferrite is not more than 6%, such as MgO, $MgAl_2O_4$, TiN, CeS, $Ce_2O_3$, CaS, $ZrO_2$, TiC and VN, etc., are used.

From the viewpoint of dispersibility and the stability of solidification nuclei generation, in particular, MgO, $MgAl_2O_4$ and TiN are preferred.

Here, the lattice incoherence with δ-ferrite is defined as a value of the difference between the lattice constant of δ-ferrite formed by the solidification of molten steel and the lattice constant of metallic compound divided by the lattice constant of solidification nuclei in molten steel, and the smaller the value is, the more the solidification nuclei are formed.

The number of inclusions in a cast steel is measured by counting the number of inclusions whose sizes are 10 $\mu$m or less per unit area using a scanning electron microscope (SEM) or the slime method.

The size of metallic compound is determined by observing the inclusions of the total cross section using an electron microscope such as SEM, etc. and calculating the average of the maximum diameter and the minimum diameter of the inclusions.

On the other hand, in case of the slime method, the determination is done by cutting out a part of the total cross section of a cast steel, dissolving the part, then picking up inclusions by classification, judging each size by the average of the maximum diameter and the minimum diameter of each inclusion, and counting the number of each size.

Here, for continuously casting a cast steel containing above inclusions, metals generating inclusions such as MgO, $MgAl_2O_4$, TiN and TiC, etc., by reacting to oxygen, FeO, $SiO_2$, MnO, nitrogen and carbon, etc., in molten steel are added or these inclusions are directly added into molten steel 11 in a tundish 12 (see FIGS. 1 and 3).

In particular, when Mg or Mg alloy is added into molten steel and inclusions comprising pure MgO or MgO-containing oxides are formed in molten steel, a better result is obtained since the dispersibility of inclusions in molten steel improves.

For example, Mg or Mg alloy is added so that Mg is contained in the amount of 0.0005 to 0.10 mass % in molten steel.

The addition method is that Mg or Mg alloy is directly added into molten steel, or that a wire formed into linear shape with thin steel sheet covering Mg or Mg alloy is continuously supplied into molten steel (see FIGS. 5 and 6).

When the Mg addition amount is less than 0.0005 mass %, a fine solidification structure is hardly formed because of the lack of solidification nuclei. Also, the effect of suppressing the growth of a solidification structure reduces and a fine solidification structure cannot be obtained since the pinning action of inclusions themselves weakens.

On the other hand, when the Mg addition amount exceeds 0.10 mass %, the generation of solidification nuclei is saturated, the total oxides in the interior of a cast steel increase, and corrosion resistance, etc., deteriorates. In addition, alloy cost increases.

Here, as molten steel of a steel grade whose solidified primary crystals are δ-ferrite, for example, there is "SUS stainless steel" containing 11 to 17 mass % of chromium, etc.

As mentioned above, in Cast Steel C of the present invention, the solidification structure is uniform and fine, the generation of surface flaws and internal defects is suppressed and excellent workability is provided.

Cast Steel C of the present invention can be cast by, in addition to a continuous casting method, a method of ingot casting, belt casting or twin roll casting, etc.

Cast Steel C of the present invention is extracted by pinch rolls 20 and 21 (see FIG. 1), cut into prescribed sizes by a cutter not shown in the figure, and then transferred to succeeding processes such as rolling, etc.

After being transferred, the Cast Steel C of the present invention is heated to 1,150 to 1,250° C. in a reheating furnace or a soaking pit not shown in the figures, then subjected to processing such as rolling, etc., and produced into a steel material such as a plate, a steel sheet or a section.

The steel material thus produced has high resistance to cracks in structure and few surface flaws such as cracks and scabs, etc., generated during and after processing.

Further, in this steel material, since center segregation, etc., in the interior of the cast steel is suppressed, internal defects generated during processing caused by internal defects in the cast steel are few.

Moreover, Cast Steel C of the present invention having a fine and uniform solidification structure is excellent in workability such as r-value, etc., easily processed, and also excellent in the toughness of a welded portion after processing.

In particular, in a steel material produced by processing such as rolling, etc., the cast steel containing many inclusions whose sizes are not more than 10 μm and having excellent dispersibility is surely prevented from the generation of scabs and cracks, etc., formed on the surface of the steel material, and has better workability such as ductility, etc., because of the easier deformation to the direction of reduction.

(4) Cast Steel D of the present invention is characterized in that, in said cast steel cast by adding metal or metallic compound in molten steel for forming solidification nuclei during the solidification of the molten steel, the number of the metallic compounds whose sizes are not more than 10 μm contained further inside than the surface layer portion of said cast steel is not less than 1.3 times the number of the metallic compounds whose sizes are not more than 10 μm contained in said surface layer portion.

In Cast Steel D of the present invention, in order to prevent surface flaws and internal defects, metal which forms a metallic compound by reacting to O, C, N and oxides, etc., in molten steel or metallic compound itself is added in molten steel so as to form solidification nuclei when molten steel solidifies.

However, if the metallic compound is formed in various sizes in molten steel and the size of the metallic compound exceeds 10 μm, solidification nuclei are hardly formed, the effect of suppressing the coarsening of equiaxed crystals by the pinning action of the metallic compound itself does not appear, and the fining of a solidification structure is not obtained.

Therefore, as metal or metallic compound added in molten steel, it is important to use the one with good dispersibility and to form metallic compounds whose sizes are not more than 10 μm as much as possible.

Further, it is essential that the number of the metallic compounds whose sizes are not more than 10 μm existing in the interior of the cast steel is not less than 1.3 times the number of the metallic compounds whose sizes are not more than 10 μm existing in the surface layer portion.

The reason is that in the surface layer portion of the cast steel, since cooling is carried out rapidly, a solidification structure of fine equiaxed crystals can be obtained even if metallic compound which becomes solidification nuclei is relatively few.

Further, it is possible to promote the fining of equiaxed crystals by the actions of solidification nuclei and pinning through controlling the number of the metallic compound whose size is not more than 10 μm in the interior of the cast steel to not less than 1.3 times the number thereof in the surface layer portion, to suppress the coarsening of equiaxed crystals, and to obtain a solidification structure having uniform and fine equiaxed crystals.

As shown in FIG. 9, a cast steel with a solidification structure wherein not less than 60% of the cross section of the solidification structure in the thickness direction of the cast steel is occupied by fine equiaxed crystals and the sizes of columnar crystals in the surface layer portion are also suppressed to be small can be obtained.

Moreover, a cast steel with a solidification structure wherein the whole cross section thereof from the surface layer portion to the interior is occupied by fine and uniform equiaxed crystals can be obtained.

Thus, in Cast Steel D of the present invention, the generation of cracks and dents caused by strain and stress during solidification and surface flaws caused by inclusions, etc., is suppressed, the resistance to internal cracks caused by strain imposed by bulging and straightening, etc., of the cast steel is enhanced, and further the generation of internal defects such as center porosity and center segregation, etc., is also suppressed since the fluidity of molten steel is secured.

In particular, in Cast Steel D of the present invention, since the number of metallic compounds which become solidification nuclei is controlled so as to be few in the surface layer portion but many in the interior, when the cast steel is processed into a steel material such as a steel sheet and a section, etc., the generation of surface flaws such as scabs and cracks, etc. on the surface caused by inclusions is suppressed, and further the deterioration of corrosion resistance, etc. caused by the exposure of metallic compound on the surface of the steel sheet and the section and the existence of metallic compound in the vicinity of the surface layer is also prevented.

When the number of the metallic compounds whose sizes are not more than 10 μm in the interior of the cast steel is less than 1.3 times the number of the metallic compounds whose sizes are not more than 10 μm in the surface layer portion of the cast steel, since solidification nuclei for making fine a solidification structure are insufficient and a pinning action becomes inactive, the solidification structure coarsens, uniform solidification structure cannot be obtained, surface flaws such as cracks and dents, etc., caused by stress resulted from the cooling during casting and uneven cooling during solidification, etc., and internal shrinkage, etc., and internal defects such as center porosity and center segregation, etc., are generated, and thus workability deteriorates when processing such as rolling, etc., is carried out.

As metallic compound contained in molten steel, used are substances whose lattice incoherence with δ-ferrite is not more than 6%, including MgO, $MgAl_2O_4$, TiN, CeS, $Ce_2O_3$, CaS, $ZrO_2$, TiC and VN, etc. From the viewpoint of the dispersibility and the stability of solidification nuclei generation when added in molten steel, MgO, $MgAl_2O_4$ and TiN are preferred.

As metal added in molten steel, Mg, Mg alloy, metal such as Ti, Ce, Ca and Zr, etc. are used. Substances which form the aforementioned metallic compound by reacting to O, C, N and oxides such as $SiO_2$, etc., in molten steel are used, but a metallic compound containing these metals is also used.

In particular, when a metal compound or a metal which forms metallic compound whose lattice incoherence with δ-ferrite is not more than 6% is added in molten steel, since the formation of solidification nuclei effectively acting is promoted and pinning action remarkably appears, a cast steel with a solidification structure comprising finer equiaxed crystals can be obtained. This cast steel easily deforms in the direction of reduction and is excellent in workability such as ductility, etc.

When continuously casting a cast steel containing the above metallic compound, Mg, Mg alloy, Ti, Ce, Ca and Zr, etc. are added into molten steel 11 in a tundish 12 (see FIGS. 1 and 2) and metallic compound such as MgO, $MgAl_2O_4$, TiN and TiC, etc., is generated by reacting with oxygen, FeO, $SiO_2$, MnO, nitrogen or carbon, etc., in molten steel 11. In particular, when Mg or Mg alloy is added into molten steel and pure MgO or MgO-containing oxides are formed in molten steel, a better result is obtained since the dispersibility of metallic compound in molten steel improves. For example, Mg or Mg alloy is added so that 0.0005 to 0.010 mass % of Mg is contained in molten steel.

The addition method is that Mg or Mg alloy is directly added into molten steel, or,that a wire formed into linear shape with thin steel sheet covering Mg or Mg alloy is continuously supplied into molten steel (see FIGS. 5 and 6).

When the Mg addition amount is less than 0.0005 mass %, the amount of solidification nuclei is insufficient, the effect of solidification nuclei and pinning action reduces, and thus a fine solidification structure is hardly obtained.

On the other hand, when the Mg addition amount exceeds 0.010 mass %, the effect of the formation of solidification nuclei is saturated, the amount of total oxides in the interior of a cast steel increases, and corrosion resistance, etc. deteriorates. In addition, the alloy cost increases.

In Cast Steel D of the present invention cast as mentioned above, a solidification structure is uniform, the generation of surface flaws and internal defects is suppressed and excellent workability is provided.

Cast Steel D of the present invention can be cast by, in addition to a continuous casting method, a method of ingot casting, belt casting or twin roll casting, etc. When the thickness is 100 mm or more, since the distribution of inclusions (metallic compound) is easily controlled and equiaxed crystals in the solidification structure from the surface layer to the interior are also easily controlled, a preferable result can be obtained. In the casting, for example, a cast steel cast by a continuous caster of vertical type or curved type using a mold open on both ends shows the effect of fining more markedly and a preferable result can be obtained.

The Cast Steel D of the present invention is heated to 1,150 to 1,250° C. in a reheating furnace or a soaking pit not shown in the figures, then subjected to processing such as rolling, etc., and produced into a steel material such as a steel sheet or a section, etc.

The steel material thus produced has enhanced resistance to cracks at micro-segregated portion in the interior of the cast steel and thus has few surface flaws such as cracks and scabs, etc.

Further, in the interior of the steel material too, internal defects caused by the internal defects of the cast steel and internal defects such as internal cracks, etc. caused by processing such as rolling, etc. are quite few. Moreover, since Cast Steel D of the present invention is excellent in workability and corrosion resistance, the steel material produced by processing said Cast Steel D is also excellent in workability and corrosion resistance.

3) When producing a cast steel of the present invention, molten steel has to be subjected to some sort of treatment. Now methods for processing molten steel according to the present invention (Processing Methods I to V of the present invention) will hereunder be described.

(1) Processing Method I of the present invention is characterized by controlling the total amount of Ca in molten steel at not more than 0.0010 mass %, and then adding a prescribed amount of Mg therein.

In the processing apparatuses shown in FIGS. 5 and 6, the total Ca amount obtained by summing together Ca and CaO, etc., contained in molten steel is adjusted so as to be 0.0010 mass % or less (including the case of zero) in molten steel 11 in a ladle 26. In addition, it is adjusted so that calcium aluminate ($12CaO—7Al_2O_3$), which is a low-melting-point compound (complex oxide) of $Al_2O_3$ and CaO, is not generated.

When the total Ca amount contained in molten steel exceeds 0.0010 mass %, Ca, which is strong deoxidizer, forms CaO, this joins with CaO contained beforehand, and a low-melting-point compound is formed by combining with $Al_2O_3$.

Further, MgO generated by adding Mg or Mg alloy combines with the complex oxide of $CaO—Al_2O_3$ and forms a low-melting-point ternary system complex oxide of $CaO—Al_2O_3—MgO$. Since this complex oxide melts at a temperature in the range of molten steel temperature, it does not act as a solidification nucleus and, as a result, a fine solidification structure cannot be obtained. Or, even though the above complex oxide is an inclusion with relatively high melting point, since it contains CaO, its lattice incoherence with δ-ferrite is low and it does not act as a solidification nucleus.

To control the total Ca amount and the generation of calcium aluminate, when deoxidizing molten steel 11 in a refining furnace or a ladle 26, deoxidation by Ca and Ca alloy is not practiced, or deoxidation is practiced using ferroalloy not containing Ca or containing Ca in a small amount.

The addition amount of Mg or Mg alloy is set to 0.0005 to 0.10 mass % in terms of Mg equivalent.

This is because, with an Mg addition amount of less than 0.0005 mass %, the generated solidification nuclei are insufficient and a fine structure cannot be obtained, while, with Mg addition amount exceeding 0.10 mass %, the effect of equiaxed crystal generation is saturated, the total oxide amount in the interior of the cast steel increases, and thus corrosion resistance, etc., deteriorates. Moreover, alloy cost also increases.

Then, in the Processing Method I of the present invention, since the total Ca amount is decreased, complex oxides such as pure MgO and $MgO—Al_2O_3$, etc., are formed by oxygen contained in molten steel and oxygen supplied from oxides such as FeO, $SiO_2$ and MnO, etc., and these oxides become fine and uniformly disperse in the molten steel.

When this molten steel solidifies, since many solidification nuclei are formed and further the above oxides themselves show the effect of pinning action (suppressing the coarsening of a structure immediately after solidification), the coarsening of the solidification structure of a cast steel is suppressed, equiaxed crystals are generated, and the equiaxed crystals themselves become fine and homogeneous.

It is preferable that the Mg addition amount and the total Ca amount contained in molten steel are controlled by the processing apparatuses 25 and 35 (see FIGS. 5 and 6) so that the generation of calcium aluminate (low-melting-point compound such as $12CaO—7Al_2O_3$) is suppressed.

Then pure MgO and MgO-containing oxides such as $MgO—Al_2O_3$ are formed by oxygen contained in molten steel and oxygen supplied from oxides such as FeO, $SiO_2$ and MnO, etc., and fine oxides uniformly disperse in the molten steel.

The solidification structure of a cast steel continuously cast from molten steel processed by the Processing Method I of the present invention, as shown in FIG. 9, becomes the one comprising uniform and fine equiaxed crystals.

A cast steel thus processed and cast is cut into a prescribed size, transferred to succeeding processes, heated in a reheating furnace or a soaking pit, etc., not shown in the figures, is then subjected to processing such as rolling, etc., and is produced as a steel material. Since the workability of the cast steel is markedly improved, a steel material produced from this cast steel is excellent in drawing property and toughness.

Further, a cast steel can be cast by, in addition to a continuous casting method, a method of ingot casting, belt casting or twin roll casting, etc. When a cast steel with a thickness of 100 mm or more is cast, for example, since the diameters of equiaxed crystals in the structure from the surface layer to the interior of the cast steel can be easily controlled and the effect of fining is remarkable, a preferable result can be obtained.

(2) Processing Method II of the present invention is characterized by carrying out a deoxidation treatment by adding a prescribed amount of Al containing alloy in molten steel before adding a prescribed amount of Mg therein.

In a processing apparatus 25 shown in FIGS. 5, molten steel 11 (150 tons) after decarbonization refining is contained in a ladle 26 and subjected to the adjustment of components, then 70 kg of Al is paid off from a storage hopper 27 and added into the molten steel 11 through a chute 29, at the same time, argon gas is supplied through a porous plug 34 provided at the bottom of the ladle 26, and the molten steel 11 is sufficiently deoxidized by the added Al while the molten steel 11 is stirred.

After the deoxidation by Al, the supply of argon gas through the porous plug 34 is continued, a wire 30 is paid off guided by a guide pipe 32 with operating a rotating drum, not shown in the figures, of a feeder 31, passing through slag 33, and 0.75 to 15 kg of metallic Mg (0.0005 to 0.010 mass %) is fed into the molten steel 11.

In this way, a prescribed amount of Al is added before a prescribed amount of Mg is added and $Al_2O_3$ is generated by reacting with oxygen, MnO, $SiO_2$ and FeO, etc., in molten steel, then Mg is added, and MgO and MgO-containing oxide such as MgO—$Al_2O_3$ are generated at the surface of $Al_2O_3$ whose lattice incoherence with δ-ferrite is larger than 6% and which does not act as a solidification nucleus. By doing this, the lattice incoherence of inclusions in molten steel with δ-ferrite is made smaller than 6%, and the inclusions can act as solidification nuclei when the molten steel solidifies.

As a result, the molten steel contains MgO and/or MgO-containing oxides dispersed in a great number, and since solidification starts with these oxides acting as starting points during solidification, the solidification structure of the cast steel becomes fine.

With the Processing Method II of the present invention, it is possible to eliminate cracks and dents generated on the surface of a cast steel, to suppress center segregation and center porosity, etc., generated in the interior, to suppress reconditioning and scrapping of the cast steel and a steel material processed therefrom, and to improve quality.

It is possible, before adding Mg in molten steel 11, namely after the deoxidation by Al, to pay off 50 kg of Fe—Ti alloy from a storage hopper 28 and to add it into molten steel 11 in a ladle 26 through a chute 29.

Since Al is added into molten steel and $Al_2O_3$ is generated by a deoxidation reaction beforehand, Ti does not generate $TiO_2$ even though Fe—Ti alloy is added, and it dissolves in the molten steel in the state of solid solution or generates TiN combining with N in the molten steel.

After that, a wire 30 is paid off and guided by a guide pipe 32 by operating the rotating drum of a feeder 31, and 0.75 to 15 kg of Mg is fed into the molten steel 11, and, as a result, MgO and MgO oxides (MgO—$Al_2O_3$) are generated on the surface of $Al_2O_3$.

MgO and/or MgO—$Al_2O_3$, which cover the surface of $Al_2O_3$, since their lattice incoherence with δ-ferrite is less than 6%, act as solidification nuclei when molten steel solidifies.

Further, the aforementioned TiN acts as a solidification nucleus likewise and, with a synergistic effect with MgO and/or MgO—$Al_2O_3$, it is possible to make solidification structure fine. In particular, with regard to the addition sequence of Al and Ti, in addition to the aforementioned addition sequence, it may be possible to take the steps of generating $TiO_2$ by adding Ti beforehand, then reducing $TiO_2$ by the added Al, and dissolving reduced Ti in molten steel in the state of solid solution.

In any case, it is possible that Ti forms TiN solely or on MgO-containing oxides and further enhances the action as a solidification nucleus. Then, since the addition amount of Ti may be small, it is possible to reduce the alloy cost and to prevent defects caused by TiN.

The composition of MgO-containing oxides was investigated by sampling a part of molten steel processed by the Processing Method II of the present invention and by using the electron probe microanalysis (EPMA) method with an electron microscope.

As a result, it was verified that, in the case of Mg addition after Al addition, inclusions which act as solidification nuclei are substances comprising $Al_2O_3$ in the interior thereof and covered with MgO or MgO-containing oxides comprising MgO—$Al_2O_3$ at the outer circumference.

Further, in the case that Ti is added after Al is added and then Mg is added, observed were inclusions having the structure wherein MgO-containing oxides cover the surface of $Al_2O_3$ and further TiN covers a part of the circumference thereof. These inclusions, since their lattice incoherence with δ-ferrite is less than 6%, act as effective solidification nuclei.

With regard to the addition sequence of Ti, in either case that Ti and Al are added in the order of Ti and then Al (or Al and then Ti), and, after that, Mg is added, or that Mg is added after Al is added, and, after that, Ti is added, the structure of covering inclusions is so configured that MgO or MgO—$Al_2O_3$ covers the surface of $Al_2O_3$ and TiN covers a part or the whole thereof, and thus the inclusions act as solidification nuclei effectively.

Further, in a cast steel cast from molten steel processed by the Processing Method II of the present invention, the solidification structure of the surface layer portion and interior in the cross section of the cast steel is sufficiently fine, as shown in FIG. 9.

(3) In the Processing Methods I and II of the present invention, it is preferable to add a prescribed amount of Mg in molten steel so that oxides such as slag and deoxidation products, etc. contained in the molten steel and oxides produced during the addition of Mg in the molten steel satisfy the following formulae (1) and (2):

$$17.4(kAl_2O_3)+3.9(kMgO)+0.3(kMgAl_2O_4)+18.7(kCaO)\leqq 500 \quad (1)$$

$$(kAl_2O_3)+(kMgO)+(kMgAl_2O_4)+(kCaO)\geqq 95 \quad (2),$$

wherein k designates mole % of the oxides.

When generating oxides by adding Mg in molten steel and fining the solidification structure of a cast steel, sometimes, oxides of MgO—$Al_2O_3$—CaO are formed or high-melting-point oxides of MgO—CaO, etc., are formed, depending on other addition elements and slag compositions.

However, since the oxides of MgO—$Al_2O_3$—CaO have a low-melting-point, they do not act as solidification nuclei when molten steel solidifies. On the other hand, since the oxides of MgO—CaO have a high-melting-point, they exist in the state of solid phase, but, their lattice coherence with δ-ferrite which is a solidified primary crystal is low and thus they do not act as solidified nuclei.

As a result of diligent research on the oxides of MgO—$Al_2O_3$—CaO and of MgO—CaO, the present inventors found out that, if the mole fractions of the components in the oxides are controlled in a proper range, it is possible to suppress the melting point of oxides becoming low and to improve their lattice incoherence with δ-ferrite which is a solidified primary crystal.

In a processing apparatus shown in FIG. 5, after decarbonized and phosphor and sulfur, etc. are removed using a refining furnace, 150 tons of molten steel 11 was received in a ladle 26.

After that, while injecting argon gas through a porous plug 34, deoxidation was carried out by adding 50 to 100 kg of Al from a hopper 27 and mixing it uniformly while stirring the molten steel 11.

Then, the structure of the oxides was analyzed by sampling the molten steel 11 and using the electron probe microanalyzer (EPMA) and α value, which is the index of the lattice incoherence of the oxides with δ-ferrite, was calculated using the formula (3) described below.

Mg addition amount was determined so that the α value is not more than 500 taking the yield into consideration and Mg-containing wire 30 corresponding to the determined amount was fed into the molten steel 11 through a guide pipe 32 with the operation of a feeder 31.

$$\alpha=17.4(kAl_2O_3)+3.9(kMgO)+0.3(kMgAl_2O_4)+18.7(kCaO)\leqq 500 \quad (3),$$

wherein k designates mole % of the oxides.

Figure 17:
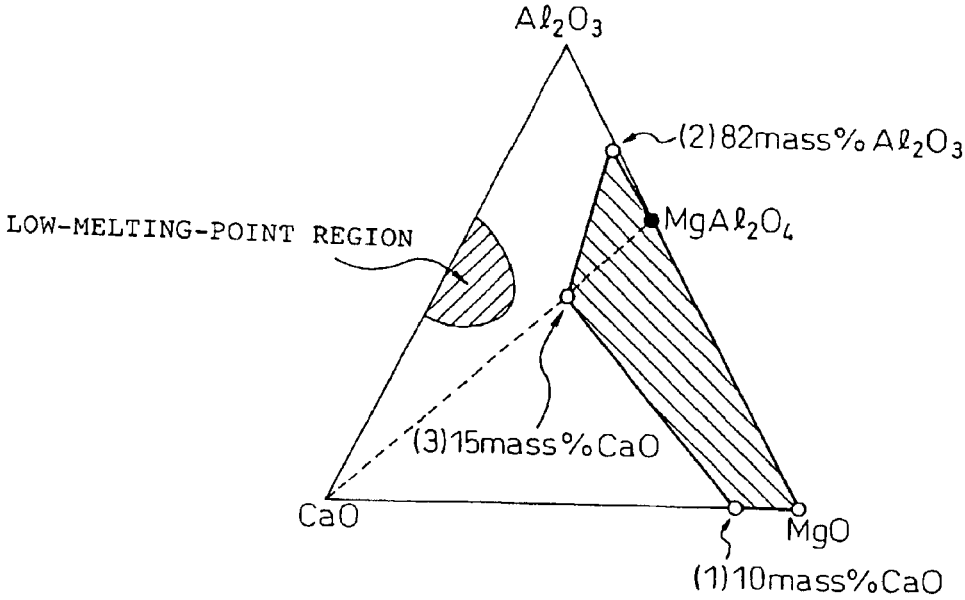
FIG. 17 is a diagram showing the composition region related to the present invention in the CaO—$Al_2O_3$—MgO phase diagram.

FIG. 17 shows the ternary phase diagram of CaO—$Al_2O_3$—MgO and if oxides are the complex oxides of CaO—$Al_2O_3$—MgO existing in the range satisfying the above formula (3) as shown in the figure (the hatched range surrounded by round circles), they act as solidification nuclei effectively.

When α value exceeds 500, even if the melting point of complex oxides becomes low or high, MgO-containing oxides covering the surface of oxides decreases and they do not act as solidification nuclei.

Further, a β value is calculated with the formula (4) shown below. When the β value is less than 95, other oxides such as $SiO_2$ and FeO, etc., increase and the generation of complex oxides which become solidification nuclei is prevented.

$$\beta=(kAl_2O_3)+(kMgO)+(kMgAl_2O_4)+(kCaO)\geqq 95 \quad (4),$$

wherein k designates mole % of the oxides.

Therefore, Mg addition amount is determined so that α value is not more than 500 and β value is not less than 95, taking the yield into consideration.

A wire 30 containing Mg corresponding to the amount of Mg thus determined is fed into molten steel 11 through a guide pipe 32 by the operation of a feeder 31.

As a result, it is possible to form many ternary system oxides of CaO—$Al_2O_3$—MgO generated by adding MgO to $Al_2O_3$ and CaO and, in addition, to form $Al_2O_3$—MgO and MgO too. Further, it is possible to disperse these complex oxides in molten steel, to commence solidification of molten steel 11 using these solidification nuclei as starting points when the temperature drops, to form equiaxed crystals, and to produce a cast steel having a fine solidification structure.

By doing so, the solidification structure of a cast steel produced by the solidification of the molten steel 11 becomes fine as shown FIG. 9.

By making fine a solidification structure, it is possible to prevent internal defects such as internal cracks, center segregation and center porosity, etc. of a cast steel. Moreover, in a steel material processed from the cast steel with a fine solidification structure, workability during rolling, etc., is excellent and the generation of surface flaws, etc. such as edge seams and roping, etc., is stably prevented.

It is preferable to control Mg addition amount within the range corresponding to the concentration of 0.0005 to 0.010 mass %.

When Mg concentration is less than 0.0005 mass %, complex oxides whose lattice incoherence with δ-ferrite is not more than 5% cannot be generated and the solidification structure of a cast steel does not become fine. On the other hand, even if Mg concentration is increased to higher than 0.010 mass %, the effect of making fine a solidification structure is saturated and the cost for the Mg addition increases.

(4) Processing Method III of the present invention is characterized by adding a prescribed amount of Mg in molten steel having the concentrations of Ti and N satisfying the solubility product constant wherein TiN crystallizes at a temperature not lower than the liqudus temperature of the molten steel.

Then, in the Processing Method III of the present invention, when molten steel is of ferritic stainless steel, it is preferable that aforementioned Ti concentration [% Ti] and N concentration [% N] satisfy the following formula:

$$[\%\ Ti]\times[\%\ N]\geqq([\%\ Cr]^{2.5}+150)\times 10^{-6},$$

wherein [% Ti] designates the amount of Ti, [% N] the amount of N, and [% Cr] the amount of Cr, in molten steel in terms of mass %.

Further, in the Processing Method III of the present invention, the amount of $Al_2O_3$ contained in molten steel is set to 0.005 to 0.10 mass %.

The lattice incoherence of TiN with δ-ferrite (a value of the difference between the lattice constant of TiN and the lattice constant of δ-ferrite divided by the lattice constant of δ-ferrite) is 4%, which is preferable, but TiN is apt to coagulate. Therefore, there are problems that coarse TiN causes the clogging of an immersion nozzle or defects such as slivers in a steel material.

The Processing Method III of the present invention is characterized in that, in addition to TiN effectively acting as a solidification nucleus when molten steel solidifies, that MgO-containing oxides generated by adding Mg in molten steel have extremely good dispersibility and, moreover, TiN preferentially crystallizes on the MgO-containing oxides.

Perceiving this point, the present inventors, in the Processing Method III of the present invention, made use of the MgO-containing oxides, enhanced the dispersibility of TiN crystallizing on the MgO-containing oxides and acting as a solidification nucleus, and made many solidification nuclei effective for the fining of a solidification structure disperse in molten steel.

When Ti and N are added in molten steel, the temperature at which TiN crystallizes is determined by the product of Ti concentration and N concentration, so called solubility product constant [% Ti] ×[% N].

For example, it is possible to arrange so that Ti and N added in molten steel retain the state of a solid solution in the molten steel at a temperature higher than the liquidus temperature of about 1,500° C. depending on their addition amount or at the temperature of 1,506° C. which is higher than the temperature at which TiN crystallizes, and commence to crystallize as TiN when cooled to a crystallization temperature of not more than about 1,505° C.

Figure 18:
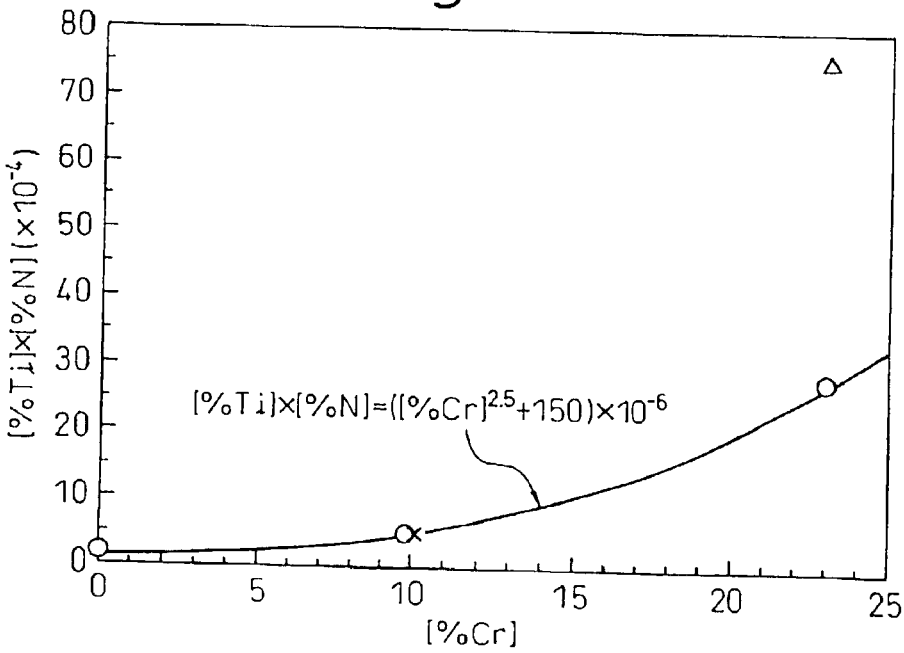
FIG. 18 is a graph showing a relationship between the solubility product constant of the concentrations of Ti and N in molten steel: [% Ti]×[% N] and Cr concentration: [% Cr], in a method for processing molten steel according to the present invention.

The present inventors carried out experiments, perceiving the relationship between the solubility product constant of the concentrations of Ti and N and the concentration of Cr for making fine the solidification structure of ferritic stainless steel containing a required amount of Cr, and obtained the results as shown in FIG. 18. The above formula is obtained from the results shown in FIG. 18.

Here, in FIG. 18, X designates a case where a solidification structure did not become fine, ○ a case where a solidification structure become sufficiently fine, and Δ a case where a solidification structure become fine but nozzle clogging occurred during casting.

In the apparatus shown in FIG. 5, after decarbonized and impurities such as phosphor and sulfur, etc. were removed using a refining furnace, 150 tons of molten steel 11 was received in a ladle 26. The molten steel 11 is of ferritic stainless steel containing 10 to 23 mass % of Cr.

After that, 150 kg of Fe—Ti alloy was added from a hopper 27 and 30 kg of N—Mn alloy from a hopper 28 in the molten steel 11, and they were uniformly mixed while stirring the molten steel 11.

Fe—Ti alloy and N—Mn alloy were added as mentioned above so that the concentrations of Ti and N contained in the molten steel 11satisfy the above formula, and that, in case that Cr content is 10 mass %, Ti concentration is 0.020 mass % and N concentration is 0.024 mass %.

The lattice incoherence of TiN with δ-ferrite is 4% which is low and TiN is likely to become a solidification nucleus of δ-ferrite. Therefore, TiN is excellent in generating equiaxed crystals easily and making fine a solidification structure when molten steel solidifies.

For making TiN act as a solidification nucleus, it is necessary to commence the crystallization of TiN at a temperature not lower than the liquidus temperature of molten steel at which molten steel commences solidification, for example, at a temperature not lower than 1,500° C. Even if crystallized at a temperature lower than the liquidus temperature, the effect of making fine a solidification structure cannot be secured.

Therefore, it is necessary to add Ti and N by determining a liquidus temperature and in the range where solubility product constant satisfies the above formula.

For increasing the effect of making fine by TiN, it is possible to increase the addition amounts of Ti and N and the amount of crystallized TiN at a certain temperature. However, the amounts of Ti and N are restricted depending on a steel grade. Even though the amounts of Ti and N are increased, TiN coagulates and coarsens with a lapse of time after crystallization, and a phenomena is seen that the number of solidification nuclei does not necessarily increase. Rather, drawbacks such as nozzle clogging caused by coarse TiN and the generation of scabs in the steel material, etc., arise.

Therefore, even though the amounts of Ti and N are identical, by using a feeder 31, feeding 75 kg of Mg in molten steel while guiding Mg containing wire 30 through a guide pipe 32 (refer to FIG. 5), securing the Mg concentration at 0.0005 to 0.010 mass %, and generating MgO-containing oxides, it is possible to disperse the crystallized TiN in the molten steel finely.

That is, before adding Ti and N or after adding Ti, Mg is added at a temperature higher than the temperature at which TiN crystallizes and MgO-containing oxides are generated.

TiN crystallizes with the temperature of molten steel decreasing, but, since the lattice incoherence of MgO-containing oxides is close to that of TiN, TiN crystallizes preferentially on the MgO-containing oxides dispersed finely and disperses and crystallizes in a great number in the molten steel more effectively than in the case of not adding Mg.

Further, a preferable result can be obtained when Mg is added after Ti is added to maintain the yield of Mg added to a molten steel at a high level and the duration before casting is shortened.

As a result, it is possible to prevent an unstable operation such as nozzle clogging, etc., caused by coarse TiN generated when Ti and N are added (without adding Mg) and to make fine the solidification structure of a cast steel produced by the solidification of the molten steel, as shown in FIG. 9.

By making fine a solidification structure, it is possible to prevent internal defects such as internal cracks, center segregation and center porosity, etc., caused by the shrinkage during solidification and a coarse structure.

As described above, in the steel material processed from a cast steel having a fine solidification structure, since the solidification structure is fine, the generation of surface flaws such as scabs, edge seam and roping, etc., of a product is also stably suppressed.

(5) Processing Method IV of the present invention is characterized by containing 1 to 30 mass % of oxides reduced by Mg in slag covering molten steel.

In the Processing Method IV of the present invention, oxides reduced by Mg comprise one or more types of FeO, $Fe_2O_3$, MnO and $SiO_2$.

Further, in the Processing Method IV of the present invention, $Al_2O_3$ contained in molten steel is set to 0.005 to 0.10 mass %.

In a processing apparatus shown in FIG. 5, molten steel 11 processed by vacuum secondary refining (secondary refining) after subjected to decarbonization refining is received in a ladle 26.

The molten steel 11 is adjusted to contain 0.005 to 0.10 mass % of $Al_2O_3$ by adding deoxidizer such as aluminum and aluminum alloy.

The purpose is to form high-melting-point MgO-containing oxides by promoting the generation of complex oxides such as MgO—$Al_2O_3$, etc., to further improve a fining property and dispersibility and enhance the activity as solidification nuclei by combining $Al_2O_3$, which has poor dispersibility and is likely to coagulate, with MgO, and thus to fine the structure of a cast steel and a steel material.

When $Al_2O_3$ contained in molten steel is less than 0.005 mass %, generated MgO combines with $Fe_2O_3$ and $SiO_2$, etc., low-melting-point oxides are generated, and the activity as solidification nuclei lowers. On the other hand, when $Al_2O_3$ contained in molten steel is more than 0.10 mass %, sometimes, $Al_2O_3$ which is likely to coagulate increases excessively and defects caused by oxides arise in a cast steel and a steel material.

When molten steel 11 is poured into a ladle 26, slag 33 which intermixed from a basic oxygen furnace or generated from a flux, etc., added during secondary refining also flows in and covers the surface of the molten steel 11in the ladle 26.

Then, Mg is added into the molten steel 11 by feeding Mg and Mg alloy containing wire 30 through a guide pipe 32 into the molten steel 11passing through the slag 33 at a rate of 2 to 50 m/min. using a feeder 31.

Conventionally, the major components of the slag covering the surface of molten steel are CaO, $SiO_2$, $Al_2O_3$, FeO, $Fe_2O_3$ and MnO, etc. When Mg is added into the molten steel covered by this slag, MgO generated by the reaction of Mg and Mg alloy with oxides in the slag is captured in the slag. As a result, Mg concentration in the molten steel cannot increase and the Mg yield in the molten steel deteriorates.

As a result of intensive research on this phenomenon, the present inventors have found that the free energy of oxide formation is larger than the free energy of MgO formation, in other words, there is an important relationship between the total weight of oxides which is thermodynamically unstable and the Mg yield in molten steel.

Figure 19:
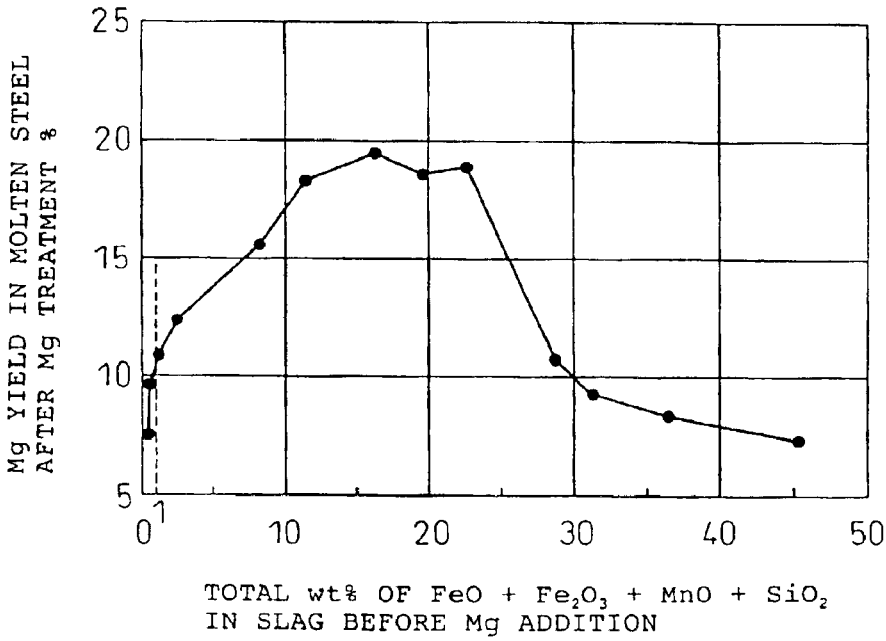
FIG. 19 is a graph showing a relationship between the total mass % of FeO, $Fe_2O_3$, MnO and $SiO_2$ in slag before Mg addition and Mg yield in molten steel after Mg treatment, in a method for processing molten steel according to the present invention.

That is, as shown in FIG. 19, when controlling the total mass % of FeO, $Fe_2O_3$, MnO and $SiO_2$, which are thermodynamically unstable oxides existing in slag before Mg addition, within the range of 1 to 30 mass % and feeding the wire containing Mg and Mg alloy into the molten steel passing through slag, the Mg yield of not less than 10% can be achieved.

Here, the Mg yield means the yield calculated by converting the total amount of Mg and MgO-containing oxides contained in molten steel into the amount of Mg. The form of Mg actually existing in molten steel is mostly MgO itself or a complex oxide such as MgO—$Al_2O_3$, etc.

It is thought that, when Mg is added into molten steel, the aforementioned oxides in slag are reduced by Mg according to the chemical reactions shown in the following formulae (1) to (4):

$$FeO+Mg \rightarrow MgO+Fe \quad (1)$$

$$Fe_2O_3+3Mg \rightarrow 3MgO+2Fe \quad (2)$$

$$MnO+Mg \rightarrow MgO+Mn \quad (3)$$

$$SiO_2+2Mg \rightarrow 2MgO+Si \quad (4)$$

That is, Mg added into molten steel is consumed in the chemical reactions shown in the above formulae (1) to (4) and generated MgO moves into slag.

In this case, when the total mass % of FeO, $Fe_2O_3$, MnO and $SiO_2$ is less than 1 mass %, the reaction of Mg added and Mg contained in Mg alloy to slag can be suppressed, however, the amount of oxygen dissolved in molten steel which is determined by the thermodynamic equilibrium of slag and molten steel also decreases.

As a result, Mg itself once added into molten steel does not form a complex oxide such as MgO or MgO—$Al_2O_3$, etc., and vaporizes with a lapse of time, and thus Mg yield deteriorates.

On the other hand, when the total mass % of the above-mentioned oxides in slag exceeds 30 mass %, the reaction of Mg and Mg contained in Mg alloy added in molten steel to slag is intensified and most of the added Mg generates MgO by the chemical reactions of the formulae (1) to (4) and moves into slag. As a result, the amount generating fine MgO-containing oxides acting as solidification nuclei in molten steel decreases, the yield of added Mg deteriorates, and the fining of the cast steel structure cannot be achieved.

Further, it is necessary to increase the Mg addition amount for securing Mg concentration required for the fining. However, this results in the increase of manufacturing cost, a drop of temperature caused by the addition of Mg and Mg alloy, and further, operational problems caused by the variation of slag properties.

As described above, for improving the yield of Mg added in molten steel, forming high-melting-point complex oxides such as MgO and MgO—$Al_2O_3$, etc., and generating more stable and finer solidification nuclei, it is preferable to control the oxides in slag within the range shown by the formula below, and more preferably, within the range of 2 to 20 mass % to obtain a better result.

$$1 \text{ mass } \% \leqq FeO+Fe_2O_3+MnO+SiO_2 \leqq 30 \text{ mass } \%$$

For controlling the concentration of oxides in slag covering molten steel within the range shown in the above formula, generally used methods are applicable, such as the method for making the reduction with reducing components in molten steel easier by scraping out slag before Mg addition and decreasing the amount of slag and the method for processing by adding a reducing agent in slag.

Here, as Mg alloy added into molten steel, Si—Mg alloy, Fe—Si—Mg alloy, Al—Mg alloy and Fe—Si—Mn—Mg alloy, etc., can be used.

(6) Processing Method V of the present invention is characterized by controlling the activity of CaO in slag covering molten steel at not more than 0.3 before adding a prescribed amount of Mg in the molten steel.

Further, in the Processing Method V of the present invention, the basicity of slag is controlled at not more than 10.

In a processing apparatus shown in FIG. 5, molten steel 11, which is a ferritic stainless steel containing 0.01 to 0.05 mass % of carbon, 0.10 to 0.50 mass % of manganese and 10 to 20 mass % of chromium and is processed by vacuum secondary refining (secondary refining) after subjected to decarbonization refining, is received in a ladle 26.

When molten steel 11 is poured into a ladle 26, slag 33 which intermixed from a basic oxygen furnace or generated from flux, etc. added during secondary refining also flows in and covers the surface of the molten steel 11.

The thickness of the slag 33 is 50 to 100 mm and the slag 33 is adjusted by the addition of flux, etc., so that the activity of CaO in the slag 33 is not more than 0.3 and the basicity ($CaO/SiO_2$) is not more than 10.

Then, Mg and Mg alloy are added into the molten steel by feeding a wire 30 containing Mg and Mg alloy through a guide pipe 32 into the molten steel 11passing through the slag 33 at a rate of 2 to 50 m/min., using a feeder 31.

Conventionally, the slag covering the surface of molten steel contains oxides such as CaO, $SiO_2$, $Al_2O_3$ and FeO, etc., and sometimes CaO concentration in the slag is raised to enhance desulfurization and dephosphorization in a basic oxygen furnace and secondary refining.

In this case, as shown in the formula below, Ca concentration in molten steel also increases by the equilibrium reaction between slag and molten steel.

$$CaO \rightarrow Ca+O$$

When Mg or Mg alloy is added in this molten steel, low-melting-point complex oxides such as CaO—$Al_2O_3$—MgO, etc., or oxides whose lattice incoherence with δ-ferrite is large are generated in the molten steel.

Since these oxides do not act as solidification nuclei when molten steel solidifies and also do not show a pinning action (suppressing the grain growth of equiaxed crystals immediately after solidification), the solidification structure coarsens. As a result, in a cast steel and a steel material processed from the cast steel, surface flaws and internal defects such as cracks, scabs and center porosity, etc., are generated.

Figure 20:
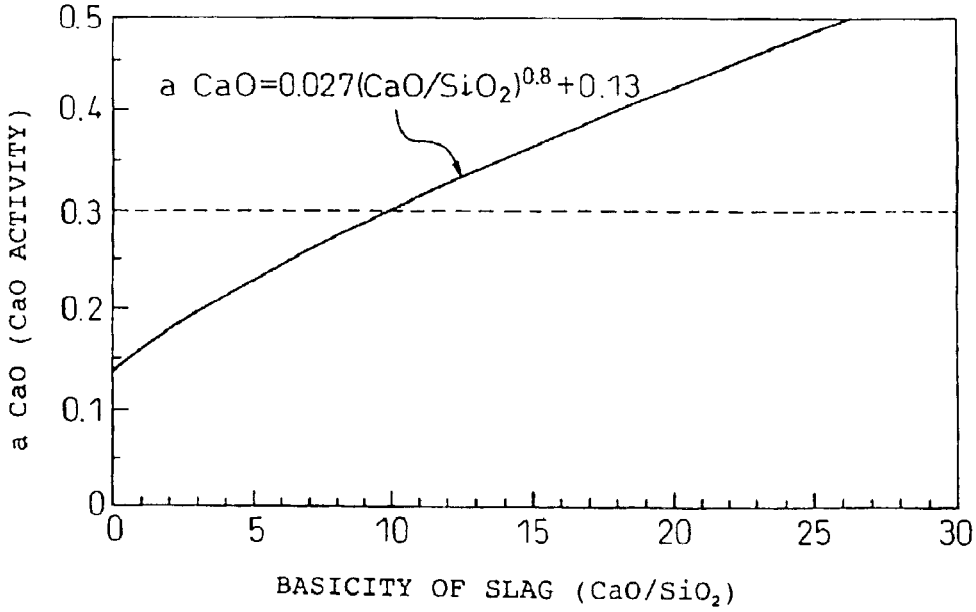
FIG. 20 is a graph showing a relationship between the basicity of slag and the activity of CaO, in a method for processing molten steel according to the present invention.

Therefore, for enhancing the activity of solidification nuclei and pinning effect, as shown in FIG. 20, it is necessary to control the CaO activity (aCaO) in slag, which is determined from the basicity of slag using the formula below, at not more than 0.3 and to add Mg or Mg alloy into molten steel.

$$aCaO=0.027(CaO/SiO_2)^{0.8}+0.13$$

By decreasing the CaO activity (aCaO) in slag to not more than 0.3, Mg and Mg contained in Mg alloy, etc., become high-melting-point MgO-containing oxides whose lattice incoherence with δ-ferrite is small, such as MgO or MgO—$Al_2O_3$, etc., and sufficiently act as solidification nuclei when molten steel solidifies. Moreover, since the MgO-containing oxides show enough pinning effect, it is possible to fine the solidification structure of a cast steel and to suppress the generation of surface flaws and internal defects in a cast steel.

When decreasing the CaO activity to not more than 0.2, the melting point of the generated MgO-containing oxides can be raised and the activity as solidification nuclei can be further enhanced.

Furthermore, in place of the CaO activity of slag, by controlling the basicity of slag at not more than 10, high-melting-point MgO-containing oxides such as MgO or MgO—$Al_2O_3$, etc., can be generated.

The CaO activity and basicity can be controlled by controlling the thickness of slag covering molten steel and by adding flux containing $Al_2O_3$ and MgO into slag.

When the basicity exceeds 10, Mg added and Mg contained in Mg alloy form low-melting-point complex oxides such as $CaO—Al_2O_3—MgO$, etc., not only do not act as solidification nuclei but also act as the starting points of the generation of defects, and thus deteriorate the quality of a cast steel and a steel material.

On the other hand, when CaO activity is controlled at not more than 0.2 or basicity is controlled at not more than 6, since the generation of MgO-containing oxides (act as solidification nuclei) is promoted and their pinning effect is enhanced, the fining of the solidification structure of a cast steel can be ensured.

Here, as Mg alloy for adding into molten steel, Si—Mg alloy, Fe—Si—Mg alloy, Al—Mg alloy, Fe—Si—Mn—Mg alloy and Ni—Mg alloy, etc., are used.

Then, a cast steel is produced by solidifying molten steel, in which 0.0005 to 0.010 mass % of Mg is added, in a mold.

4) Methods for producing Cast Steels A to D of the present invention will be explained hereunder. The Cast Steels A to D of the present invention are produced by pouring molten steel containing MgO-containing oxides into a mold and continuously casting the molten steel while stirring the molten steel using an electromagnetic stirrer.

When producing a cast steel of the present invention by continuous casting, an electromagnetic stirrer is installed at a position between the meniscus in a mold and a level 2.5 m away therefrom in the downstream direction.

Further, when producing a cast steel of the present invention by continuous casting, the flow velocity of an agitation stream imposed on molten steel by an electromagnetic stirrer is set to not less than 10 cm/sec.

In the continuous caster shown in FIGS. 1 to 4, molten steel 11 containing 16.5 mass % of chromium is poured in a mold 13 through an outlet 14 of an immersion nozzle 15, and, while solidifying and forming a solidified shell 18*a* by the cooling with the mold 13 and the cooling with water spray from cooling water nozzles installed in support segments 17, then extracted with pinch rolls 20 and 21 to produce a cast steel 18.

0.0005 to 0.010 mass % of Mg is contained in molten steel 11, and the Mg reacts to oxygen and oxides such as $SiO_2$ and MnO, etc., in the molten steel 11 and forms oxides such as MgO and $MgO—Al_2O_3$, etc.

When Mg content is less than 0.0005 mass %, MgO in molten steel decreases, the amount of generated solidification nuclei as well as the effect of pinning action decreases, and thus a solidification structure cannot become fine. On the other hand, when Mg content exceeds 0.010 mass %, the effect of making fine a solidification structure is saturated and marked effect does not appear, increasing the cost for the addition of Mg, etc.

Here, an electromagnetic stirrer 16 is installed at the position 500 mm apart from the meniscus in a mold 13 in the downstream direction.

The feature of stirring is that a stirring flow directed from a short piece 13*d* toward a short piece 13*c* along the inside of a long piece 13*a* of a mold 13 is imposed with electromagnetic coils 16*a* and 16*b*, and another stirring flow directed from a short piece 13*c* toward a short piece 13*d* along the inside of a long piece 13*b* is imposed with electromagnetic coils 16*c* and 16*d*. As a whole, as shown by the arrows in FIG. 3, a stirring flow whirling in the horizontal direction is imposed on the molten steel 11.

Then, the molten steel 11 poured from an outlet 14 is cooled by a mold 13, oxides present at the vicinity of a solidified shell 18*a* are flushed away, preventing oxides from captured by the solidified shell 18*a*, and thus the surface layer portion having few oxides can be obtained.

Since the surface layer portion thus obtained is cooled at a rapid cooling rate by the cooling with the mold 13 and the water spray from cooling water nozzles installed in support segments 17, it is likely to be a fine solidification structure. In addition, since stirring flow divides the tips of columnar crystals into pieces and the relaxation of the so-called constituent supercooling (melting point falls locally due to the concentration of solute components accompanying solid-liquid allocation at a solidification interface) promotes equiaxed crystallization, a fine solidification structure can be obtained even if oxides are few.

Further, with regard to the oxides flushed away from the vicinity of the solidified shell 18*a*, though some of them float upward and are captured by powder not shown in the figures at the surface of the meniscus, most of them remain in the interior of a cast steel acting as solidification nuclei and showing pinning action, and thus the solidification structure of the interior of the cast steel can become fine.

The stirring flow is imposed on the molten steel 11 with the thrust (5 to 90 mmFe) generated by giving three-phase alternating current with different phases to the electromagnetic coils 16*a* to 16*d* and by imposing shifting magnetic field known by the Flemming law on the molten steel 11.

The strength of the thrust is controlled by changing the value of electric current imposed on the electromagnetic coils 16*a* to 16*d* so that the flow rate falls within the range of 10 to 40 cm/sec.

As a result, it becomes possible to make fine not less than 60% of a solidification structure from the surface layer portion to the interior of the cast steel 18, to suppress the generation of surface flaws such as cracks and dents, etc., and internal cracks caused by bulging and straightening, to secure the fluidity of unsolidified molten steel, and to produce the high quality cast steel 18 wherein the generation of center porosity and center segregation is suppressed.

Also in a steel material produced from the cast steel 18 by processing such as rolling, etc., the generation of surface flaws and internal defects such as cracks, scabs, center porosity and center segregation, etc., is suppressed and excellent drawing property and material properties can be obtained.

When the fine solidification structure of a cast steel 18 is less than 60%, crystal grains become large, surface flaws and internal defects arise, and material properties such as drawing property deteriorate.

Further, based on the reason described above, it is possible to improve the uniformity of a solidification structure by occupying the whole cross section of a cast steel 18 in the thickness direction with a fine solidification structure, to surely prevent the generation of surface flaws and internal defects of the cast steel and steel material, and to improve material properties further stably.

In particular, since, in a cast steel thus produced, oxides contained in the surface layer portion are small, it is possible to decrease the oxides existing on the surface or at the vicinity thereof of a steel sheet and a section, etc., processed by rolling, etc.

Then, when the oxides on the surface or at the vicinity thereof decrease, since the amount of oxides (MgO-containing oxides) which dissolve out when they contact with acid or salt water, etc., can be suppressed, the corrosion of a steel material generated with these oxides acting as starting points can be prevented. Therefore, a steel material obtained by processing a cast steel produced with the continuous casting method according to the present invention is excellent in corrosion resistance, too.

(8) The continuous casting method of the present invention can be applied to the continuous casting of ferritic stainless molten steel.

The continuous casting method of the present invention is suitable, in particular, for casting ferritic stainless molten steel containing 10 to 23 mass % of chromium and 0.0005 to 0.010 mass % of Mg.

In the continuous caster shown in FIGS. 1 to 4, molten steel 11 containing 10 to 23 mass % of chromium is poured in a mold 13 through an outlet 14 of an immersion nozzle 15, and, while being stirred with an electromagnetic stirrer 16, solidifying and forming a solidified shell 18*a* by the cooling with the mold 13 and the cooling with water spray from cooling water nozzles installed in support segments 17, then extracted with pinch rolls 20 and 21 to produce a cast steel 18.

0.0005 to 0.010 mass % of Mg is contained in molten steel 11, and the Mg reacts to oxides such as O, $SiO_2$ and MnO, etc., contained in the molten steel 11 and forms high-melting-point oxides such as MgO or MgO—$Al_2O_3$, etc.

The oxides such as MgO or MgO—$Al_2O_3$, etc., act as solidification nuclei, promote equiaxed crystallization of a solidification structure, and exhibit the so-called pinning action which suppresses the growth of the structure immediately after solidification. Further, by promoting the generation of equiaxed crystals, it is possible that not less than 60% of the cross section is occupied by a fine solidification structure (equiaxed crystals).

When the fine solidification structure (equiaxed crystals) of a cast steel is less than 60%, the crystal grain diameter of whole cross section becomes large and surface flaws and internal defects are apt to appear.

Besides, when Mg content is less than 0.0005 mass %, MgO and/or MgO-containing oxides in molten steel decrease, the generation of solidification nuclei and the effect of pinning action lower, and thus a solidification structure cannot become fine. On the other hand, when the Mg content exceeds 0.010 mass %, the effect of making fine a solidification structure is saturated and the cost of adding the Mg increases.

An electromagnetic stirrer 16 is installed at a position 500 mm away from the molten steel surface (meniscus) 25 in a mold 13 in the downstream direction and imposes a stirring flow whirling along the inner wall of the mold 13 on the molten steel 11 in the mold 13.

The flow velocity and the action effect of the stirring flow is the same as described in the previous section (7).

In the cast steel thus obtained, as shown in FIG. 9, the surface layer portion which the stirring flow affects is occupied by extremely fine equiaxed crystals and the interior is occupied by a solidification structure of fine equiaxed crystals.

Moreover, since the solidification structure of fine equiaxed crystals improves the fluidity of molten steel at the unsolidified portion 18*b* in the interior of a cast steel, it is possible to suppress the generation of center porosity and center segregation, and to prevent the generation of surface flaws and internal defects such as cracks and scabs, etc., in a cast steel and even in a steel pipe produced from the cast steel.

Further, in some cases, soft reduction is applied to a cast steel to suppress the generation of center porosity. That is, using reduction segments 19 and holding the bottom face of a cast steel 18 with support rolls 22, a soft reduction is applied so that the upper portion in the center is pressed down by about 3 to 10 mm with convex 23 of the reduction rolls 24. By this soft reduction, an unsolidified portion 18*b* and center porosity generated in the interior of a cast steel 18 can be bonded with pressure.

The soft reduction is commenced from the time when solid phase rate (the thickness of a solidified portion/the thickness of a cast steel) of a cast steel 18 is in the range of 0.2 to 0.7.

Here, the solid phase rate is determined by striking a wedge into a cast steel, judging the melt damage of the tip thereof, and measuring the solidified (solid phase) area and the unsolidified area of the cast steel.

With the cast steel 18, breakdown where reduction ratio exceeds 0.90 (large reduction) is not required and it is possible to eliminate a rolling process which is generally carried out using a rolling mill such as blooming or slabbing process and to save the production cost drastically.

Then, a cast steel thus cast is cut into a prescribed length, formed after heated again, and then pierced with a plug to produce a seamless steel pipe in pipe manufacturing processes.

Since, in this cast steel used for pipe manufacturing, the solidification structure is fine and, in addition, center porosity, etc. is surely bonded with pressure by soft reduction, when the cast steel is pierced by expanding the interior with a plug, it easily deforms by processing, the generation of cracks and scabs on the inner surface is prevented, and thus a steel pipe with excellent quality can be produced.

In addition, it is not necessary to apply reconditioning such as grinding after a pipe is manufactured and it is possible to prevent scrapping caused by defects and to improve the yield and the productivity, etc., of the product.

In particular, when a pipe is manufactured using a cast steel produced with imposing electromagnetic stirring at the vicinity of a mold, since oxides contained in the surface layer portion of the cast steel are few, oxides existing on the surface and at the vicinity thereof of the steel pipe pierced in the pipe manufacturing process can decrease too. Therefore, it is possible to suppress the amount of the oxides (MgO-containing oxides) which dissolve out when their surfaces contact with acid or salt water, etc., and to improve corrosion resistance by suppressing the corrosion of the steel pipe generated with these oxides acting as starting points.

5) Now examples according to the present invention will be described hereunder.

It should be understood that the present invention is not intended to be limited to the specific examples and the objects of the present invention, change of conditions within the scope not deviating from the gist of the present invention and modifications of embodiments, etc., are included in the scope of the present invention.

EXAMPLE 1-1

The example relates to the Cast Steel A of the present invention.

0.005 mass % of Mg was added into molten steel in a tundish, then the molten steel was poured into a mold with an inner size of 1,200 mm in width and 250 mm in thickness, the cast steel was cooled and solidified by the cooling with the mold and the water sprays from support segments, and the cast steel was extracted with pinch rolls after subjected to the reduction of 3 to 7 mm using reduction segments.

Then, the cast steel was cut, the solidification structure (status of equiaxed crystals) of the cross section in the thickness direction and defects in the surface layer and interior of the cast steel were investigated, then the cast steel was rolled after heated to the temperature of 1,250° C., and defects in the surface layer and interior and workability of the steel material were investigated. The results are shown in Table 1.

TABLE 1

| Item | | Example 1 | Example 2 | Example 3 |
|---|---|---|---|---|
| Macro-structure of cast steel | | Surface layer: columnar crystal Interior: equiaxed crystal (60%) | Whole cross section is occupied by equiaxed crystals. | Whole cross section is occupied by equiaxed crystals. The maximum diameter of equiaxed crystals is within three times the average diameter of equiaxed crystals. |
| Quality of cast steel | | ○ | ○ | ○ |
| Quality of steel material | Surface flaw | ○ | ◎ | ◎ |
| | Internal defect | ○ | ◎ | ◎ |
| Workability of steel material | | ○ | ○ | ◎ |

TABLE 2

| Item | | Comparative example 1 | Comparative example 2 |
|---|---|---|---|
| Macro-structure of cast steel | | Surface layer: columnar crystal (50%) Interior: equiaxed crystals (50%) | Whole cross section is occupied by equiaxed crystals. However, the equiaxed crystals in the surface layer do not satisfy the formula specified by the present invention. |
| Quality of cast steel | | X | Δ |
| Quality of steel material | Surface flaw | X | Δ |
| | Internal defect | X | Δ |
| Workability of steel material | | X | Δ |

In Table 1, example 1 relates to a cast steel prepared so that 60% of the solidification structure over the total cross section in the thickness direction thereof is occupied by equiaxed crystals (equiaxed crystal diameters of 1 to 5.2 mm), the diameters (mm) of which satisfy the formula below. In said cast steel, though some cracks are observed in the range of columnar crystals in the surface layer, the generation of internal defects such as cracks, center porosity and center segregation, etc., is suppressed and good results are obtained as a whole (designated with the marks ○).

$$D<1.2X^{1/3}+0.75,$$

wherein D designates each diameter (mm) of equiaxed crystals in terms of internal structure in which the crystal orientations are identical, and X the distance (mm) from the surface of the cast steel.

Further, in a steel material rolled using this cast steel, the generation of scabs and cracks is low in the surface layer, internal defects such as cracks, center porosity and center segregation, etc., are also few, thus the results are good (designated with the marks ○), the deformation in the direction of rolling is easily performed since the solidification structure is fine and the micro-segregation is small, and toughness after forming is also good (designated with the marks ○).

Example 2 relates to a cast steel comprising equiaxed crystals whose diameters (mm) satisfy the above formula over the total cross section in the thickness direction of the cast steel (equiaxed crystal diameters of 1.0 to 4.5 mm). In said cast steel, columnar crystals are not present in the surface layer, defects are few in the surface layer and interior, and the quality is good (designated with the marks ○).

Further, in a steel material rolled using this cast steel, the generation of scabs and cracks is extremely low in the surface layer, internal defects such as cracks, center porosity and center segregation, etc. are also extremely few, and thus the results are good (designated with the marks ◎). Moreover, the deformation in the direction of rolling is easily performed since the solidification structure is fine and the micro-segregation is small, and toughness after forming is also excellent (designated with the marks ○).

Example 3 relates to a cast steel wherein the solidification structure thereof comprises equiaxed crystals whose diameters (mm) satisfy the above formula over the total cross section in the thickness direction of the cast steel (equiaxed crystal diameters of 0.9 to 2.6 mm) and the maximum equiaxed crystal diameter is not more than three times the average equiaxed crystal diameter. In said cast steel, micro-segregation formed in the surface layer portion is small, the generation of scabs and cracks is low since the dispersion of micro-segregation is suppressed, and, in the interior too, internal defects such as cracks, center porosity and center segregation, etc., do not appear (designated with the marks ○).

Further, a steel material rolled using this cast steel is very excellent in the suppression of the surface flaws such as scabs and cracks, etc. in the surface layer and the internal defects such as cracks, center porosity and center segregation, etc. (designated with the marks ∪), deforms easily in the direction of rolling, and is excellent in toughness, etc., after forming (designated with the marks ◎)

On the contrary, as shown in Table 2, comparative example 1 relates to a cast steel wherein equiaxed crystals occupy 50% of the cross section of the cast steel in the thickness direction and columnar crystals are present at the rate of 50% in the surface layer. In said cast steel, cracks appear at the columnar crystal portion in the surface layer, internal defects also appear, and thus the evaluation results are bad (designated with the marks X).

Further, in a steel material rolled using this cast steel, surface flaws such as scabs and cracks, etc. and internal defects such as cracks, center porosity and center segregation, etc. appear (designated with the marks X), the evaluation on workability and toughness after forming, etc. is also bad (designated with the marks X).

Comparative example 2 relates to a cast steel wherein the whole cross section of the cast steel in the thickness direction is occupied by equiaxed crystals but the equiaxed crystals in the surface layer (40% of the whole cross section) do not satisfy above formula. In said cast steel, the evaluation on surface flaws such as scabs and cracks, etc. in the surface layer and internal defects such as center porosity and center segregation, etc. is somewhat bad (designated with the marks Δ). In a steel material rolled using this cast steel, scabs and cracks slightly appear in the surface layer, internal defects such as center porosity and center segregation, etc. slightly appear too, resulting in somewhat bad evaluation (designated with the marks Δ), and workability and toughness, etc., after forming are also somewhat bad (designated with the marks Δ).

EXAMPLE 1-2

The example is a case where, in Cast Steel A of the present invention, the diameters D (mm) of equiaxed crystals satisfy the following formula:

$$D<0.08X^{0.78}+0.5,$$

wherein X designates the distance (mm) from the surface of the cast steel, and D each diameter (mm) of equiaxed crystals located at the distance of X from the surface of the cast steel.

After adding 0.1 mass % of Mg into molten steel in a tundish, the molten steel was poured in a mold with an inner size of 1,200 mm in width and 250 mm in thickness, the cast steel was cooled and solidified by the cooling with the mold and the water sprays from support segments, and the cast steel was extracted with pinch rolls after being subjected to the reduction of 3 to 7 mm using reduction segments.

Then, the cast steel was cut, the solidification structure (status of equiaxed crystal diameter) of the cross section in the thickness direction and defects in the surface layer and interior of the cast steel were investigated, then the cast steel was rolled after being heated to the temperature of 1,250° C., and defects in the surface layer and interior and workability of the steel material were investigated. The results are shown in Table 3.

TABLE 3

| | Item | Example 1 | Example 2 | Example 3 | Comparative example 1 | Comparative example 2 |
|---|---|---|---|---|---|---|
| Quality of cast steel | Surface flaw | Δ | ○ | ○ | X | Δ |
| | Internal defect | ○ | ○ | ◎ | X | X |
| Quality of steel material | Surface flaw | Δ | ○ | ○ | X | Δ |
| | Internal defect | ○ | ○ | ◎ | X | X |
| | Workability | ○ | ○ | ◎ | X | X |

In Table 3, the evaluation results are designated as follows: ◎; very good, ○; good, Δ; somewhat good, X; bad.

In Table 3, example 1 relates to a cast steel prepared so that not less than 60% of the solidification structure over the total cross section thereof is occupied by equiaxed crystals, the diameters (mm) of which satisfy aforementioned formula (equiaxed crystal diameters of 1.5 to 3.2 mm), and to a steel material produced using said cast steel. With regard to the quality of said cast steel, the generation of cracks is comparatively low, internal defects such as cracks, center porosity and center segregation, etc., are also few, and thus the evaluation is good.

Further, with regard to the quality of said steel material rolled using said cast steel, the generation of scabs and cracks in the surface layer is comparatively low, internal defects such as cracks, center porosity and center segregation, etc., are also few, thus the evaluation is good, and toughness, etc. after forming is also good.

Example 2 relates to a cast steel prepared so that the whole cross section of the cast steel is occupied by equiaxed crystals whose diameters satisfy the aforementioned formula (equiaxed crystal diameters of 0.3 to 2.9 mm), and to a steel material produced using said cast steel. In said cast steel, the generation of cracks is low, internal defects such as cracks, center porosity and center segregation, etc., do not appear, and thus the quality is good.

Further, with regard to the quality of said steel material rolled using said cast steel, the generation of scabs and cracks in the surface layer is low, internal defects such as cracks, center porosity and center segregation, etc., are also few, thus the evaluation is good, and toughness, etc., after forming is also excellent.

Example 3 relates to a cast steel wherein the total cross section thereof is occupied by equiaxed crystals having the diameters of 0.5 to 1.4 mm and the maximum equiaxed crystal diameter is not more than three times the average equiaxed crystal diameter, and to a steel material produced using said cast steel. In said cast steel, the generation of cracks is lower and, in the interior too, internal defects such as cracks, center porosity and center segregation, etc., do not appear, and thus the quality is very excellent.

Further, in the steel material rolled using said cast steel, the generation of surface flaws scabs and cracks, etc., in the surface layer and internal defects such as cracks, center porosity and center segregation, etc. is ultimately suppressed, and toughness, etc. after forming is excellent.

On the contrary, comparative example 1 relates to a cast steel prepared so that columnar crystals exist in the range not less than 40% from the surface layer of the solidification structure at the cross section in the thickness direction of the cast steel and the equiaxed crystal diameters in the solidification structure of the interior are 2.0 to 3.1 mm, and to a steel material produced using said cast steel. In the cast steel and the steel material, micro-segregation in the surface layer is large, cracks caused by the casting process and the cooling process in a mold are generated, and internal defects such as cracks, center porosity and center segregation, etc., are also generated. Further, in the steel material rolled using said cast steel, surface flaws such as scabs and cracks and internal defects such as cracks, center porosity and center segregation, etc., are generated, and workability and toughness, etc. after forming are also bad.

Comparative example 2 relates to a cast steel wherein 40% of the solidification structure at the cross section in the thickness direction of the cast steel is occupied by equiaxed crystals whose diameters satisfy the aforementioned formula (equiaxed crystal diameters of 2.8 to 5.7 mm), and to a steel material produced using said cast steel. In the cast steel and the steel material, cracks, etc., in the surface layer are considerably suppressed, but internal defects such as cracks, center porosity and center segregation, etc., are generated in the interior.

Further, in the steel material rolled using said cast steel, scabs and cracks are somewhat generated in the surface layer, internal defects such as cracks, center porosity and center segregation, etc., are also generated, and workability and toughness, etc. after forming are also bad.

EXAMPLE 2

The example relates to Cast Steel B of the present invention.

0.005 mass % of Mg was added into molten steel in a tundish, then the molten steel was continuously cast in a mold with an inner size of 1,200 mm in width and 250 mm in thickness, the cast steel was cooled and solidified by the cooling with the mold and the water sprays from support segments, and the cast steel was extracted with pinch rolls after subjected to the reduction of 3 to 7 mm using reduction segments.

Then, the cast steel was cut, equiaxed crystals of the structure at the cross section in the thickness direction and crystal grain diameter of each surface at each position of the corresponding thickness after grinding the cast steel at an interval of 2 mm from the surface of the cast steel were measured, and defects in the surface layer and interior of the cast steel were investigated. Further, surface flaws, wrinkles and workability, etc., of the steel material produced by rolling said cast steel after heated to the temperature of 1,250° C. were investigated. The results are shown in Table 4.

TABLE 4

| | Cast steel | | Steel material | | |
|---|---|---|---|---|---|
| Item | Surface crack | Internal crack | Surface flaw | Wrinkle | Workability |
| Example 1 | ○ | ○ | ○ | ○ | ○ |
| Example 2 | ◎ | ◎ | ◎ | ◎ | ◎ |
| Comparative example | X | X | X | X | X |

In Table 4, example 1 relates to a cast steel prepared so that equiaxed crystals are formed at the area of 30% of total cross section in the thickness direction of the cast steel and the maximum crystal grain diameter divided by the average crystal grain diameter is 2 to 2.7 at the surface in the corresponding depth of the thickness direction. In this cast steel, surface cracks and internal cracks do not appear (designated with the marks ○), and, in the steel material produced by rolling said cast steel, the generation of surface flaws and wrinkles is insignificant (designated with the marks ○), and further workability is also good (designated with the marks ○).

Example 2 represents a cast steel illustrated with a solid line in FIG. 14 and relates to a cast steel prepared so that equiaxed crystals are formed at the area of not less than 60% in the interior thereof and the maximum crystal grain diameter divided by the average crystal grain diameter is 1.7 to 2.5 at the surface in the corresponding depth of the thickness direction. In this cast steel, surface cracks and internal cracks do not appear (designated with the marks ◎), and, in the steel material produced by rolling said cast steel, surface flaws and wrinkles do not appear (designated with the marks ◎), and further workability is very good (designated with the marks ◎).

On the contrary, comparative example 1 represents a cast steel illustrated with a solid line in FIG. 15 and relates to a cast steel wherein equiaxed crystal ratio in the interior of the cast steel is as low as about 20%, the center portion is occupied by coarse equiaxed crystals, and some of the values obtained by dividing the maximum crystal grain diameter by the average crystal grain diameter exceed three times (2.5 to 4.7) among the crystal grain diameters at the positions in the corresponding depth of the thickness direction. In this cast steel, surface cracks and internal cracks are observed (designated with the marks X), and, in the steel material produced by rolling said cast steel, surface flaws such as surface cracks, etc. and wrinkles are generated (designated with the marks X), and workability is also bad (designated with the marks X).

EXAMPLE 3

The example relates to Cast Steel C of the present invention.

0.005 mass % of Mg was added into molten steel in a tundish, then the molten steel was continuously cast in a mold with an inner size of 1,200 mm in width and 250 mm in thickness, the cast steel was cooled and solidified by the cooling with the mold and the water sprays from support segments, and the cast steel was extracted with pinch rolls after subjected to the reduction of 3 to 7 mm using reduction segments.

Then, the cast steel was cut, and equiaxed crystal ratio of solidification structure at the cross section in the thickness direction, the average diameter (mm) of equiaxed crystals and defects in the surface layer and interior of the cast steel were investigated. Further, the cast steel was heated to a temperature of 1,250° C. and rolled into a steel material, and defects in the surface layer and interior of the steel material and workability were investigated. The results are shown in Table 5.

TABLE 5

| Item | Number of inclusions (/cm$^2$) | Size of inclusion ($\mu$m) | Equiaxed crystal rate (%) | Average diameter of equiaxed crystal (mm) | Surface flaw of cast steel and steel material | Internal defect of cast steel and steel material | r value of steel material | Toughness at welded portion of steel material |
|---|---|---|---|---|---|---|---|---|
| Example 1 | 104 | Not less than 10 | 62 | 1.8 | ○ | ○ | ○ | ○ |
| Example 2 | 141 | Not more than 10 | 81 | 1.3 | ◎ | ◎ | ◎ | ○ |
| Comparative example 1 | 70 | Not more than 10 | 27 | 2.5 | X | X | X | X |
| Comparative example 2 | 45 | Not more than 10 | 15 | 4.7 | X | X | X | X |

In Table 5, example 1 relates to a cast steel prepared so that the number of inclusions whose lattice incoherence with δ-ferrite contained in the cast steel of ferritic steel is not more than 6% is 104/cm$^2$, the size of the inclusions is not less than 10 μm, equiaxed crystal ratio is 62%, and the average diameter of equiaxed crystals is 1.8 mm. In this cast steel, the generation of surface flaws such as cracks and dents, etc., is low (designated with the marks ○), and internal defects such as cracks, center porosity and center segregation, etc., are also few (designated with the marks ○).

Further, in the steel material produced by rolling said cast steel, ridging and edge seam, etc. are few in the surface layer (designated with the marks ○), internal defects such as cracks, center porosity and center segregation, etc., are also few (designated with the marks ○), and r value which is an index of workability, etc. is good (designated with the marks ○).

Example 2 relates to a cast steel prepared so that the number of inclusions whose lattice incoherence with δ-ferrite contained in the cast steel of ferritic steel is not more than 6% is 141/cm$^2$, the size of the inclusions is not more than 10 μm, equiaxed crystal ratio is 81%, and the average diameter of equiaxed crystals is 1.3 mm. In this cast steel, the generation of surface flaws such as cracks and dents, etc., is low (designated with the marks ◎), and internal defects such as cracks, center porosity and center segregation, etc., are also few (designated with the marks ◎).

Further, in the steel material produced by rolling said cast steel, ridging and edge seam, etc., are few in the surface layer (designated with the marks ◎), internal defects such as cracks, center porosity and center segregation, etc., are also few (designated with the marks ◎), r value which is an index of workability, etc. is also good (designated with the marks ◎) On the contrary, comparative example 1 relates to a cast steel prepared so that the number of inclusions contained in the cast steel is 70/cm$^2$, the size of the inclusions is not more than 10 μm, equiaxed crystal ratio is 27%, and the average diameter of equiaxed crystals is 2.5 mm. In this cast steel, surface flaws such as cracks and dents, etc., are generated (designated with the marks X), and internal defects such as cracks, center porosity and center segregation, etc., are also generated in the interior of the cast steel (designated with the marks X).

Further, in a steel material produced by rolling said cast steel, scabs, ridging and edge seam, etc., are generated in the surface layer (designated with the marks X), internal defects such as cracks, voids and segregation, etc., are many (designated with the marks X), and r value which is an index of workability, etc., is also bad (designated with the marks X).

Comparative example 2 relates to a cast steel wherein the number of the metallic compound of not more than 10 μm among the metallic compound existing per unit area in the cast steel is 45/cm$^2$ in the surface layer portion and also 45/cm$^2$ in the interior and the maximum grain diameters of equiaxed crystals both in the surface layer portion and in the interior are large. In this cast steel, surface flaws such as cracks and dents, etc., and internal defects such as center porosity and segregation, etc., are also generated (designated with the marks X).

Further, in the steel material produced by rolling said cast steel, surface flaws such as scabs and cracks, etc., and internal defects such as cracks, center porosity and center segregation, etc., are generated (designated with the marks X), and r value which is an index of workability, etc., is also bad (designated with the marks X).

EXAMPLE 4

The example relates to Cast Steel D of the present invention.

0.005 mass % of Mg was added into molten steel in a tundish, then the molten steel was continuously cast in a mold with an inner size of 1,200 mm in width and 250 mm in thickness, the cast steel was cooled and solidified by the cooling with the mold and the water sprays from support segments, and the cast steel was extracted with pinch rolls after subjected to the reduction of 3 to 7 mm using reduction segments.

Then, the cast steel was cut, and equiaxed crystal size of the solidification structure at the cross section in the thickness direction and defects in the surface layer and interior of the cast steel were investigated. Further, the cast steel was heated to the temperature of 1,250° C. and rolled into a steel material, and defects in the surface layer and interior of the steel material and workability were investigated. The results are shown in Table 6.

TABLE 6

| | Number of metallic compound (/cm$^2$) | | | Maximum diameter of equiaxed crystal grain (mm) | | Internal defect and surface flaw of cast steel or steel material | r value of steel material |
|---|---|---|---|---|---|---|---|
| | (a) Surface layer portion | (b) Interior portion | (b)/(a) | Surface layer portion | Interior portion | | |
| Example 1 | 50 | 66 | 1.32 | 1.7 | 4.9 | ○ | ○ |
| Example 2 | 95 | 130 | 1.37 | 1.1 | 3.1 | ○ | ○ |
| Comparative example 1 | 45 | 46 | 1.02 | 1.8 | 5.5 | X | X |
| Comparative example 2 | 97 | 116 | 1.19 | 1.2 | 4.2 | ○ | X |

In Table 6, example 1 relates to a cast steel prepared so that the number of the metallic compounds, the size of which is not more than 10 μm among the metallic compounds contained in the cast steel, is 50/cm$^2$ in the surface layer portion and 66/cm$^2$ in the interior portion, and good equiaxed crystals are formed. In this cast steel, cracks, dents, ridging and edge seam, etc., are few and internal defects such as cracks, center porosity and center segregation, etc., are also few. Further, in a steel material produced by rolling said cast steel, ridging and edge seam, etc., in the surface layer and internal defects such as cracks, center porosity and center segregation, etc., are few (designated with the marks ○), and r value which is an index of workability, etc. is good (designated with the marks ○).

Example 2 relates to a cast steel wherein the number of the metallic compound, the size of which is not more than 10 μm among the metallic compound existing per unit area in the cast steel, is 95/cm$^2$ in the surface layer portion and 130/cm$^2$ in the interior, and good equiaxed crystals are formed. In this cast steel, cracks, dents, ridging and edge seam, etc., are few and internal defects such as cracks, center porosity and center segregation, etc., are also few. Further, in a steel material produced by rolling said cast steel, ridging and edge seam, etc., in the surface layer and internal defects such as cracks, center porosity and center segregation, etc., are few (designated with the marks ○), and the r value, etc., are good (designated with the marks ○).

On the contrary, comparative example 1 relates to a cast steel wherein the number of the metallic compound, the size of which is not more than 10 μm among the metallic compound existing per unit area in the cast steel, is 45/cm$^2$ in the surface layer portion and 46/cm$^2$ in the interior, and the maximum grain diameters of equiaxed crystals both in the surface layer portion and in the interior are large. In this cast steel, surface flaws such as cracks and dents, etc., and internal defects such as cracks, center porosity and center segregation, etc., are generated, and, in a steel material produced by rolling said cast steel, surface flaws such as scabs and cracks and internal defects such as cracks, center porosity and center segregation, etc., are generated (designated with the marks X), and the r value is also bad (designated with the marks X).

Comparative example 2 relates to a cast steel wherein the number of the metallic compound, the size of which is not more than 10 μm among the metallic compound existing per unit area in the cast steel, is 97/cm$^2$ in the surface layer portion and 116/cm$^2$ in the interior, and the grain diameters of equiaxed crystals both in the surface layer portion and in the interior are small. In this cast steel and a steel material produced from the cast steel, the generation of surface flaws and internal defects is low (designated with the marks ○), but the r value is bad (designated with the marks X).

Further, in cast steels wherein the ratio of the number of metallic compounds having sizes of not more than 10 μm are similar to examples 1 and 2, and 0.06 mass % of MgO, $MgAl_2O_3$, TiN and TiC are added as metallic compounds, and in steel materials produced from said cast steels by processing such as rolling, etc., the size of equiaxed crystals in the solidification structure and defects in the surface layer and interior of the cast steels were investigated. Further, the cast steels were heated to the temperature of 1,250° C. and rolled into steel materials, and defects in the surface layer and interior of the steel materials and workability were investigated. Consequently, good results were obtained.

EXAMPLE 5

The example relates to the Processing Method I of the present invention.

In respective cases that molten steel in a tundish did not contain Ca, and contained 0.0002 mass %, 0.0005 mass %, 0.0006 mass % and 0.0010 mass % as total Ca, 0.005 mass % of Mg was added into respective molten steel, then the respective molten steel was poured and continuously cast in a mold with an inner size of 1,200 mm in width and 250 mm in thickness, the cast steel was cooled and solidified by the cooling with the mold and the water sprays from support segments, and the cast steel was extracted with pinch rolls after being subjected to the reduction of 3 to 7 mm using reduction segments.

Then, main components of the oxides in molten steel before Mg addition, main components of the oxides in molten steel after Mg addition, and the status of the fining of the cast steel structure were investigated. The results are shown in Table 7.

TABLE 7

| | | Total Ca mass % in molten steel before Mg addition | Inclusion in molten steel before Mg addition | Inclusion in molten steel after Mg addition | Status of the fining of the solidification structure in cast steel | Synthetic judgement |
|---|---|---|---|---|---|---|
| Example | 1 | 0.0000% | $Al_2O_3$ | $Al_2O_3$.MgO, MgO | Extremely fine (grain diameter <1 mm) | ◎ |
| | 2 | 0.0002% | $Al_2O_3$ | $Al_2O_3$.MgO, MgO | Extremely fine (grain diameter <1 mm) | ◎ |
| | 3 | 0.0005% | $Al_2O_3$ | $Al_2O_3$.MgO, MgO | Extremely fine (grain diameter <1 mm) | ◎ |
| | 4 | 0.0006% | $Al_2O_3$.CaO (CaO is not more than several percent.) | $Al_2O_3$.MgO · CaO MgO.CaO (CaO is not more than several percent.) | Fine (grain diameter <3 mm) | ○ |
| | 5 | 0.0010% | $Al_2O_3$.CaO (CaO is not more than several percent.) | $Al_2O_3$.MgO · CaO MgO.CaO (CaO is not more than several percent.) | Fine (grain diameter <3 mm) | ○ |
| Comparative example | 1 | 0.0012% | $Al_2O_3$.CaO | $Al_2O_3$.MgO · CaO | Coarse | X |
| | 2 | 0.0015% | $Al_2O_3$.CaO | $Al_2O_3$.MgO · CaO | Coarse | X |
| | 3 | 0.0023% | $Al_2O_3$.CaO | $Al_2O_3$.MgO · CaO | Coarse | X |

In Table 7, example 1 represents the case that Ca is not contained in molten steel, and inclusions in molten steel before Mg addition are oxides having $Al_2O_3$ as the main component and inclusions in molten steel after Mg addition are oxides having $Al_2O_3$—MgO and MgO as the main component. The solidification structure of a cast steel produced by casting this molten steel is extremely fine and the synthetic judgement is extremely good (designated with the marks ◎).

Example 2 represents the case that Ca in molten steel is adjusted to 0.0002 mass %, and inclusions in molten steel before Mg addition are oxides having $Al_2O_3$ as the main component and inclusions in molten steel after Mg addition are oxides having $Al_2O_3$—MgO and MgO as the main component. In this molten steel, calcium aluminate is not generated, the solidification structure of a cast steel produced by casting this molten steel is extremely fine and the synthetic judgement is extremely good (designated with the marks ◎).

Example 3 represents the case that Ca in molten steel is adjusted to 0.0005 mass %, and inclusions in molten steel before Mg addition are oxides having $Al_2O_3$ as the main component and inclusions in molten steel after Mg addition are oxides having $Al_2O_3$—MgO and MgO as the main component. In this molten steel, calcium aluminate is not generated, the solidification structure of a cast steel produced by casting this molten steel is extremely fine and the synthetic judgement is extremely good (designated with the marks ◎).

Example 4 represents the case that Ca in molten steel is adjusted to 0.0006 mass %, and inclusions in molten steel before Mg addition are oxides having $Al_2O_3$ as the main component and additionally CaO of not more than several percent, and inclusions in molten steel after Mg addition are oxides having $Al_2O_3$—MgO—CaO and MgO—CaO including CaO of not more than several percent as the main component.

In this molten steel, though CaO is detected in the inclusions before and after Mg addition, since the contained amount is not more than several percent, an inoculation effect appears when molten steel solidifies. Therefore, the solidification structure of a cast steel produced by casting this molten steel is fine and the synthetic judgement is good (designated with the marks ○).

Example 5 represents the case that Ca in molten steel is adjusted to 0.0010 mass %, and inclusions in molten steel before Mg addition are oxides having $Al_2O_3$ as the main component and additionally CaO of not more than several percent, and inclusions in molten steel after Mg addition are oxides having $Al_2O_3$—MgO—CaO and MgO—CaO including CaO of not more than several percent as the main component.

In this molten steel too, though CaO is detected in the inclusions before and after Mg addition, since the contained amount is not more than several percent, inoculation effect appears when molten steel solidifies. Therefore, the solidification structure of a cast steel produced by casting this molten steel is fine and the synthetic judgement is good (designated with the marks ○).

On the contrary, comparative example 1 represents the case that Ca in molten steel is adjusted to 0.0012 mass %, and inclusions in molten steel before Mg addition are oxides having $Al_2O_3$—CaO (calcium aluminate) as the main component and inclusions in molten steel after Mg addition are oxides having CaO—$Al_2O_3$—MgO as the main component. The solidification structure of a cast steel produced by casting this molten steel is coarse and the synthetic judgement is bad (designated with the marks X).

Comparative example 2 represents the case that Ca in molten steel is adjusted to 0.015 mass %, and inclusions in molten steel before Mg addition are oxides having $Al_2O_3$—CaO (calcium aluminate) as the main component and inclusions in molten steel after Mg addition are oxides having CaO—$Al_2O_3$—MgO as the main component. The solidification structure of a cast steel produced by casting this molten steel is coarse and the synthetic judgement is bad (designated with the marks X).

Comparative example 3 represents the case that Ca in molten steel is adjusted to 0.023 mass %, and inclusions in molten steel before Mg addition are oxides having $Al_2O_3$—CaO (calcium aluminate) as the main component and inclusions in molten steel after Mg addition are oxides having CaO—$Al_2O_3$—MgO as the main component. The solidification structure of a cast steel produced by casting this molten steel is coarse and the synthetic judgement is bad (designated with the marks X).

EXAMPLE 6

The example relates to the Processing Method II of the present invention.

150 tons of molten steel subjected to decarbonization refining and the adjustment of components was received in a ladle, Al and Ti were added into the molten steel changing the addition conditions, at the same time, the molten steel was deoxidized while the molten steel was stirred with argon gas being injected through a porous plug provided at the ladle, and after that 0.75 to 15 kg of Mg was supplied into the molten steel. Then the presence of defects in the surface layer and interior of the cast steel continuously cast using the molten steel and status of the fining of the solidification structure were investigated. The results are shown in Table 8.

TABLE 8

| | | Example | | | Comparative example | |
|---|---|---|---|---|---|---|
| Item | | 1 | 2 | 3 | 1 | 2 |
| Molten steel amount (ton) | | 150 | 150 | 150 | 150 | 150 |
| Deoxidation condition | Amount of deoxidizer (kg) | Metallic Al: 50 kg | Metallic Al: 75 kg, Fe—Ti: 50 kg | Fe—Ti: 50 kg, metallic Al: 75 kg | Simultaneous addition of 75 kg of metallic Al and 0.75 kg of metallic Mg | Addition of 75 kg of metallic Al after adding 50 kg of Fe—Ti and 15 kg |
| | Amount of metallic Mg after deoxidation | Metallic Mg: 0.75 kg | Metallic Mg: 15 kg | Metallic Mg: 15 kg | | |

TABLE 8-continued

| Item | Example 1 | Example 2 | Example 3 | Comparative example 1 | Comparative example 2 |
|---|---|---|---|---|---|
| (kg) | | | | | of metallic Mg |
| Presence of surface flaw and internal defect in cast steel | None | None | None | Present | Present |
| Soundness of solidification structure | Good | Good | Good | Bad | Bad |
| Synthetic judgement | ○ | ○ | ○ | X | X |

In Table 8, example 1 represents the case that 0.75 kg of Mg is added after deoxidation by adding 50 kg of Al. No defects are observed in the surface layer and interior of the cast steel, the solidification structure is fine sufficiently, and the synthetic judgement is good (designated with the marks ○).

Example 2 represents the case that deoxidation is carried out by adding 50 kg of Fe—Ti alloy after adding 75 kg of Al, and then 15 kg of Mg is added. No defects are observed in the surface layer and interior of the cast steel, the solidification structure is fine sufficiently, and the synthetic judgement is good (designated with the marks ○).

Example 3 represents the case that deoxidation is carried out by adding 75 kg of Al after adding 50 kg of Fe—Ti alloy, and then 15 kg of Mg is added. No defects are observed in the surface layer and interior of the cast steel, the solidification structure is fine sufficiently, and the synthetic judgement is good (designated with the marks ○).

Here, in any of examples 1 to 3, as shown in FIG. 9, the solidification structure has equiaxed crystals formed in its interior and is fine.

On the contrary, comparative example 1 represents the case that deoxidation is carried out by adding 75 kg of Al and 0.75 kg of Mg simultaneously. Complex oxides of MgO and $Al_2O_3$ are generated in molten steel, but, in the surface structure of MgO-containing oxides, MgO content is not more than 10% and its lattice coherence with δ-ferrite is low, and thus the surface structure is inappropriate as solidification nuclei. As a result, defects appear in the surface layer and interior of the cast steel, the solidification structure is coarse as shown in FIG. 7, and the synthetic judgement is bad (designated with the marks X).

Comparative example 2 represents the case that 15 kg of Mg is added after 50 kg of Fe—Ti alloy is added, and then deoxidation is carried out by adding 75 kg of Al. Oxides in molten steel are composed of MgO in their center portions, but they do not act as solidification nuclei since $Al_2O_3$ is generated on their surfaces. As a result, defects appear in the surface layer and interior of the cast steel, solidification structure is coarse and the synthetic judgement is bad (designated with the marks X).

EXAMPLE 7

The example relates, in the Processing Methods I and II of the present invention, to a processing method characterized by adding a prescribed amount of Mg in molten steel so that oxides such as slag and deoxidation products, etc., contained in the molten steel and oxides produced during the addition of Mg in the molten steel satisfy the following formulae (1) and (2) (k designates mole % of the oxides):

$$\beta 17.4(kAl_2O_3)+3.9(kMgO)+0.3(kMgAl_2O_4)+18.7(kCaO)\leqq 500 \quad (1)$$

$$\beta=(kAl_2O_3)+(kMgO)+(kMgAl_2O_4)+(kCaO)\geqq 95 \quad (2).$$

Using a top- and bottom-blown converter, 150 tons of molten steel containing 10 to 23 mass % of chromium was received in a ladle, 100 kg of Al was added while argon gas was injected through a porous plug, and the molten steel was deoxidized by being uniformly mixed while being stirred.

After that, the molten steel was sampled, the composition of oxides was measured with EPMA, Mg addition amount was adjusted so that above formulae were satisfied, and complex oxides were generated. Then a cast steel was produced by continuously casting the molten steel.

After that, the presence of internal defects such as internal cracks, center segregation and center porosity, etc., in the cast steel, the soundness of the solidification structure, and surface appearance and workability of a steel material after processing were investigated. The results are shown in Table 9.

TABLE 9

| Item | Mg addition amount (kg) | Oxide composition (mole %) $Al_2O_3$ | MgO | $MgAl_2O_4$ | CaO | Others | α value of oxides | Internal defect of cast steel | Solidification structure of cast steel | Surface appearance of steel material | Workability of steel material | Synthetic judgement |
|---|---|---|---|---|---|---|---|---|---|---|---|---|
| Example 1 | 125 | 5.1 | 37.2 | 52.4 | 4.1 | 1.2 | 326 | None | Good | Good | Good | ○ |
| Example 2 | 30 | 7.4 | 22.3 | 51.2 | 14.2 | 4.9 | 497 | None | Good | Good | Good | ○ |
| Comparative example 1 | 85 | 3.3 | 46.8 | 29.3 | 16.8 | 3.8 | 563 | Present | Bad | Bad | Bad | X |
| Comparative example 2 | 30 | 15.9 | 30.8 | 37.2 | 12.3 | 11.2 | 638 | Present | Bad | Bad | Bad | X |

In Table 9, example 1 represents the case that 125 kg of Mg is added into molten steel, the molten steel is stirred, and α value (the left side of the above formula (1), an index designates the lattice incoherence of oxides with δ-ferrite) of complex oxides contained in the molten steel is adjusted to 326. Internal defects do not appear in the cast steel, the solidification structure is fine, the surface appearance and workability of the steel material are also good, and thus the synthetic judgement is good (designated with the marks ○).

Example 2 represents the case that 30 kg of Mg is added into molten steel, the molten steel is stirred, and α value of complex oxides contained in the molten steel is adjusted to 497. Internal defects do not appear on the surface and in the interior of the cast steel, the solidification structure is fine as shown in FIG. 9, the surface appearance and workability of the steel material are also good, and thus the synthetic judgement is good (designated with the marks ○).

On the contrary, comparative examples 1 and 2 represent the respective cases that, without considering the composition of oxides contained in molten steel before Mg is added, 85 kg and 30 kg of Mg are respectively added and then the molten steel is stirred. As a result, α value of the complex oxides contained in the molten steel exceeds 500, internal defects are generated in the cast steel, the solidification structure coarsens and deteriorates as shown in FIG. 7 in each cast steel, and thus the synthetic judgement is bad (designated with the marks X).

EXAMPLE 8

The example relates to the Processing Method III of the present invention.

Using a top- and bottom-blown converter, 150 tons of molten steel containing 0 to 23 mass % of chromium and subjected to decarbonization and the removal of impurities such as phosphor and sulfur, etc. was received in a ladle, Fe—Ti alloy and N—Mn alloy were added to adjust the concentrations of Ti and N in the molten steel at 0.013 to 0.125 mass % and 0.0012 to 0.024 mass %, respectively, while argon gas was injected through a porous plug, then Mg was added, and the molten steel was continuously cast into a cast steel. Then, the stability of the casting operation, the quality of the fineness of the solidification structure, and presence of internal defects in the cast steel and surface flaws on the steel material were investigated. The results are shown in Table 10.

In Table 10, example 1 represents the case that 0.0035 mass % of Mg is added after the concentrations of Ti and N are adjusted to 0.013 mass % and 0.012 mass %, respectively, in molten steel containing 0 mass % of Cr. The casting operation is stable, the solidification structure of the cast steel is fine, no defects appear in the cast steel and steel material, and thus the synthetic judgement is good (designated with the marks ○).

Example 2 represents the case that 0.0015 mass % of Mg is added after the concentrations of Cr, Ti and N are adjusted to 10 mass %, 0.020 mass % and 0.024 mass %, respectively, in molten steel. The casting operation is stable, the solidification structure of the cast steel is fine, no defects appear in the cast steel and steel material, and thus the synthetic judgement is good (designated with the marks ○).

Example 3 represents the case that 0.0025 mass % of Mg is added after the concentrations of Ti and N are adjusted to 0.125 mass % and 0.022 mass %, respectively, in molten steel containing 23 mass % of Cr. The casting operation is stable, the solidification structure of the cast steel is fine, no defects appear in the cast steel and steel material, and thus the synthetic judgement is good (designated with the marks ○).

On the contrary, comparative example 1 represents the case that the concentrations of Cr, Ti and N are adjusted to 10 mass %, 0.021 mass % and 0.023 mass %, respectively, in molten steel and Mg is not added. The operation is unstable due to the nozzle clogging during casting, the solidification structure of the cast steel coarsens as shown in FIG. 7, defects appear in the cast steel and steel material, and thus the synthetic judgement is bad (designated with the marks X).

Comparative example 2 represents the case that the concentrations of Cr, Ti and N are adjusted to 23 mass %, 0.198 mass % and 0.038 mass %, respectively, in molten steel and the solubility product constant of Ti and N ([% Ti]×[% N]) is adjusted in a range where TiN does not precipitate, and Mg is not added. In the case of comparative example 2, though the solidification structure is fine, since the operation is unstable due to the nozzle clogging during casting and defects caused by coarse TiN appear on the surface of the steel material, the synthetic evaluation is tentatively judged as bad (designated with the marks Δ).

EXAMPLE 9

The example relates to the Processing Method IV of the present invention.

150 tons of molten steel was received in a ladle, the thickness of slag covering the molten steel was controlled to

TABLE 10

| Item | | Molten steel amount (ton) | Cr concentration (mass %) | Ti concentration (mass %) | N concentration (mass %) | Mg concentration (mass %) | Stability of operation | Quality of the fineness of the solidification structure | Presence of internal defect in cast steel | Presence of surface flaw on steel material | Synthetic judgement |
|---|---|---|---|---|---|---|---|---|---|---|---|
| Example | 1 | 150 | 0 | 0.013 | 0.012 | 0.0035 | Good | Good | None | None | ○ |
| | 2 | 150 | 10 | 0.020 | 0.024 | 0.0015 | Good | Good | None | None | ○ |
| | 3 | 150 | 23 | 0.125 | 0.022 | 0.0025 | Good | Good | None | None | ○ |
| Comparative example | 1 | 150 | 10 | 0.021 | 0.023 | No addition | Bad | Bad | Present | Present | X |
| | 2 | 150 | 23 | 0.198 | 0.038 | No addition | Bad | Good | None | Present | Δ (Nozzle clogging occurred) |

100 mm, total weight of FeO, $Fe_2O_3$, MnO and $SiO_2$ was adjusted within a prescribed range, and Mg alloy wire was supplied into the molten steel passing through the slag so that the amount of Mg is 50 kg in terms of pure Mg (0.0333 mass %).

Further, the molten steel was continuously cast at the casting speed of 0.6 m/min. using a continuous caster having a mold with an inner size of 1,200 mm in width and 250 mm in thickness.

Then, Mg mass % in the molten steel after Mg treatment, Mg mass % in the cast steel and the status of the fining of the solidification structure of the cast steel were investigated. The results are shown in Table 11.

TABLE 11

| Item | | Total mass % of FeO + $Fe_2O_3$ + MnO + $SiO_2$ in slag before Mg addition | Mg mass % in molten steel after Mg addition | Mg mass % in cast steel | Status of the fining of the solidification structure |
|---|---|---|---|---|---|
| Example | 1 | 2.5 | 0.0041 | 0.0015 | Fine |
| | 2 | 11.3 | 0.0061 | 0.0020 | Fine |
| | 3 | 16.1 | 0.0065 | 0.0035 | Fine |
| | 4 | 22.4 | 0.0063 | 0.0031 | Fine |
| | 5 | 28.5 | 0.0036 | 0.0019 | Fine |
| Comparative example | 1 | 0.5 | 0.0025 | 0.0009 | Partially coarse |
| | 2 | 36.3 | 0.0028 | 0.0008 | Partially coarse |

In Table 11, example 1 represents the case that the total amount of FeO, $Fe_2O_3$, MnO and $SiO_2$ in slag before Mg addition was adjusted to 2.5 mass %. Mg in the molten steel is adjusted to 0.0041 mass % and Mg in the cast steel to 0.0015 mass %, and the solidification structure of the cast steel is fine.

Examples 2, 3 and 4 represent the cases that the total amount of FeO, $Fe_2O_3$, MnO and $SiO_2$ in slag before Mg addition is adjusted to 11.3 mass %, 16.1 mass % and 22.4 mass %, respectively. Mg in the molten steel is 0.0061 mass %, 0.0065 mass % and 0.0063 mass %, respectively, and Mg in the cast steel 0.0020 mass %, 0.0035 mass % and 0.0031 mass %, respectively, and thus Mg yield is stably high and the solidification structure of the cast steel is fine.

Example 5 represents the case that the total amount of FeO, $Fe_2O_3$, MnO and $SiO_2$ in slag before Mg addition is adjusted to 28.5 mass %. Mg in the molten steel is adjusted to 0.0036 mass % and Mg in the cast steel to 0.0019 mass %, and the solidification structure of the cast steel is fine.

On the contrary, comparative example 1 represents the case that the total amount of FeO, $Fe_2O_3$, MnO and $SiO_2$ in slag before Mg addition is adjusted to 0.5 mass %. Though Mg in the molten steel is 0.0025 mass %, Mg in the cast steel is 0.0009 mass %, and thus the Mg yield is low and the solidification structure of the cast steel partially coarsens.

Comparative example 2 represents the case that the total amount of FeO, $Fe_2O_3$, MnO and $SiO_2$ in slag before Mg addition is adjusted to 36.3 mass %. Though Mg in the molten steel is 0.0028 mass %, Mg in the cast steel is 0.0008 mass %, and thus Mg yield is low and the solidification structure of the cast steel partially coarsens.

EXAMPLE 10

The example relates to the Processing Method V of the present invention.

150 tons of molten steel was received in a ladle, the thickness of slag covering the molten steel was controlled to 100 mm, CaO activity in slag and the basicity of slag were adjusted, and Mg alloy wire was supplied into the molten steel passing through the slag and dissolved so that 50 kg of Mg is added in terms of pure Mg in the molten steel.

Further, the molten steel was continuously cast at the casting speed of 0.6 m/min. using a continuous caster having a mold with an inner size of 1,200 mm in width and 250 mm in thickness.

Then, Mg mass % in the molten steel after Mg treatment and status of the fining of the solidification structure of the cast steel were investigated. The results are shown in Table 12.

TABLE 12

| Item | | CaO activity in slag | Basicity of slag ($CaO/SiO_2$) | Mg concentration in molten steel (mass %) | Solidification structure of cast steel | Synthetic judgement |
|---|---|---|---|---|---|---|
| Example | 1 | 0.20 | 3 | 0.0010 | ◎ | ◎ |
| | 2 | 0.25 | 7 | 0.0020 | ◎ | ◎ |
| | 3 | 0.30 | 10 | 0.0020 | ◎ | ◎ |
| Comparative example | 1 | 0.36 | 15 | 0.0050 | X | X |
| | 2 | 0.42 | 20 | 0.0100 | X | X |

Example 1 represents the case that Mg alloy wire is added while maintaining the CaO activity in slag at 0.2 and the basicity at 3. Mg concentration in molten steel after Mg treatment is 0.0010 mass %, the fining of the solidification structure in the cast steel is achieved (designated with the marks ◎), and the synthetic judgement is excellent (designated with the marks ◎).

Examples 2 and 3 represent the cases that CaO activity in slag is adjusted to 0.25 and 0.30, respectively, and basicity to 7 and 10, respectively. Mg concentration in molten steel is high, the solidification structure of the cast steel is fine (designated with the marks ◎), and the synthetic judgement is excellent (designated with the marks ◎).

On the contrary, comparative example 1 represents the case that Mg alloy wire is added while maintaining the CaO activity in slag at 0.36 and the basicity at 15, and Mg in molten steel after Mg treatment is adjusted to 0.0050 mass %. The solidification structure of the cast steel is coarse (designated with the marks X) and the synthetic judgement is bad (designated with the marks X).

Comparative example 2 represents the case that Mg alloy wire is added while maintaining the CaO activity in slag at 0.42 and the basicity at 20, and Mg in molten steel after Mg treatment is adjusted to 0.0100 mass %. The solidification structure of the cast steel is coarse (designated with the marks X) and the synthetic judgement is bad (designated with the marks X).

EXAMPLE 11

The example relates to a continuous casting method for producing Cast Steels A to D of the present invention.

0.005 mass % of Mg was added in molten steel containing 16.5 mass % of chromium, after that, the molten steel was continuously cast using an oscillation mold with an inner size of 1,200 mm in width and 250 mm in thickness, and the cast steel was cooled and solidified by the cooling with the mold and the water spray from support segments, and the cast steel was extracted with pinch rolls.

Then, the defects and the number of inclusions in the surface layer and interior of the cast steel and the solidification structure were investigated. Moreover, in the steel material produced by rolling the cast steel after being heated to the temperature of 1,250° C., corrosion resistance of the surface and the generation of wrinkles (ridging) were also investigated. The results are shown in Table 13.

TABLE 13

| Item | | | Example | Comparative example 1 | Comparative example 2 |
|---|---|---|---|---|---|
| Mg addition | | | Yes | Yes | No |
| Electromagnetic stirring | | | Yes | No | Yes |
| Cast steel | Surface layer | Inclusion | Few | Many | None |
| | | Solidification structure | Fine | Fine | Fine |
| | | Surface crack | None | None | None |
| | Interior | Inclusion | Many | Many | None |
| | | Solidification structure | Fine | Fine | Coarse |
| | | Internal crack | None | None | Present |
| | | Center segregation | Insignificant | Insignificant | Significant |
| Steel material | Corrosion resistance of surface | | Good | Bad | Good |
| | Wrinkle at rolling | | Good | Good | Bad |

In Table 13, example represents the case that molten steel is cast, being stirred by installing an electromagnetic stirrer so that the center of core is placed at the position 500 mm away from the meniscus in a mold in the downstream direction. In this example, it is possible to decrease the number of MgO-containing oxides (inclusions) in the surface layer of the cast steel, to make fine the solidification structure in the surface layer, and to prevent defects such as surface cracks, etc. Further, in the interior of the cast steel, it is possible to increase the number of MgO-containing oxides (inclusions), to obtain fine equiaxed crystals, and, as a result, to eliminate internal cracks, and to mitigate center segregation.

Further, in the steel material produced by rolling this cast steel, the corrosion resistance of the surface is good and wrinkles, etc., caused by the coarsening of the solidification structure do not appear.

On the contrary, comparative example 1 represents the case that the stirring of molten steel with an electromagnetic stirrer is not carried out. Though the number of MgO-containing oxides (inclusions) increases in the surface layer and interior of the cast steel and the solidification structure in the surface layer and interior can become fine, the existence of corrosion spots originated from MgO-containing oxides is recognized. The steel material is practically bad.

Comparative example 2 represents the case that Mg is not added but the stirring of molten steel with an electromagnetic stirrer is carried out. In the interior of the cast steel, the solidification structure coarsens and internal cracks and center segregation are generated, and, in the steel material produced by rolling the cast steel, wrinkles, etc., caused by the coarsening of the solidification structure are generated.

EXAMPLE 12

The example relates to applying the aforementioned continuous casting of the present invention to the casting of ferritic stainless molten steel, and further, to producing a seamless steel pipe from the cast steel.

0.0010 mass % of Mg was added in molten steel containing 13.0 mass % of chromium, after that, the molten steel was continuously cast using an oscillation mold with an inner size of 600 mm in width and 250 mm in thickness, and the cast steel was cooled and solidified by the cooling with the mold and the water spray from support segments, and the cast steel was extracted with pinch rolls.

Then, the solidification structure of the cast steel and the generation of defects in the surface and interior of the pierced seamless steel pipes were investigated. The results are shown in Table 14.

TABLE 14

| Item | | Mg addition amount in molten steel (mass %) | Electromagnetic stirring condition: Used or not used | Electromagnetic stirring condition: Stirring position | Soft reduction condition: Solid phase fraction when started | Soft reduction condition: Reduction amount (mm) | Solidification structure of cast steel | Internal and surface defect of steel pipe | Synthetic judgement |
|---|---|---|---|---|---|---|---|---|---|
| Example | 1 | 0.0010 | Not used | — | — | — | ○ | ○ | ○ |
| | 2 | 0.0010 | Used | 500 mm downstream from meniscus | 0.5 | 6 | ◎ | ◎ | ◎ |
| | 3 | 0.0010 | Not used | — | 0.4 | 7 | ○ | ◎ | ◎ |
| Comparative example | 1 | No addition | Used | 500 mm downstream from meniscus | — | — | X | X | X |
| | 2 | No addition | Not used | — | 0.4 | 7 | X | X | X |

In Table 14, example 1 represents the case that 0.0010 mass % of Mg is added in molten steel and a seamless steel pipe is produced by casting the molten steel. The solidification structure of the cast steel is fine (designated with the marks ○), cracks and scabs are not generated on the surface and in the interior of the steel pipe when pierced (designated with the marks ○), and thus the synthetic judgement is good (designated with the marks ○).

Example 2 represents the case that molten steel is cast, being stirred by installing an electromagnetic stirrer so that the center of the core is placed at the position 500 mm away from the meniscus in a mold in the downstream direction, and soft reduction is commenced from the position where solid phase rate is 0.5. In the surface layer of the cast steel, the number of MgO-containing oxides decreases, the solidification structure of the whole cast steel is fine (designated with the marks ◎), cracks and scabs are not generated at all on the surface and in the interior of the steel pipe when pierced (designated with the marks ◎), and thus the synthetic judgement is excellent (designated with the marks ◎).

Example 3 represents the case that 0.0010 mass % of Mg is added in molten steel, the molten steel is cast, and the cast steel is subjected to soft reduction at a total press down depth of 7 mm in the range from the position where solid phase rate becomes 0.4 to the position where the cast steel solidifies. The solidification structure of the cast steel is fine (designated with the marks ○), cracks and scabs are not generated on the surface and in the interior of the steel pipe when pierced (designated with the marks ◎), and thus the synthetic judgement is excellent (designated with the marks ◎).

On the contrary, comparative example 1 represents the case that molten steel is cast without adding Mg therein, electromagnetic stirring is applied at the position 500 mm away from the meniscus in the downstream direction, and the cast steel is pierced. The solidification structure of the cast steel coarsens (designated with the marks X), cracks and scabs are generated on the surface and in the interior of the steel pipe when pierced (designated with the marks X), and thus the synthetic judgement is bad (designated with the marks X).

Comparative example 2 represents the case that molten steel is cast without adding Mg therein and the cast steel is subjected to soft reduction at a total press down depth of 7 mm in the range from the position where solid phase rate becomes 0.4 to the position where the cast steel solidifies. The solidification structure of the cast steel coarsens (designated with the marks X), cracks and scabs are generated on the surface and in the interior of the steel pipe when pierced (designated with the marks X), and thus the synthetic judgement is bad (designated with the marks X).

INDUSTRIAL AVAILABILITY

In a cast steel of the present invention, suppressed are the generation of surface flaws such as cracks and dents, etc., generated in a cast steel caused by strain and stress during solidification process, surface flaws caused by inclusions, etc., and internal defects such as internal cracks, center porosity and center segregation, etc.

Therefore, a cast steel of the present invention is excellent in workability and quality, does not require reconditioning such as grinding of a cast steel, and also realizes high yield since the scrapping is minimized.

A processing method of the present invention is a method to control the properties of molten steel and the form of inclusions in molten steel so that the solidification structure is fine when the molten steel solidifies, and an extremely useful method to process molten steel for obtaining a cast steel of the present invention.

Further, a continuous casting method for producing a cast steel of the present invention is to enhance the effect of the function imposed on molten steel by the processing method of the present invention when the molten steel is continuously cast.

As a result, in steel materials such as steel sheets and steel pipes, etc., produced by processing a cast steel of the present invention, like the cast steel, the generation of surface flaws and internal defects is suppressed, and workability and quality are excellent.

What is claimed is:

1. A cast steel with excellent workability, characterized in that not less than 60% of the total cross section thereof is occupied by equiaxed crystals, the diameters (mm) of which satisfy the following formula:

$$D<1.2X^{1/3}+0.75,$$

wherein D designates each diameter (mm) of equiaxed crystals in terms of internal structure in which the crystal orientations are identical, and X the distance (mm) from the surface of the cast steel;

wherein average equiaxed crystal grain diameter is greater than 1 mm; and wherein the cast steel contains not less than 100/cm$^2$ of inclusions whose lattice incoherence with δ-ferrite formed during solidification of molten steel is not more than 6%.

2. A cast steel with excellent workability, characterized in that the maximum crystal grain diameter at a depth from the surface of the cast steel is not more than three times the average crystal grain diameter at the same depth;

wherein average equiaxed crystal grain diameter is greater than 1 mm; and wherein the cast steel contains not less than 100/cm$^2$ of inclusions whose lattice incoherence with δ-ferrite formed during solidification of molten steel is not more than 6%.

3. A cast steel with excellent workability according to claim 2, characterized in that not less than 60% of the cross section in the direction of the thickness of said cast steel is occupied by equiaxed crystals.

4. A cast steel with excellent workability and/or quality according to any one of claims 1 to 3, characterized by containing MgO and/or oxides including MgO.

5. A cast steel with excellent workability and/or quality according to any one of claims 1 to 3, characterized in that said cast steel is ferritic stainless steel.

6. A steel material with excellent workability and quality, characterized by heating a cast steel with excellent workability and/or quality according to any one of claims 1 to 3 to a temperature of 1,100 to 1,350° C., and then producing said steel material by applying process comprising rolling to said cast steel.

* * * * *